US008002604B2

(12) United States Patent
Van de Rostyne et al.

(10) Patent No.: US 8,002,604 B2
(45) Date of Patent: Aug. 23, 2011

(54) REMOTE CONTROLLED TOY HELICOPTER

(75) Inventors: Alexander Jozef Magdalena Van de Rostyne, Bornem (BE); Wong Kwok Leung, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 363 days.

(21) Appl. No.: 12/233,529

(22) Filed: Sep. 18, 2008

(65) Prior Publication Data

US 2009/0104836 A1 Apr. 23, 2009

Related U.S. Application Data

(63) Continuation-in-part of application No. 12/185,277, filed on Aug. 4, 2008, now Pat. No. 7,883,392, and a continuation-in-part of application No. 11/627,919, filed on Jan. 26, 2007, now Pat. No. 7,662,013, which is a continuation-in-part of application No. 11/465,781, filed on Aug. 18, 2006, now Pat. No. 7,815,482, which is a continuation-in-part of application No. 11/462,177, filed on Aug. 3, 2006.

(51) Int. Cl.
*A63H 27/127* (2006.01)
*B64C 27/00* (2006.01)

(52) U.S. Cl. ..... 446/37; 244/17.11

(58) Field of Classification Search ..... None
See application file for complete search history.

(56) References Cited

U.S. PATENT DOCUMENTS 934,771 A 9/1909 Turnbull
1,403,909 A 1/1922 Moir
1,446,522 A 2/1923 Smith
1,446,718 A * 2/1923 Newbauer ..... 244/6
1,470,017 A 10/1923 Lougheed
1,773,281 A 8/1930 Scott
1,800,470 A * 4/1931 Oehmichen ..... 416/40
(Continued)

FOREIGN PATENT DOCUMENTS

BE 338599 12/1926
(Continued)

OTHER PUBLICATIONS

Photographic prior art reference #1, helicopter.
(Continued)

*Primary Examiner* — Gene Kim
*Assistant Examiner* — Alyssa M Hylinski
(74) *Attorney, Agent, or Firm* — Greenberg Traurig, LLP

(57) ABSTRACT

A remote-controlled toy helicopter comprises a body; a motor in the helicopter, a battery for powering the motor, and a receiver for communicating signals between the motor and a separate remote controller. A main rotor with blades is driven by a rotor shaft and causing a first lift force developed by the main rotor when the helicopter is airborne. A system permits movement of the helicopter on the ground, and these can be wheels. The helicopter travels on a floor or ground surface when the main rotor develops a second degree of lift force. The helicopter includes a system to effect motion in a horizontal dimension thereby to direct the desired direction. The control includes an actuator for engaging with an assembly depending from the rotor, the inter-engagement of the actuator and assembly effecting a change in the angle of incidence of at least the one blade of the rotor. The system includes a rotor, preferably complemented with a stabilizer rotor.

28 Claims, 41 Drawing Sheets

U.S. PATENT DOCUMENTS 1,828,783 A 10/1931 Oehmichen
1,925,156 A 9/1933 Vaughn
2,030,578 A 2/1936 Flettner
2,110,563 A 3/1938 Thaon
2,272,643 A 2/1942 Peters et al.
2,275,094 A 3/1942 Taylor
2,307,381 A 1/1943 Bess
D140,480 S 2/1945 Maycen
2,368,698 A 2/1945 Young
2,384,516 A 9/1945 Young
2,411,596 A 11/1946 Shapiro
2,413,831 A 1/1947 Jordan
2,429,502 A 10/1947 Young
D149,130 S 3/1948 Katenberter et al.
2,439,143 A 4/1948 Nemeth
D153,314 S 4/1949 Piasecki
D153,315 S 4/1949 Piasecki
D153,316 S 4/1949 Piasecki
D153,317 S 4/1949 Piasecki
2,466,821 A 4/1949 Owen
2,469,144 A 5/1949 Baggott
2,481,750 A 9/1949 Hiller, Jr. et al.
2,486,059 A 10/1949 Pentecost
2,487,020 A 11/1949 Gilcrease
2,514,822 A 7/1950 Wolfe, Jr.
2,532,683 A 12/1950 Traver
2,554,938 A 5/1951 Catalano
D163,938 S 7/1951 Douglas
2,563,731 A 8/1951 Masterson
2,599,957 A * 6/1952 Walker ..... 446/68
2,614,637 A 10/1952 Landgraf
2,629,568 A 2/1953 Croshere, Jr. et al.
2,629,570 A 2/1953 Carnahan
2,633,924 A 4/1953 Young
2,638,707 A * 5/1953 Baker ..... 446/37
2,639,874 A 5/1953 Stalker
2,646,848 A 7/1953 Young
D171,569 S 3/1954 Apostolescu
2,720,928 A 10/1955 Warto
2,725,494 A 11/1955 Anderson
D178,081 S 6/1956 Papadakos
2,750,131 A 6/1956 Thomson
2,801,494 A * 8/1957 Ernst ..... 446/37
D181,643 S 12/1957 Graham
2,818,123 A 12/1957 Hiller, Jr.
2,822,994 A 2/1958 Warto
D184,501 S 2/1959 Wlaschin et al.
2,923,494 A 2/1960 Strong
D187,625 S 4/1960 Apostolescu
D187,895 S 5/1960 Douglas
2,950,074 A 8/1960 Apostolescu
2,980,187 A * 4/1961 Smyth-Davila ..... 416/18
2,987,848 A 6/1961 Neuhaus et al.
3,029,048 A * 4/1962 Brooks et al. ..... 244/17.19
3,035,643 A 5/1962 Kelley et al.
3,068,611 A 12/1962 Lauderdale
3,080,001 A * 3/1963 Culver et al. ..... 416/18
3,093,929 A 6/1963 Robbins et al.
3,106,964 A 10/1963 Culver et al.
3,116,896 A 1/1964 Sigler et al.
3,135,334 A 6/1964 Culver
3,180,424 A 4/1965 Serriades
3,213,944 A 10/1965 Nichols et al.
3,228,478 A 1/1966 Edenborough
3,231,222 A * 1/1966 Scheutzow ..... 244/17.19
D205,326 S 7/1966 Postelson-Apostolescu
3,321,022 A 5/1967 Oguri
3,370,809 A 2/1968 Leoni
3,371,886 A 3/1968 Schertz
3,391,746 A 7/1968 Cardoso
3,409,249 A 11/1968 Bergquist et al.
3,448,810 A 6/1969 Vogt
3,450,374 A 6/1969 Moore
3,460,628 A 8/1969 Tankersley
3,481,559 A 12/1969 Apostolescu
3,554,467 A 1/1971 Yowell
3,558,081 A * 1/1971 Williams ..... 244/17.19
3,572,616 A 3/1971 Ulisnik
3,592,559 A 7/1971 Ward
D221,453 S 8/1971 Swanberg
3,625,631 A 12/1971 Covington, Jr. et al.
3,662,487 A 5/1972 Seefluth
3,759,629 A 9/1973 Abramopaulos
3,771,924 A 11/1973 Buchstaller
D232,168 S 7/1974 Leoni
D232,170 S 7/1974 Diamond et al.
3,857,194 A * 12/1974 Guttman ..... 446/36
D234,350 S 2/1975 Beckert et al.
3,905,565 A * 9/1975 Kolwey ..... 244/17.23
3,933,324 A 1/1976 Ostrowski
D239,930 S 5/1976 Ulisnik
4,025,230 A 5/1977 Kastan
4,053,123 A 10/1977 Chadwick
4,073,086 A 2/1978 Ogawa
4,084,345 A 4/1978 Tanaka
4,118,143 A * 10/1978 Kavan ..... 416/18
4,142,697 A 3/1979 Fradenburgh
D253,003 S 9/1979 Tanaka
4,173,321 A 11/1979 Eickmann
4,195,439 A 4/1980 Kramer
4,227,856 A 10/1980 Verrill et al.
4,307,533 A 12/1981 Sims et al.
4,519,746 A 5/1985 Wainauski et al.
4,522,563 A 6/1985 Reyes et al.
4,629,440 A 12/1986 Mckittrick et al.
D287,738 S 1/1987 Bollinger et al.
D294,605 S 3/1988 Matsumoto
4,759,514 A * 7/1988 Burkam ..... 244/17.21
4,880,355 A 11/1989 Viullet et al.
4,941,803 A 7/1990 Wainauski et al.
4,958,786 A * 9/1990 Ogawa et al. ..... 244/17.13
4,981,456 A 1/1991 Sato et al.
5,015,187 A 5/1991 Lord
5,108,043 A 4/1992 Canavespe
5,151,014 A 9/1992 Greenwald et al.
5,190,242 A 3/1993 Nichols
5,203,520 A 4/1993 Przygodski et al.
5,209,429 A 5/1993 Doolin et al.
5,240,204 A 8/1993 Kunz
5,252,100 A 10/1993 Osawa et al.
5,255,871 A * 10/1993 Ikeda ..... 244/17.13
5,259,729 A * 11/1993 Fujihira et al. ..... 416/25
5,304,090 A * 4/1994 Vanni ..... 446/36
5,370,341 A 12/1994 Leon
5,388,785 A 2/1995 Rollet et al.
5,395,275 A 3/1995 Johnson et al.
D357,894 S 5/1995 Arnold et al.
5,505,407 A 4/1996 Chiapetta
5,511,947 A 4/1996 Schmuck
D372,741 S 8/1996 Tsai
D378,606 S 3/1997 Tamagnini
5,609,312 A 3/1997 Arlton et al.
5,628,620 A * 5/1997 Arlton ..... 416/114
D388,048 S 12/1997 Taylor et al.
D390,942 S 2/1998 Mei
5,749,540 A 5/1998 Arlton
5,836,545 A 11/1998 Arlton et al.
5,879,131 A 3/1999 Arlton et al.
5,906,476 A 5/1999 Arlton
5,915,649 A 6/1999 Head
5,971,320 A 10/1999 Jermyn et al.
6,000,911 A 12/1999 Toulmay et al.
D421,279 S 2/2000 Tsai
6,032,899 A 3/2000 Mondet et al.
6,039,541 A 3/2000 Parker et al.
D425,853 S 5/2000 Caporaletti
6,086,016 A 7/2000 Meek
6,231,005 B1 * 5/2001 Costes ..... 244/17.25
6,302,652 B1 10/2001 Roberts
6,398,618 B1 6/2002 Wu
6,435,453 B1 8/2002 Carter, Jr.
6,460,802 B1 10/2002 Norris
6,467,726 B1 10/2002 Hosoda
D467,861 S 12/2002 Lee
6,499,690 B1 12/2002 Katayama et al.
6,543,726 B2 4/2003 Illingworth
6,632,119 B2 10/2003 Chernek et al.

6,659,395 B2 12/2003 Rehkemper et al.
6,659,721 B1 12/2003 Parker et al.
6,688,936 B2 2/2004 Davis
6,702,552 B1 3/2004 Harman
6,719,244 B1 4/2004 Gress
6,732,973 B1 5/2004 Rehkemper
6,745,977 B1 6/2004 Long et al.
6,749,401 B2 6/2004 Vanmoor
6,758,436 B2 7/2004 Rehkemper et al.
D496,695 S 9/2004 Davis
6,789,764 B2 9/2004 Bass et al.
6,843,699 B2 1/2005 Davis
6,884,034 B1 4/2005 Parker et al.
6,886,777 B2 5/2005 Rock
6,899,586 B2 5/2005 Davis
6,929,215 B2 8/2005 Arlton
6,938,853 B2 9/2005 Pines et al.
6,960,112 B2 11/2005 Helmlinger et al.
6,978,969 B1 12/2005 Neal
D524,227 S 7/2006 Stille et al.
D524,228 S 7/2006 Scott et al.
D524,229 S 7/2006 Stille et al.
D524,230 S 7/2006 Stille et al.
D524,718 S 7/2006 Scott et al.
7,100,866 B2 9/2006 Rehkemper et al.
7,178,757 B1 2/2007 Breese et al.
7,178,758 B2 2/2007 Rehkemper
7,188,803 B2 3/2007 Ishiba
7,198,223 B2 4/2007 Phelps, III et al.
7,204,453 B2 4/2007 Muren
D544,825 S 6/2007 Van de Rostyne et al.
D545,755 S 7/2007 Van de Rostyne et al.
D546,269 S 7/2007 Van de Rostyne et al.
7,246,769 B2 7/2007 Yoeli
D548,803 S 8/2007 Zimet
7,255,623 B2 8/2007 Davis
7,264,199 B2 9/2007 Zientek
7,273,195 B1 9/2007 Golliher
D552,531 S 10/2007 Van de Rostyne et al.
D554,040 S 10/2007 Van de Rostyne et al.
7,306,186 B2 12/2007 Kusic
D559,764 S 1/2008 Wai
D561,084 S 2/2008 Wai
D561,085 S 2/2008 Wai
D561,676 S 2/2008 Wai
D561,677 S 2/2008 Wai
D561,678 S 2/2008 Wai
D561,679 S 2/2008 Wai
D568,947 S 5/2008 Van de Rostyne et al.
D576,215 S 9/2008 Van de Rostyne et al.
7,422,505 B2 9/2008 Van de Rostyne
7,425,167 B2 9/2008 Van de Rostyne
7,425,168 B2 9/2008 Van de Rostyne
D579,403 S 10/2008 Van de Rostyne et al.
D580,343 S 11/2008 Van de Rostyne et al.
D580,344 S 11/2008 Wai
D580,845 S 11/2008 Van de Rostyne et al.
D581,341 S 11/2008 Van de Rostyne et al.
D581,856 S 12/2008 Van de Rostyne et al.
D582,336 S 12/2008 Van de Rostyne et al.
D582,833 S 12/2008 Van de Rostyne et al.
D583,297 S 12/2008 Van de Rostyne et al.
7,467,984 B2 12/2008 Van de Rostyne
D585,810 S 2/2009 Van de Rostyne et al.
7,494,397 B2 2/2009 Van de Rostyne
7,497,759 B1 3/2009 Davis
2002/0008759 A1 1/2002 Hoyos
2002/0049518 A1* 4/2002 Yamamoto ..... 701/2
2002/0109044 A1 8/2002 Rock
2002/0134883 A1 9/2002 Stamps et al.
2004/0087241 A1 5/2004 Agostini et al.
2004/0162001 A1 8/2004 Davis
2004/0184915 A1 9/2004 Kunii et al.
2004/0222329 A1 11/2004 Kuhns et al.
2004/0245376 A1 12/2004 Muren
2005/0061909 A1 3/2005 Winston
2005/0121552 A1 6/2005 Rehkemper
2005/0121553 A1* 6/2005 Isawa et al. ..... 244/17.19
2006/0102777 A1 5/2006 Rock
2006/0121819 A1 6/2006 Isawa
2006/0231677 A1* 10/2006 Zimet et al. ..... 244/17.23
2007/0012818 A1* 1/2007 Miyazawa et al. ..... 244/17.25
2007/0017724 A1 1/2007 Rajasingham
2007/0105475 A1 5/2007 Gotou et al.
2007/0158494 A1 7/2007 Burrage
2007/0164148 A1 7/2007 Van de Rostyne
2007/0164149 A1 7/2007 Van de Rostyne
2007/0164150 A1 7/2007 Van de Rostyne
2007/0178798 A1 8/2007 Lai
2007/0181742 A1 8/2007 Van de Rostyne et al.
2007/0187549 A1 8/2007 Owen
2007/0215750 A1 9/2007 Shantz et al.
2007/0262197 A1 11/2007 Phelps et al.
2008/0067284 A1 3/2008 Bakker
2008/0111399 A1 5/2008 Zierten
2008/0112808 A1 5/2008 Schmaling et al.
2008/0207079 A1 8/2008 Corsiglia et al.
2008/0299867 A1 12/2008 Van de Rostyne et al.
2009/0008497 A1 1/2009 Corsiglia et al.
2009/0047861 A1 2/2009 Van de Rostyne et al.
2009/0047862 A1 2/2009 Van de Rostyne et al.
2009/0117812 A1 5/2009 Van de Rostyne et al.
2009/0163110 A1 6/2009 Van de Rostyne et al.

FOREIGN PATENT DOCUMENTS

BE 1016960 11/2007
CN 1496923 A 5/2004
DE 1 270 408 6/1968
DE 24 09 227 A1 9/1975
DE 40 17 402 A1 12/1991
DE 94 14 652 U1 11/1994
DE 203 14 041 U1 4/2004
DE 102 56 916 A 9/2004
DE 20 2007 00098 U1 4/2007
EM 000111869-0001 3/2004
EP 0 250 135 12/1987
EP 0 727 350 8/1996
EP 1 462 362 A1 9/2004
EP 1462362 A1 9/2004
ES P0233821 8/1957
ES P0234258 9/1957
ES P0245313 4/1959
ES P0283794 1/1963
ES 490715 4/1980
ES 275141 7/1982
ES 0298826 1/1989
ES 0464158 1/1992
ES 2 074 010 8/1995
ES 0727350 8/1996
ES 1238185 9/2002
ES 2172362 9/2002
ES 2251668 9/2004
FR 1 040 719 A 10/1953
FR 1 265 789 A 5/1961
GB 255936 7/1926
GB 272871 5/1927
GB 281721 8/1928
GB 916894 A 1/1963
GB 956536 4/1964
GB 958536 5/1964
GB 1081341 A 8/1967
GB 1533251 11/1978
GB 2 436 258 A 9/2007
JP S30-7668 10/1930
JP S32-003535 6/1932
JP 1269699 10/1989
JP 5192452 8/1993
JP 8150818 6/1996
JP 9048398 2/1997
JP 9512515 12/1997
JP 10076996 3/1998
JP 2000-272594 10/2000
JP 2003-103066 4/2003
JP 2003-220999 8/2003
JP 2004-121798 4/2004
JP 2004121798 A 4/2004
JP 2005-193905 7/2005
JP 2005193905 A 7/2005

| | | | |
|---|---|---|---|
| JP | 2006-051217 | | 2/2006 |
| WO | WO03/080433 | A1 | 10/2003 |
| WO | WO 2004/080556 | A2 | 9/2004 |
| WO | WO2006/075096 | | 7/2006 |

OTHER PUBLICATIONS

Photographic prior art reference #2, helicopter displaying writing in French on the tail.
Photographic prior art reference #3, explanation of the function of the flybar.
Photographic prior art reference #4, toy helicopter, www.raidentech.com.
Photographic prior art reference #5, toy helicopter.
Photographic prior art reference #6, helicopter.
Photographic prior art reference #7, helicopter with M40297 or MA0297 displayed on the tail.
Photographic prior art reference #8, toy helicopter #AHS-23900, hstoy.en.alibaba.com.
Photographic prior art reference #9, toy helicopter, toys999.en.alibaba.com.
Mill, Colin. "Practical Theories, Part 9", W3MH—World Wide Web *Model Helicopter Magazine*, Jul. 1996, http://www.w3mh.co.uk/articles/html/csm9-11.htm.
Day, David. "Moving swashplates & CCPM", 2001-2006. See http://www.iroquois.free-online.co.uk.
Selberg, B.P.; Cronin, D.L.; Rokhsaz, K.; Dykman, J.R., Yager, C. J. "Aerodynamic-Structural Analysis of Dual Bladed Helicopter Systems (Field Technical Report", Report No. NASA-CR-162754, Feb 80 46p (Abstract).
Ham, Normand. Helicopter individual-blade-control research at MIT 1977-1985; DGLR, European Rotorcraft Forum, 12th, Garmisch-Partenkirchen, West Germany; Germany, Federal Republic of; Sep. 22-25, 1986 10 pp. 1986 (Abstract).
Proctor, Paul. "Aviation Week & Space Technology", v146, n13, p47(1), Mar. 31, 1997 (Abstract).
Zein-Sabatto, S.; Zheng, Y. "Intelligent Flight Controllers for Helicopter Control"; 1997 IEEE International Conference on Neural Networks, Proceedings (Cat. No. 97CH36109) Part vol. 2 p. 617-621 vol. 2 (Abstract).
Mirick, Paul H. "A Comparison of Theory and Experiment for Coupled Rotor Body Stability of a Bearingless Rotor Model in Hover and Forward Flight", Jun. 1, 1988, IP Document Id 19880017770 pp. 87-101 (Abstract).
US District Court, Eastern District of Virginia, Norfolk Division, *Silverlit Toys Manufactory, Ltd*., et al. v. *Westminster, Inc*., et al., Case No. 2:07-cv-472-JBF/JEB.
US District Court, Northern District of Georgia, Atlanta Division, *Westminsterm, Inc*. v. *Silverlit Toys Manufactory Ltd*. et al., Case No. 1:07-cv-2450-JOF.
US District Court, Central District of California, Southern Division, *Innovage LLC* v. *Silverlit Toys Manufactory, Ltd*., et al., Case No. SACV07-1334 DOC (ANx).
"Declaration of Alexander Van De Rostyne in Support of Defendants and Counterclaimants Silverlit Toys Manufactory Ltd.'s and Spin Master Ltd.'s Motion for Preliminary Injunction", with relevant Exhibits A, C and E-Q, filed on Dec. 3, 2007, in USDC Case No. SACV07-1334 DOC (ANx).
"Declaration of Kei Fung ("Kevin") Choi in Support of Defendants and Counterclaimants' Motion for Preliminary Injunction", with relevant Exhibits A, C, and E, filed on Dec. 3, 2007, in USDC Case No. SACV07-1334 DOC (ANx).
"Declaration of L. Kenneth Rosenthal in Support of Counterclaimants Silverlit Toys Manufactory Ltd.'s and Spin Master Ltd.'s Motion for Preliminary Injunction", with relevant Exhibits O, P, S, V, Y, BB, MM and NN, filed on Dec. 3, 2007, in USDC Case No. SACV07-1334 DOC (ANx).
"Memorandum of Points and Authorities in Support of Motion for Preliminary Injunction of Silverlit Manufactory Ltd. and Spin Master Ltd.", filed on Dec. 3, 2007, in USDC Case No. SACV07-1334 DOC (ANx).
"Declaration of Valerie W. Ho in Support of Defendants and Counterclaimants' Motion for Preliminary Injunction", with relevant Exhibits A, B and M, filed on Dec. 3, 2007, in USDC Case No. SACV07-1334 DOC (ANx).
"Declaration of Conor Forkan in Support of Counterclaimants Silverlit Toys Manufactory Ltd.'s and Spin Master Ltd.'s Reply to Innovage's Opposition to Motion for Preliminary Injunction", with relevant Exhibits A-D, filed on Dec. 26, 2007, in USDC Case No. SACV07-1334 DOC (ANx).
"Declaration of L. Kenneth Rosenthal in Support of Counterclaimants Silverlit Toys Manufactory Ltd.'s and Spin Master Ltd.'s Reply to Innovage's Opposition to Motion for Preliminary Injunction", with relevant Exhibits A-D, filed on Dec. 26, 2007, in USDC Case No. SACV07-1334 DOC (ANx).
"Counterclaimants Silverlit Toys Manufactory Ltd.'s and Spin Master Ltd.'s Reply in Support of Motion for Preliminary Injunction", filed on Dec. 26, 2007, in USDC Case No. SACV07-1334 DOC (ANx).
"Innovage's Memorandum of Points and Authorities in Opposition to Silverlit and Spin Master's Motion for Preliminary Injunction", filed on Dec. 19, 2007, in USDC Case No. SACV07-1334 DOC (ANx).
"Declaration of Francisco Rubio-Campos in Support of Plaintiff Innovage LLC's Opposition to Silverlit and Spin Master's Motion for Preliminary Injunction", filed on Dec. 19, 2007, in USDC Case No. SACV07-1334 DOC (ANx).
"Declaration of Jennifer Hamilton in Support of Plaintiff Innovage LLC's Opposition to Silverlit and Spin Master's Motion for Preliminary Injunction", filed on Dec. 19, 2007, in USDC Case No. SACV07-1334 DOC (ANx).
"Counterclaim Defendant Merchsource's Opposition to Preliminary Injunction", filed on Dec. 19, 2007, in USDC Case No. SACV07-1334 DOC (ANx).
"Declaration of Lowell Anderson in Opposition to Preliminary Injunction", filed on Dec. 19, 2007, in USDC Case No. SACV07-1334 DOC (ANx).
"Supplemental Declaration of Francisco Rubio-Campos in Support of Plaintiff Innovage LLC's Opposition to Silverlit and Spin Master's Motion for Preliminary Injunction", filed on Jan. 4, 2008, in USDC Case No. SACV07-1334 DOC (ANx).
"Declaration of Nicholas Ringold in Support of Defendants and Counterclaimants' Reply to Merchsource LLC's Opposition to Ex Parte Application to Shorten Time for Hearing on Preliminary Injunction", with relevant Exhibits B-I, filed on Dec. 5, 2007, in USDC Case No. SACV07-1334 DOC (ANx).
"Declaration of Kei Fung ("Kevin") Choi in Support of Defendants and Counterclaimants' Reply to Merchsource LLC's Opposition to Ex Parte Application to Shorten Time for Hearing on Preliminary Injunction", with Exhibit A, filed on Dec. 6, 2007, in USDC Case No. SACV07-1334 DOC (ANx).
"Counterclaimants Silverlit Toys Manufactory Ltd.'s and Spin Master's Reply to Merchsource LLC's Opposition to Ex Parte Application to Shorten Time on Hearing on Motion for Preliminary Injunction", filed on Dec. 6, 2007, in USDC Case No. SACV07-1334 DOC (ANx).
"Counterclaimants Silverlit Toys Manufactory Ltd.'s and Spin Master's 1) Reply to Innovage LLC's Opposition to Ex Parte Application to Shorten Time on Hearing on Motion for Preliminary Injunction, and 2) Opposition to Innovage LLC's Ex Parte Application for Order to Extend Time to Oppose Motion for Preliminary Injunction", filed on Dec. 5, 2007, in USDC Case No. SACV07-1334 DOC (ANx).
"Declaration of Lowell Anderson in Opposition to Ex Parte Application to Shorten Time for Hearing on Preliminary Injunction", filed on Dec. 4, 2007, in USDC Case No. SACV07-1334 DOC (ANx).
"Counterclaim Defendant Merchsource's Opposition to Ex Parte Application to Shorten Time for Hearing on Motion for Preliminary Injunction", filed on Dec. 4, 2007, in USDC Case No. SACV07-1334 DOC (ANx).
"Plaintiff Innovage LLC's Opposition to Defendant Silverlit and Spin Master's Ex Parte Application for Order to Shorten Time for Hearing on Defendants' Motion for Preliminary Injunction; Declaration of Barry Messner in Support", filed on Dec. 4, 2007, in USDC Case No. SACV07-1334 DOC (ANx).

"Plaintiff Innovage LLC's Ex Parte Application for Order to Extend Time to Oppose Defendants' Motion for Preliminary Injunction; Memorandum of Points and Authorities; Declaration of Barry Messner", filed on Dec. 4, 2007, in USDC Case No. SACV07-1334 DOC (ANx).
"Amended Answer, Affirmative Defenses and Counterclaims for: (1) Patent Infringement; (2) Trade Dress Infringement; (3) Unfair Competition and False Designation of Origin; (4) Unfair Competition Under California Business & Professions Code § 17200; and (5) Copyright Infringement", filed on Dec. 11, 2007, in USDC Case No. SACV07-1334 DOC (ANx).
"Innovage's Reply in Opposition of Silverlit and Spin Master to Plaintiff Innovage LLC's Ex Parte Application for Order to Extend Time to Oppose Defendants' Motion for Preliminary Injunction", filed on Dec. 7, 2007, in USDC Case No. SACV07-1334 DOC (ANx).
"Counterclaim Defendant Innovage LLC's Amended Reply and Affirmative Defenses to Counterclaims of Silverlit Toys Manufactory Ltd. and Spin Master Ltd.", filed on Jan. 9, 2008, in USDC Case No. SACV07-1334 DOC (ANx).
"*ORDER* Denying Defendants' Motion for Preliminary Injunction", filed on Jan. 8, 2008, in USDC Case No. SACV07-1334 DOC (ANx).
"Counterclaimants Silverlit Toys Manufactory Ltd.'s and Spin Master's Ltd.'s Objection and Motion to Strike Plaintiff Innovage LLC's Belated Supplemental Declaration of Francisco Rubio-Campos", filed on Jan. 4, 2008, in USDC Case No. SACV07-1334 DOC (ANx).
"Supplemental Declaration of Francisco Rubio-Campos in Support of Plaintiff Innovage LLC's Opposition to Silverlit ad Spin Master's Motion for Preliminary Injunction", filed on Jan. 4, 2008, in USDC Case No. SACV07-1334 DOC (ANx).
"Counterclaim Defendant Innovage LLC's Reply and Affirmative Defenses to Counterclaims of Silverlit Toys Manufactory Ltd. and Spin Master Ltd.", filed on Dec. 26, 2007, in USDC Case No. SACV07-1334 DOC (ANx).
"Counterclaim Defendant Merchsource LLC's Answer and Defenses to Counterclaims of Silverlit Toys Manufactory Ltd. and Spin Master Ltd.", filed on Dec. 26, 2007, in USDC Case No. SACV07-1334 DOC (ANx).
"Answer, Affirmative Defenses and Counterclaims for: (1) Patent Infringement; (2) Trade Dress Infringement; (3) Unfair Competition and False Designation of Origin; and (4) Unfair Competition Under California Business & Professions Code § 17200", with Exhibits E & F, filed on Dec. 3, 2007, in USDC Case No. SACV07-1334 DOC (ANx).
"Complaint for: 1) Declaratory Judgment of Invalidity and Non-Infringement of Certain Design Patents; 2) Declaratory Judgment of Invalidity and Non-Infringement of Trade Dress", filed on Nov. 13, 2007, in USDC Case No. SACV07-1334 DOC (ANx).
Photo of portion of PicooZ product package; Silverlit 2006 Product Catalog (5 pages total).
Partial International Search from PCT/US2006/047982.
Photographic prior art reference, Dragonfly helicopter (2005) (4 pages).
*Piccolino: 1.69 gram RC helicopter*—RCGroups.com, http://www.rcgroups.com/forums/showthread.php?t=509295, Apr. 24, 2006 (6 pages).
International Search from PCT/US2008/051938.
Pryun, Richard R. "In-flight measurement of rotor blade airloads, bending moments, and motions, together with rotor shaft loads and fuselage vibration, on a tandem rotor helicopter", *Boeing*, Nov. 1967 (Abstract, 1 pg).
Brahmananda, et al. "Application of passive dampers to modern helicopters", Smart Mater, 1996 http://www.iop.org/EJ/abstract/0964-1726/5/5/001 (Abstract, 1 pg).
http://www.microhelicopters.net, Jul. 7, 2008 (3 pgs).
Castillo, et al. "Real-time stabilization and tracking of a four-rotor mini rotorcraft", IEEE, Jul. 2004 http://www.ieeexplore.org/xpl/freeabs_all.jsp?arnumber=1308180 (1 pg).
"Structural Components, Design of Tilt-Rotor JVX Near Completion", Aviation Week & Space Technology, vol. 122, No. 2, p. 84, Jan. 14, 1985 (10 pgs).
European Search Opinion dated Jun. 10, 2008, in EP 06 845 583.1.
Website reference, en.wikipedia.org/wiki/Kamov_Ka-50, Kamov Ka-50, Jun. 19, 2004 (6 pages).
Photographic reference, en.wikipedia.org/wiki/Image:Kamov_Ka-50_MAKS-2005.jpg, Aug. 28, 1995.
Photographic reference, www.fas.org/man/dod-101/sys/ac/row/ka-50-hokum.jpg, Aug. 28, 1995.
Photographic reference, www.aviastar.org/foto/ka-50_1.jpg, Aug. 28, 1995.
Website reference, web.archive.org/web/20050225044931/http://www.silverlit.com (2 pages), Jun. 5, 2007.
Website reference, web .archive.org/web/20060616140712/boeing.com/rotorcraft/military/ah64d/index.htm, Nov. 23, 2001 (2 pages).
Website reference, en.wikipedia.org/wiki/AH-64_Apache, Jul. 16, 2004 (11 pages).
Website reference, http://www.globalsecurity.org/military/systems/aircraft/ah-64d.htm, Nov. 7, 2001 (6 pages).
Photographic reference, www.fas.org/man/dod-101/sys/ac/ah-64.gif, Aug. 19, 2000.
Photographic reference, en.wikipedia.org/wiki/Image:P320007.jpg, 1981 (3 pages).
Photographic reference, www.fas.org./man/dod-101/sys/ac/ah-64d_001.jpg, Mar. 21, 1997.
Photographic reference, www.fas.org./man/dod-101/sys/ac/ah-64d-image83.jpg, Aug. 19, 2000.
Photographic reference, www.fas.org./man/dod-101/sys/ac/ah-64d-longbow1.jpg, Aug. 19, 2000.
Photographic reference, www.fas.org/man/dod-101/sys/ac/ah-64-dvic294.jpg, Feb. 2, 2003.
Photographic reference, www.voodoo.cz/ah64/pics/ah115.jpg, Jun. 14, 2001.
Photographic reference, www.voodoo.cz/ah64/pics/ah122.jpg, Jan. 10, 2002.
Photographic reference, www.voodoo.cz/ah64/pics/ah106.jpg, Jan. 9, 2002.
Photographic reference, www.voodoo.cz/ah64/pics/ah112.jpg, Aug. 22, 2002.
Photographic reference, www.voodoo.cz/ah64/pics/ah092.jpg, Jan. 8, 2002.
Photographic reference, www.voodoo.cz/ah64/pics/ah153.jpg, Apr. 4, 2002.
Photographic reference, www.voodoo.cz/ah64/pics/ah149.jpg, Jul. 8, 2000.
Photographic reference, www.voodoo.cz/ah64/pics/ah051.jpg, Jan. 8, 2002.
Photographic reference, www.voodoo.cz/ah64/pics/ah049.jpg, Mar. 15, 2002.
Photographic reference, www.voodoo.cz/ah64/pics/ah027.jpg, May 8, 1999.
Photographic reference, www.voodoo.cz/ah64/pics/ah010.jpg, Jul. 8, 2000.
Photographic reference, www.voodoo.cz/ah64/pics/ah003.jpg, Sep. 1, 2001.
Photographic reference, www.airforceworld.com/heli/gfx/ah64/wah64_1.jpg, 1991.
Photographic reference, www.fas.org/man/dod-101/sys/ac/ah-64a-990421-F-2095R-004.jpg, Aug. 19, 2000.
Photographic reference, www.fas.org/man/dod-101/sys/ac/ah-64-dvic292.jpg, Aug. 19, 2000.
Website reference, www.runryder.com/helicopter/t285494p1/, Jun. 12, 2007 (10 pages).
Website reference, web.archive.org/web/20031218200732/http://www.scarlet.be/pixel/pixeli111.htm, Dec. 18, 2003 (7 pages).
Website reference, web.archive.org/web/20031017234927/http://www.scarlet.be/pixel/pixelfp.htm, Oct. 17, 2003 (2 pages).
Website reference, web.archive.org/web/20031218061901/http://pixelito.reference.be/, Dec. 18, 2003 (4 pages).
Website reference, www.aviastar.org/helicopters$_{13}$ eng/breguet-dorand.php, 1935 (4 pages).
Website reference, www.lionheartcreations.com/Lionheartsflightsimsite_page7.html, May 6, 2004.(4 pages).
Website reference, www.lionheartcreations.com/FalconE.html, Jun. 22, 2004 (2 pages).

Photographic reference, www.rotaryaction.com/images/airwolf4.jpg, 1984.
Website reference, www.rotaryaction.com/pages/airwolf.html, 1984 (3 pages).
Website reference, http://www.youtube.com/watch?v=DsXgmOurwts, "Golden Age Pioneers—Nicolas Florine", Mar. 28, 2008 (4 pages).
Robert Dingemanse, Press Release "Flying Car Company Takes Off", Mar. 2007, http://www.pal-v.com.
"Esky Dauphin 4-channels Mini Electric Coaxial Helicopter", http://www.esky-heli.com/esky-24g-4ch-dauphin-bluegrey-rtf-kit-for-beginner-flightsim-p-2994.html, May 8, 2008.
Chinook Helicopter, first flight 1961, as referenced in Wikipedia http://en.wikipedia.org/wiki/CH-47_Chinook, Dec. 15, 2008 (11 pages).
Office Action dated Feb. 10, 2009, from pending U.S. Appl. No. 11/462,177 (9 pages).
Office Action dated Feb. 10, 2009, from pending U.S. Appl. No. 11/465,781 (9 pages).
Office Action dated May 8, 2008, from U.S. Appl. No. 11/754,752, now 7,494,397 (9 pages).
Office Action dated May 7, 2008, from U.S. Appl. No. 11/842,719, now 7,467,984 (9 pages).
Office Action dated May 8, 2008, from U.S. Appl. No. 11/953,826, now 7,425,167 (10 pages).
Office Action dated May 8, 2008, from U.S. Appl. No. 11/953,830, now 7,425,168 (10 pages).
Office Action dated May 8, 2008, from U.S. Appl. No. 11/953,823, now 7,422,505 (11 pages).
Office Action dated Mar. 31, 2009, from pending U.S. Appl. No. 12/264,890 (8 pages).
Office Action dated May 29, 2009, from pending U.S. Appl. No. 12/264,890 (10 pages).
Office Action dated Jun. 1, 2009, from pending U.S. Appl. No. 11/627,919 (9 pages).
Office Action dated Jun. 2, 2009, from pending U.S. Appl. No. 11/736,506 (9 pages).
Office Action dated Jun. 16, 2009, from pending U.S. Appl. No. 12/402,446 (10 pages).
Davis: Vectron Ultralite Battery Operated Radio/Infrared Controlled Flying Saucer Toy; U.S. Copyright Registration. VA 1-285-847.
Rotory Modeler Magazine; Mar./Apr. 2005 issue; 62 pages; Moneta, VA US; www.rotory.com.
Rotory Modeler Magazine; Jan./Feb. 2005 issue; 2 pp.; Moneta, VA US: www.rotory.com.
Hirobo Indoor Flight Helicopter, X.R.B SRIama Sky Robo; product manuel; Jul. 2004; 37 pages; http://model.hirobo.co.jp/; (Japanese text).
Hirobo Indoor Flight Helicopter, S.R.B SRIama sky Robo; product manuel; Jul. 2004; 37 pages; http://model.hirobo.co.jb/; (English translation).
Rotory Modeler Magazine; Mar./Apr. 2005 issue; 12 pages; Moneta, VA US; www.rotory.com.
Rotoryworld Magazine; Issue Seven; Dec./Jan. 2005 issue; 4 pages; Bedfordshire UK.
Flyrc Magazine; Mar. 2005 issue; 6 pages; US.
Model Helicopter World Magazine; Mar. 2005 issue; 7 pages; UK.
Rotory Modeler Magazine; Jan./Feb. 2005 issue; 2 pages; Moneta, VA US; www.rotory.com.
Parts List; Hirobo S.R.B. Price List; Jul./Jan./Oct. 2004; 4 pages; Edison, NJ US.
Cambridge Aerospace Series, Principles of Helicopter Aerodynamics; 2000; 5 pages; New York, NY US; www.cambridge.org/9780521660600.

* cited by examiner

REMOTE CONTROLLED TOY HELICOPTER

RELATED APPLICATION

This application is a continuation-in-part of U.S. patent application Ser. No. 12/185,277, filed Aug. 4, 2008 and U.S. patent application Ser. No. 11/627,919, filed Jan. 26, 2007, which is a continuation in part of U.S. patent application Ser. No. 11/465,781, filed Aug. 18, 2006, which is a continuation-in-part of U.S. patent application Ser. No. 11/462,177, filed Aug. 3, 2006, which claims priority to Belgian Patent Application No. 2006/0043, filed Jan. 19, 2006, the contents of all of which are incorporated by reference herein in their entirety.

BACKGROUND

The present disclosure concerns an improved flying object such as a helicopter.

The disclosure concerns a helicopter generally. In particular, but not exclusively, it is related to a toy helicopter and in particular to a remote-controlled model helicopter with increased functionality.

SUMMARY

A remote-controlled toy helicopter comprises a body; a motor in the helicopter, a battery for powering the motor, and a receiver for communicating signals between the motor and a separate remote controller. The main rotor with blades is driven by a rotor shaft and causes a first lift force developed by the main rotor when the helicopter is airborne and acts as a flying toy or helicopter. The lift force greater than this first degree of force can retain the helicopter flying and or rising.

There is a device, unit or mechanism for permitting movement, such as wheels for permitting the helicopter to travel on a floor or ground surface when the main rotor develops a second degree of lift force. In this second mode the toy acts as a car. The second degree of force is less than the first degree of force.

DRAWINGS

In order to further explain the characteristics of the disclosure, the following embodiments of an improved helicopter according to the disclosure are given as an example only, without being limitative in any way, with reference to the accompanying drawings, in which:

The above-mentioned features and objects of the present disclosure will become more apparent with reference to the following description taken in conjunction with the accompanying drawings wherein like reference numerals denote like elements and in which:

FIG. 1 schematically represents a helicopter according to the disclosure in perspective;

FIG. 2 represents a top view according to arrow F2 in FIG. 1;

Figure 11:
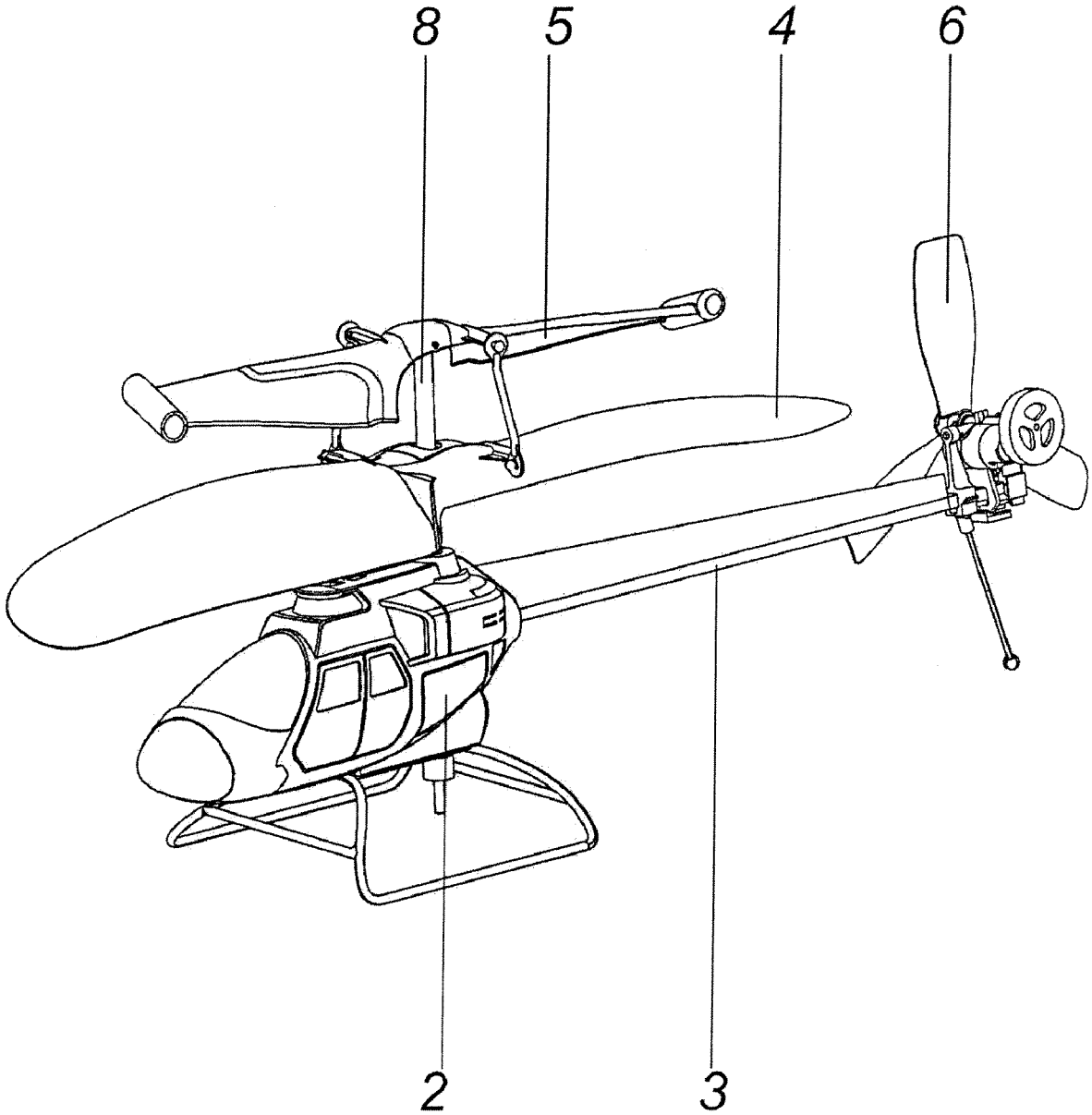
Figure 12:
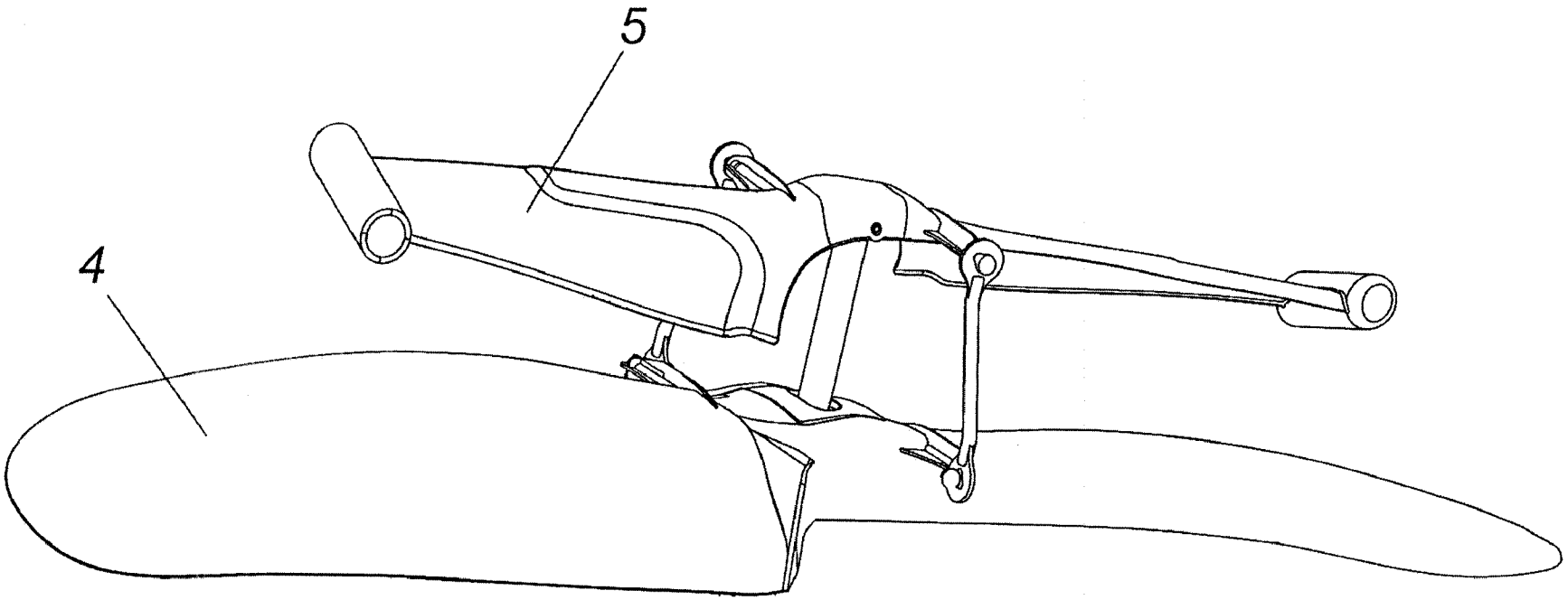
Figure 13:
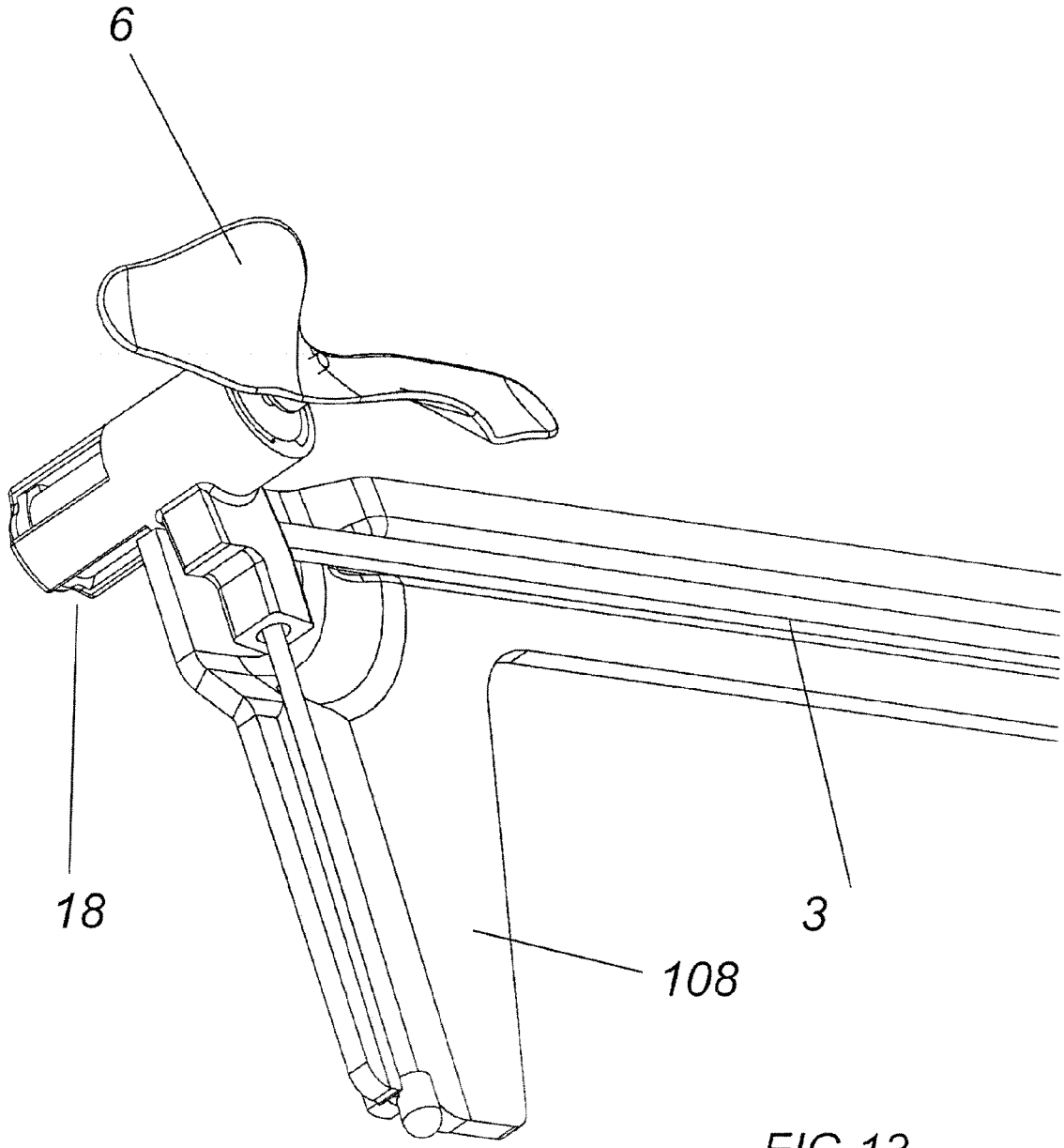
Figure 14:
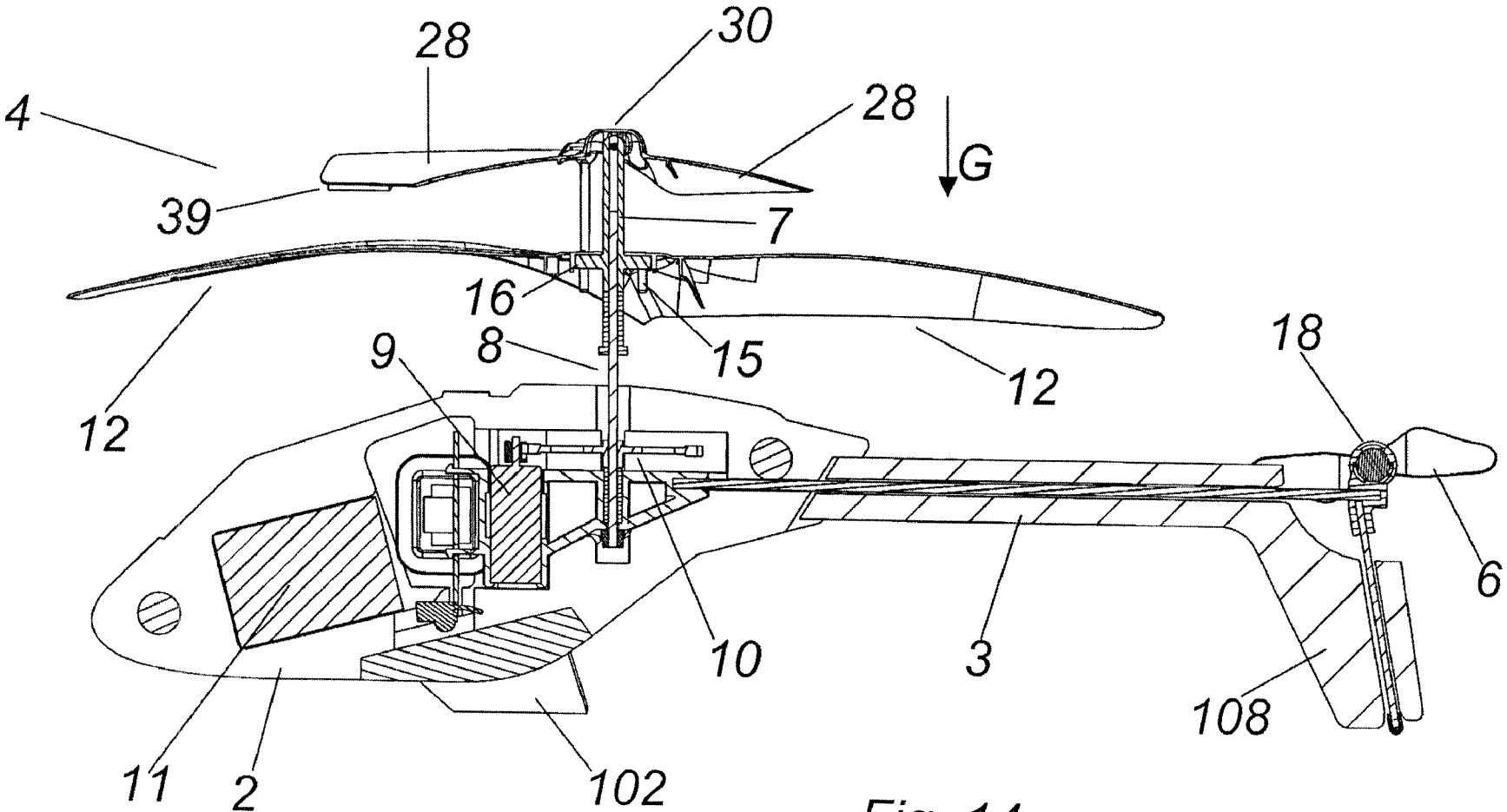
Figure 15:
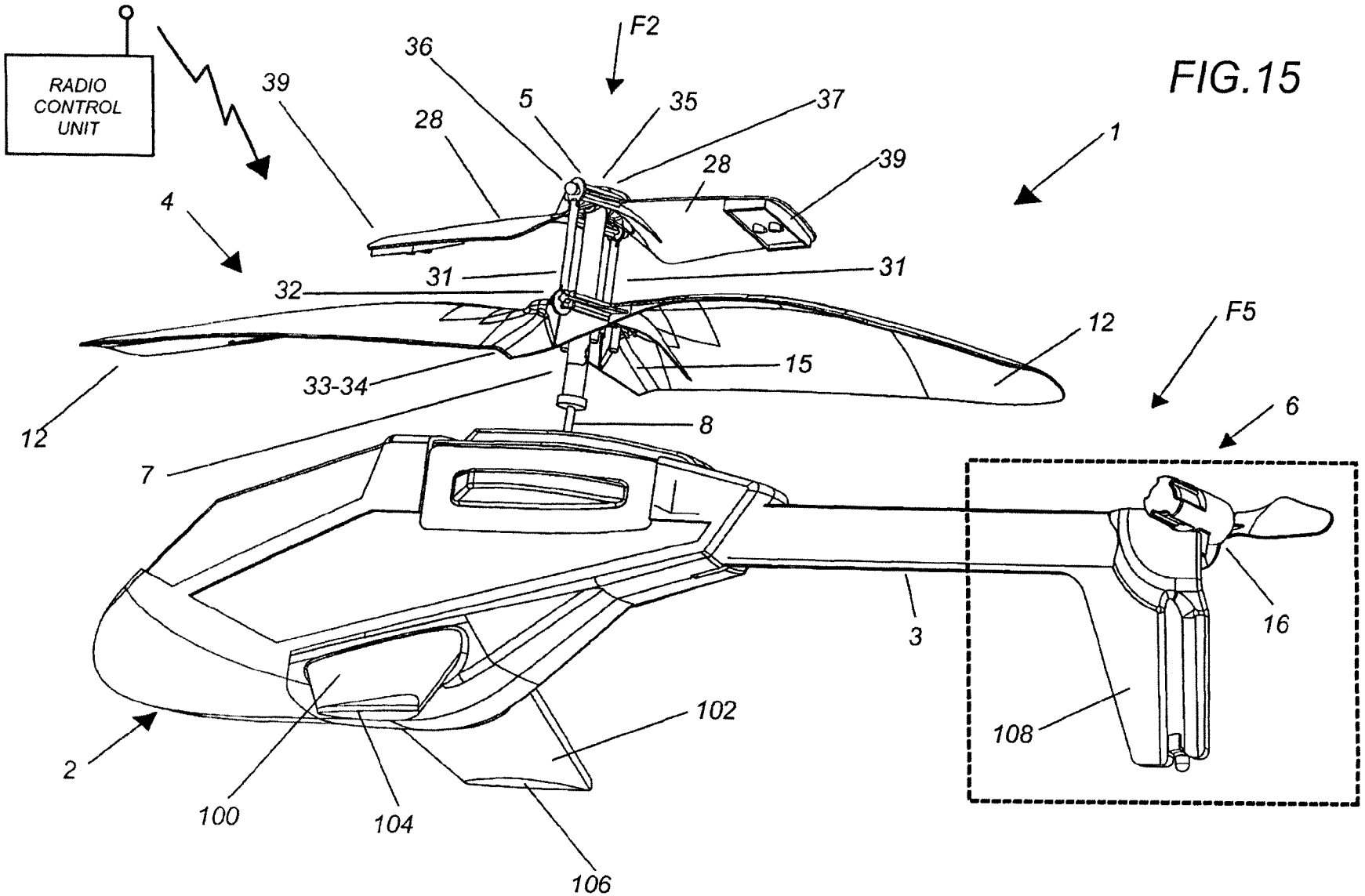
Figure 16:
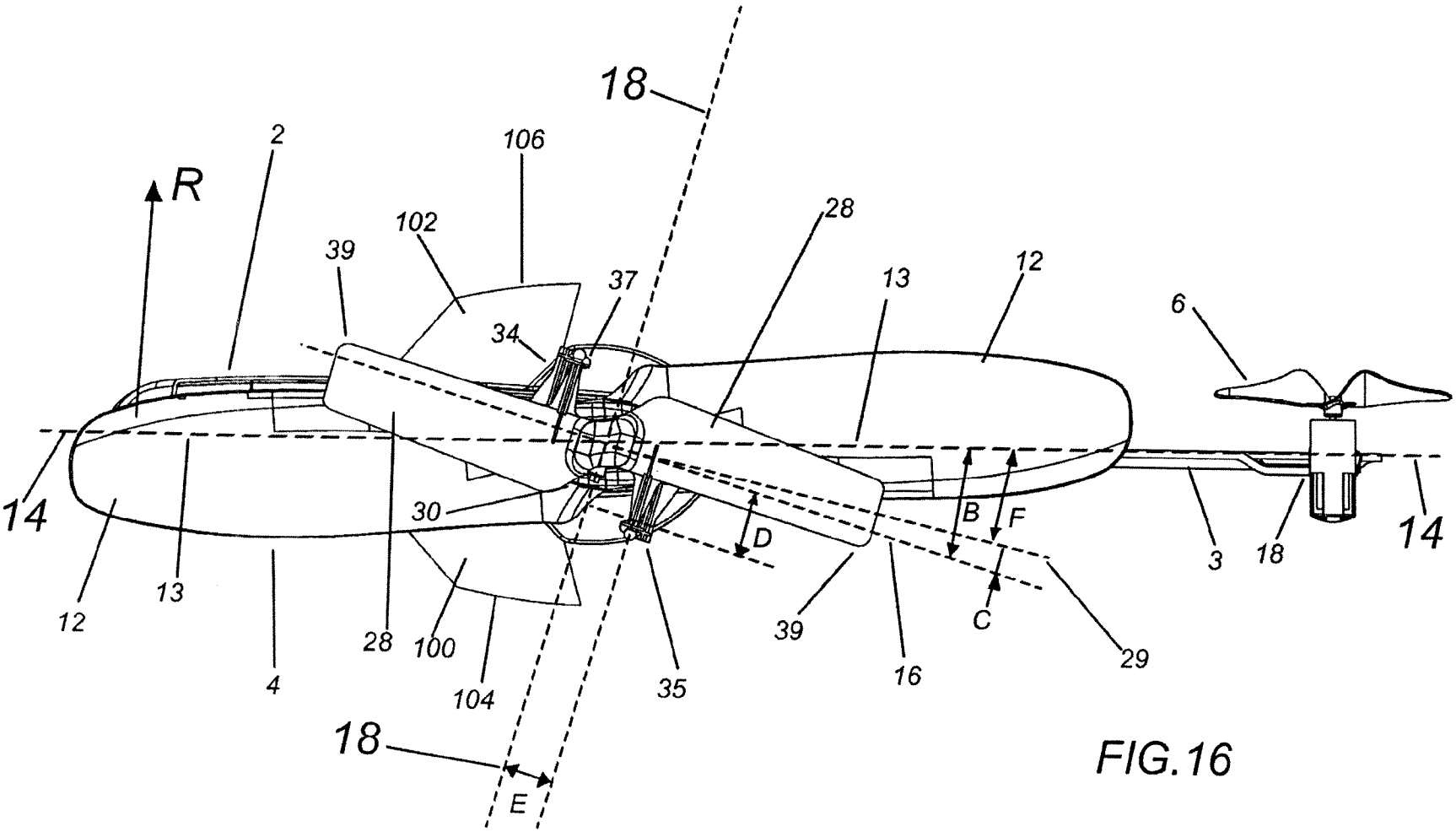
Figure 17:
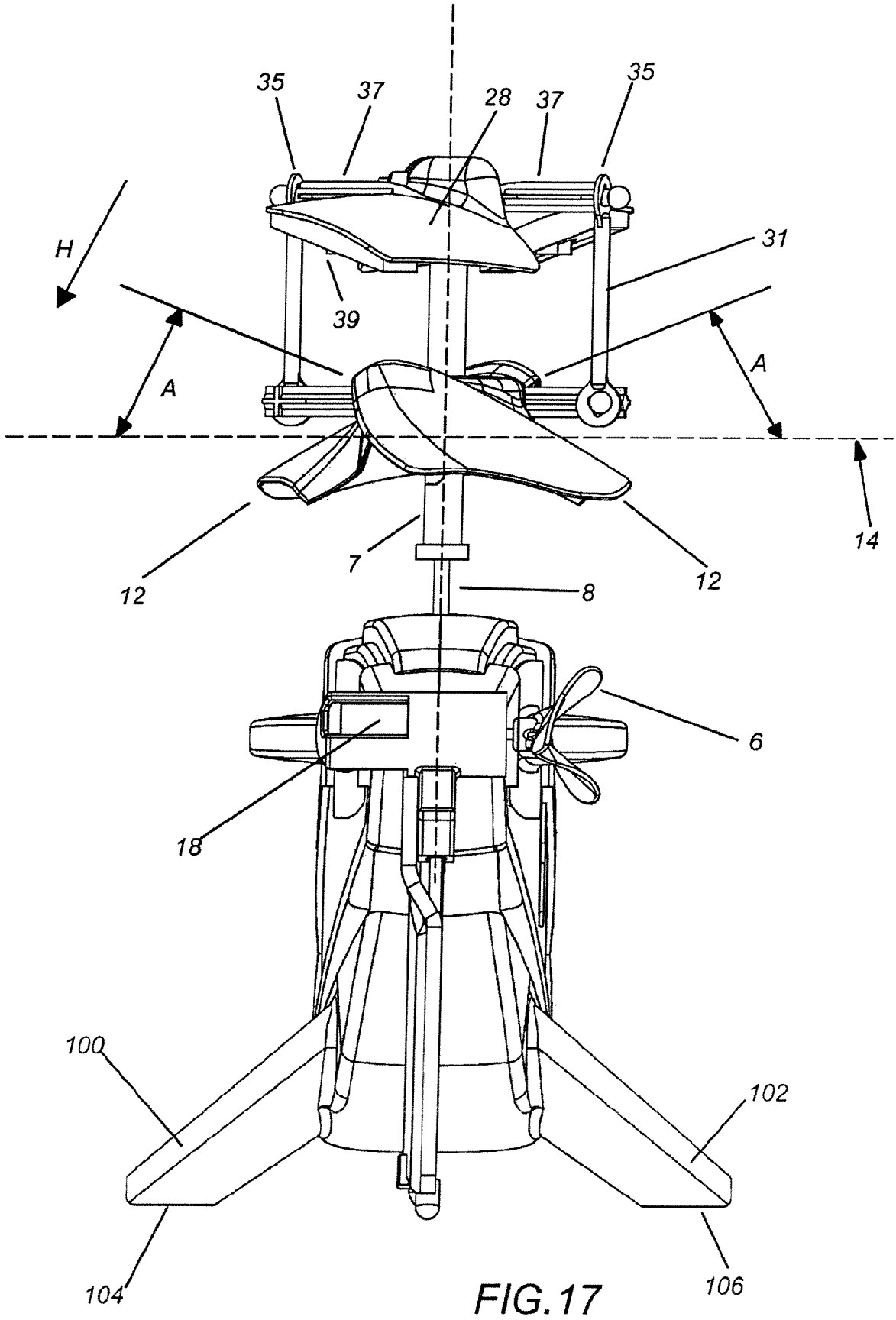
Figure 18:
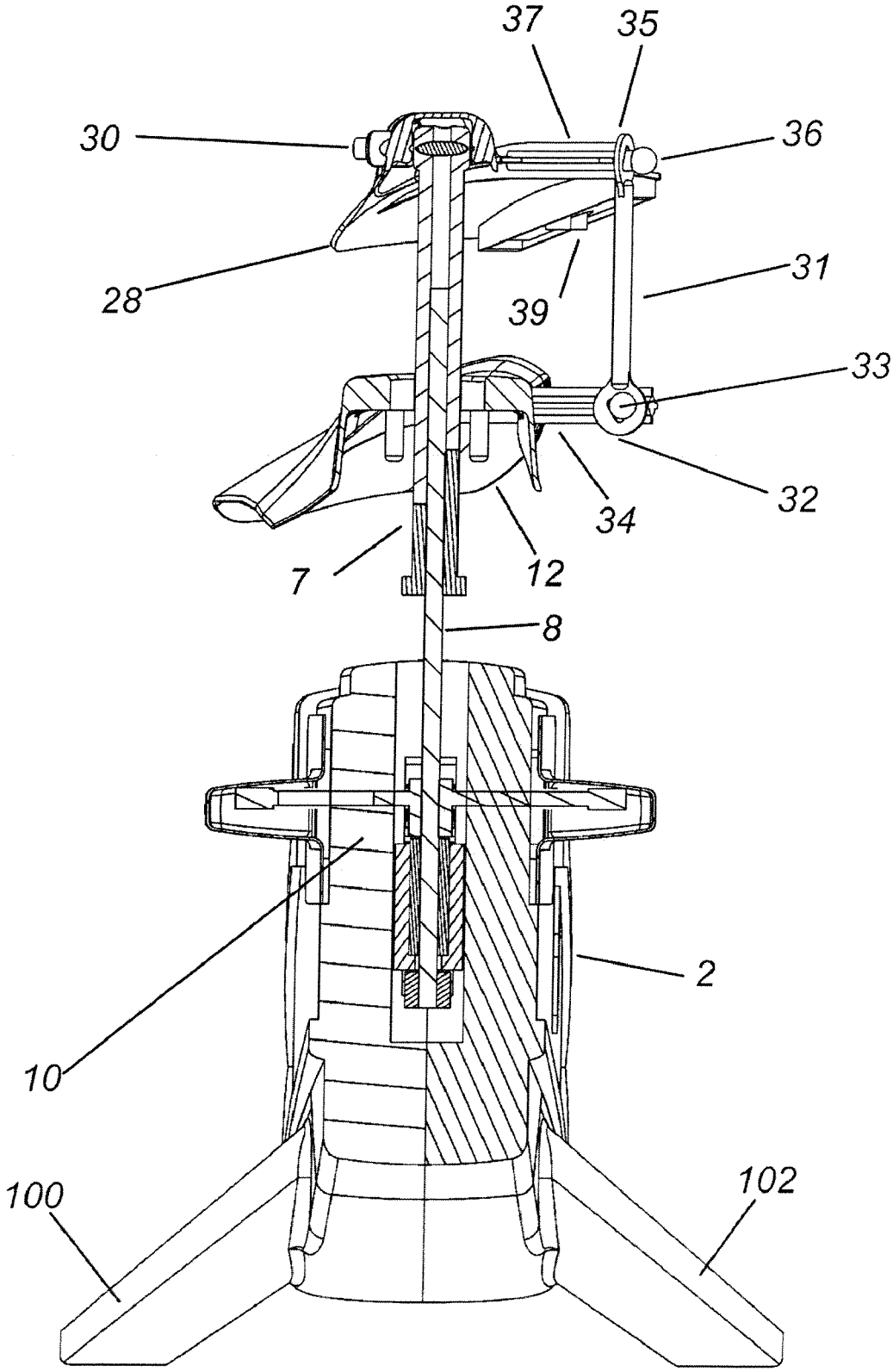
Figure 19:
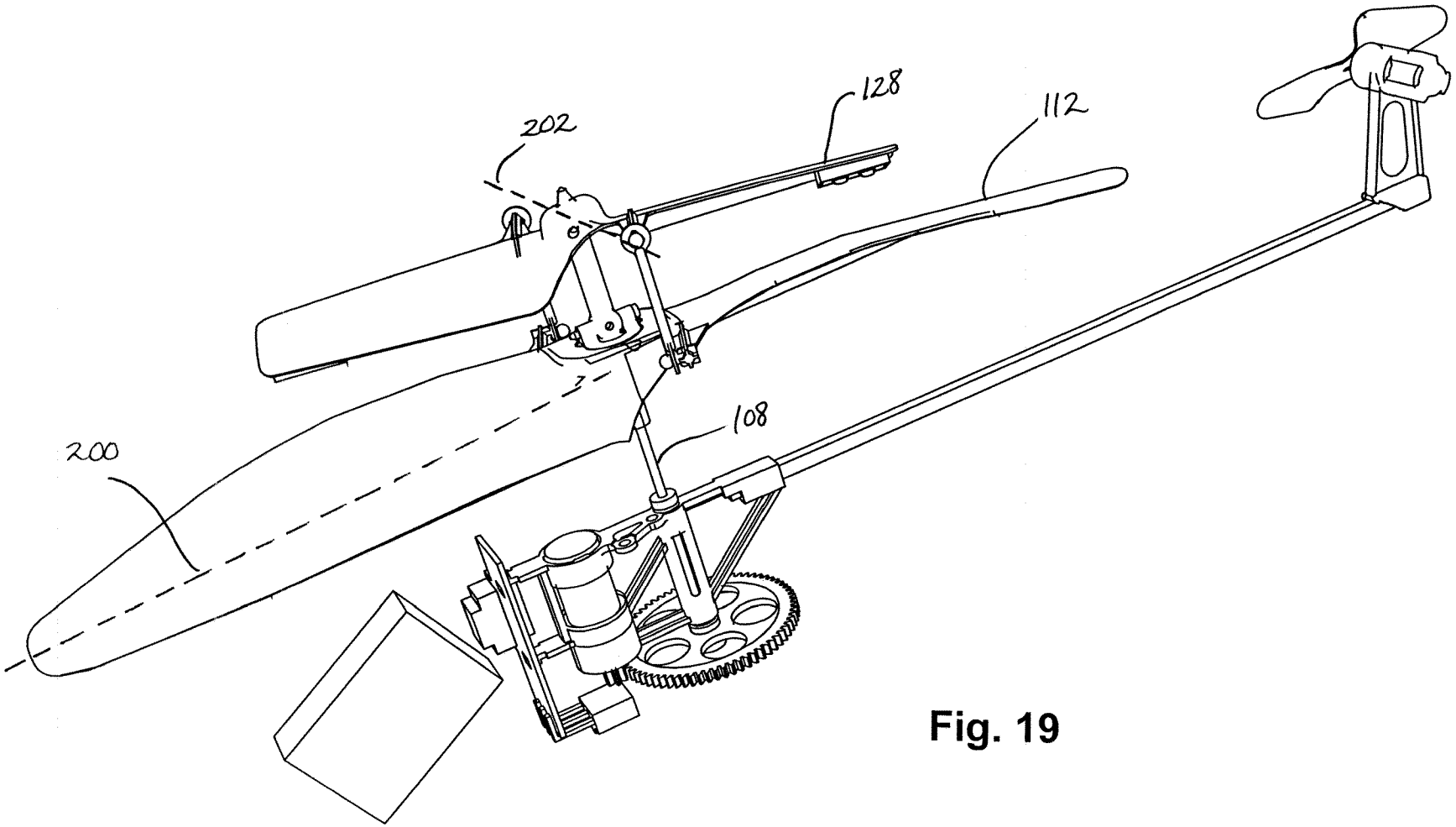
Figure 20:
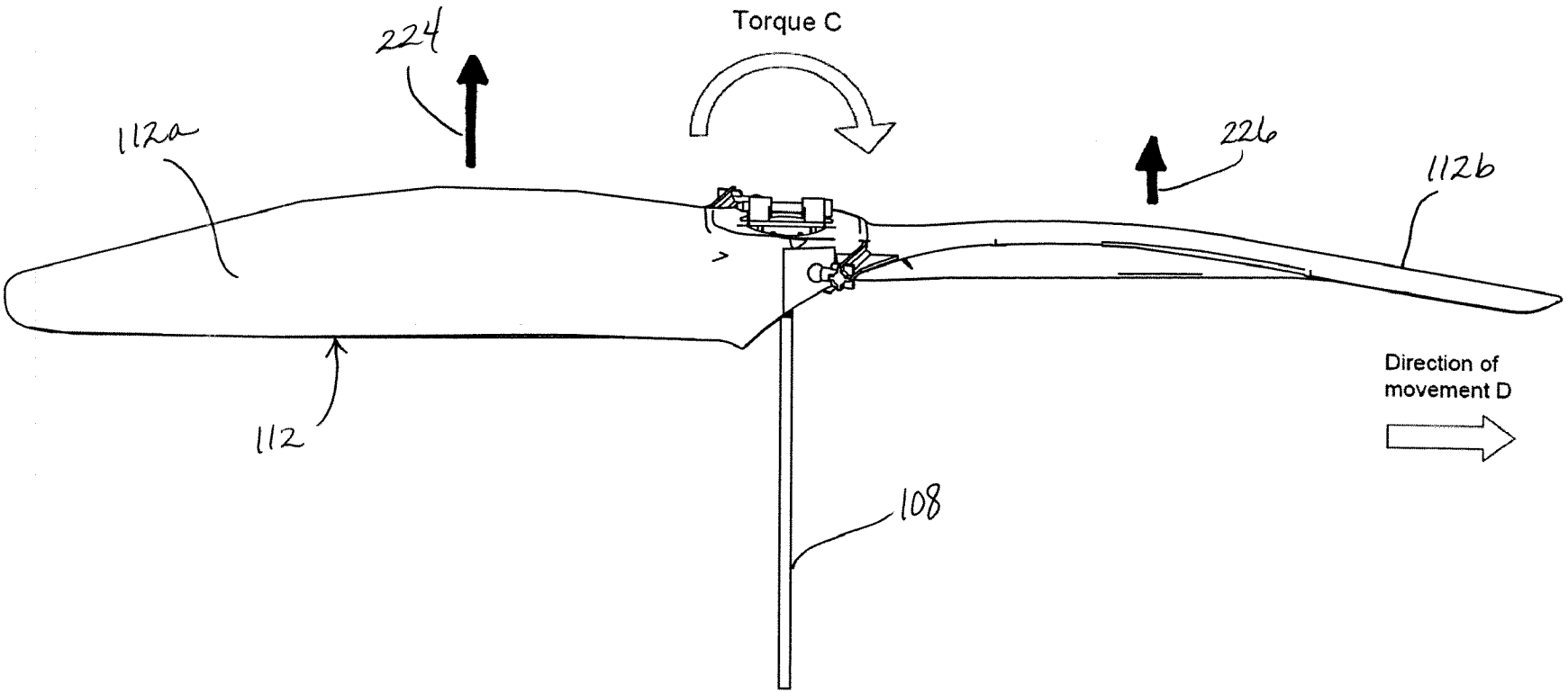
Figure 21:
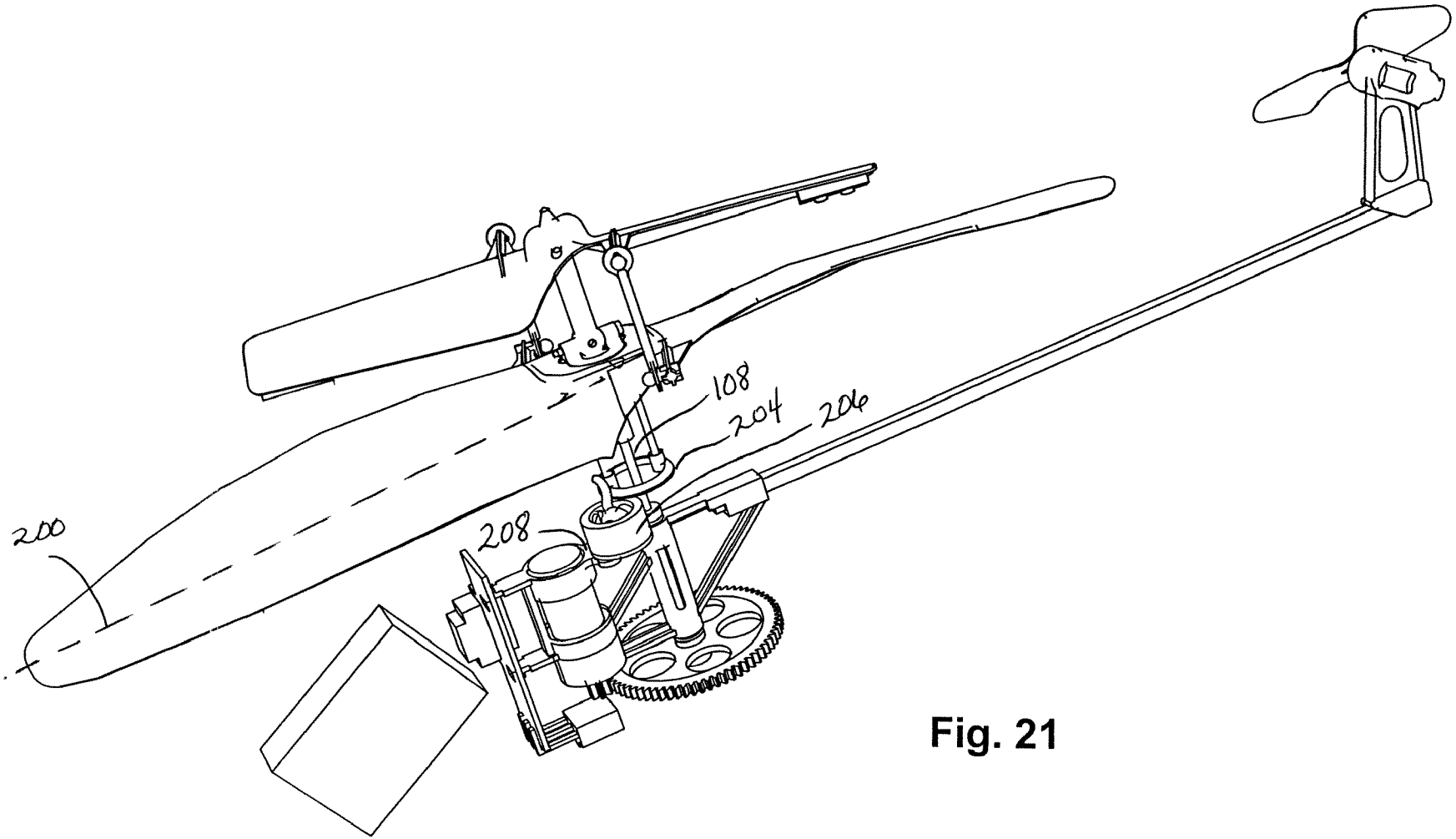
Figure 22A:
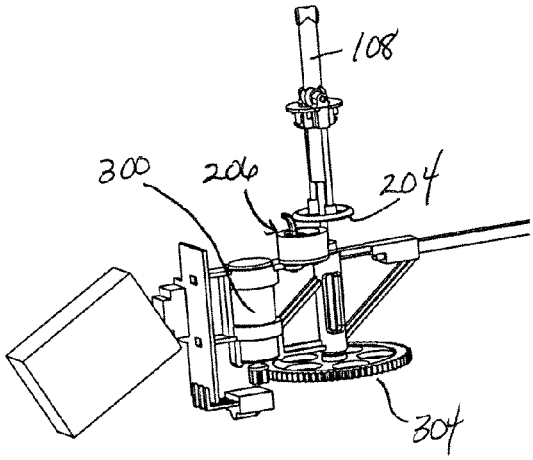
Figure 22B:
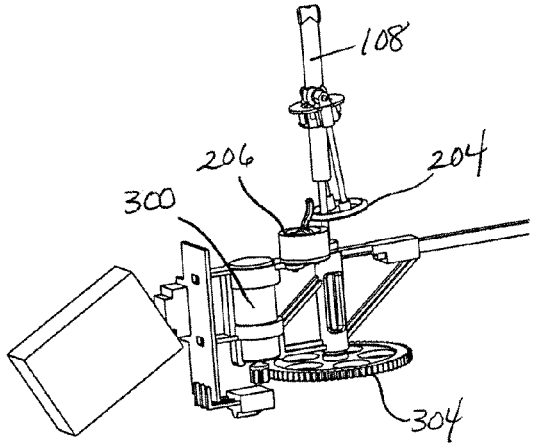
Figure 23:
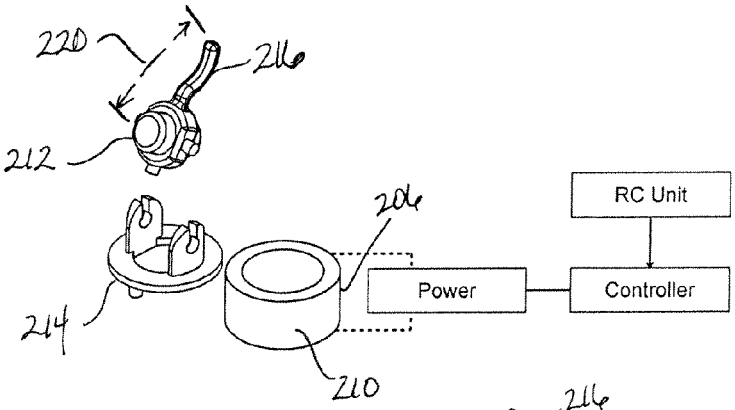
Figure 24:
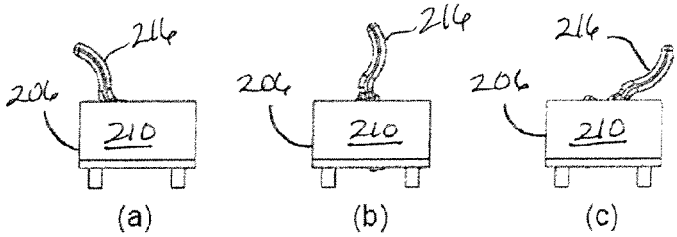
Figure 25:
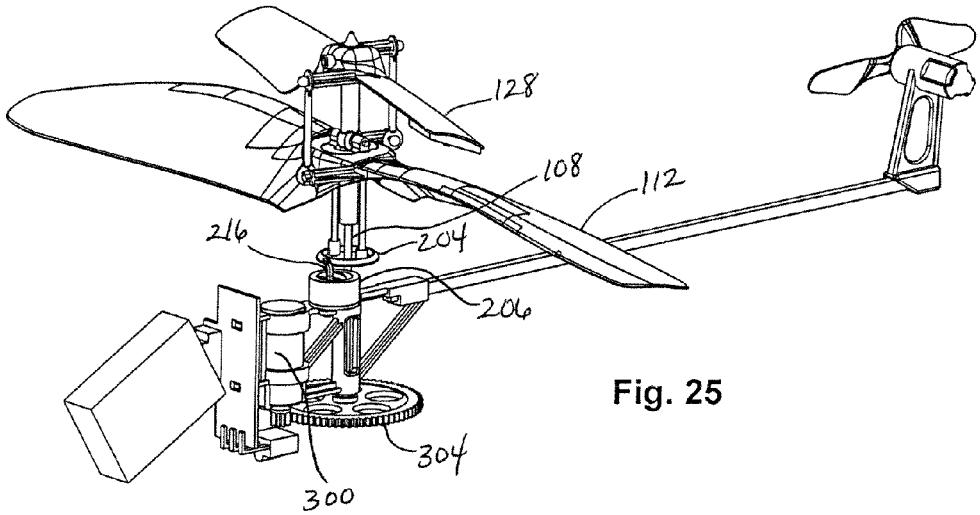
Figure 27A:
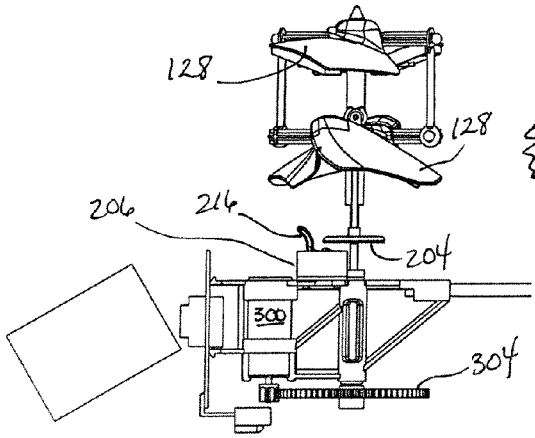
Figure 27B:
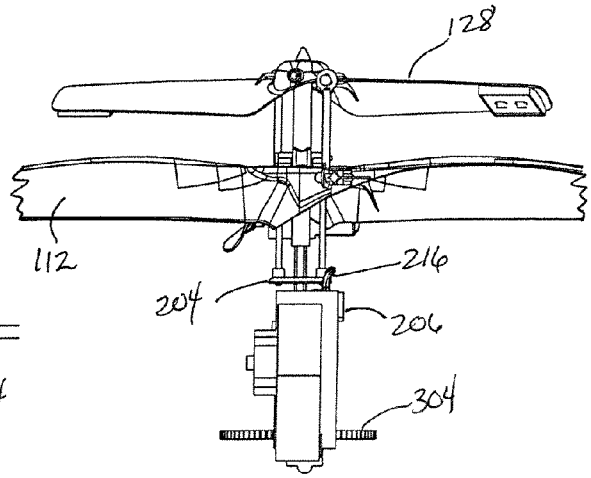
Figure 26:
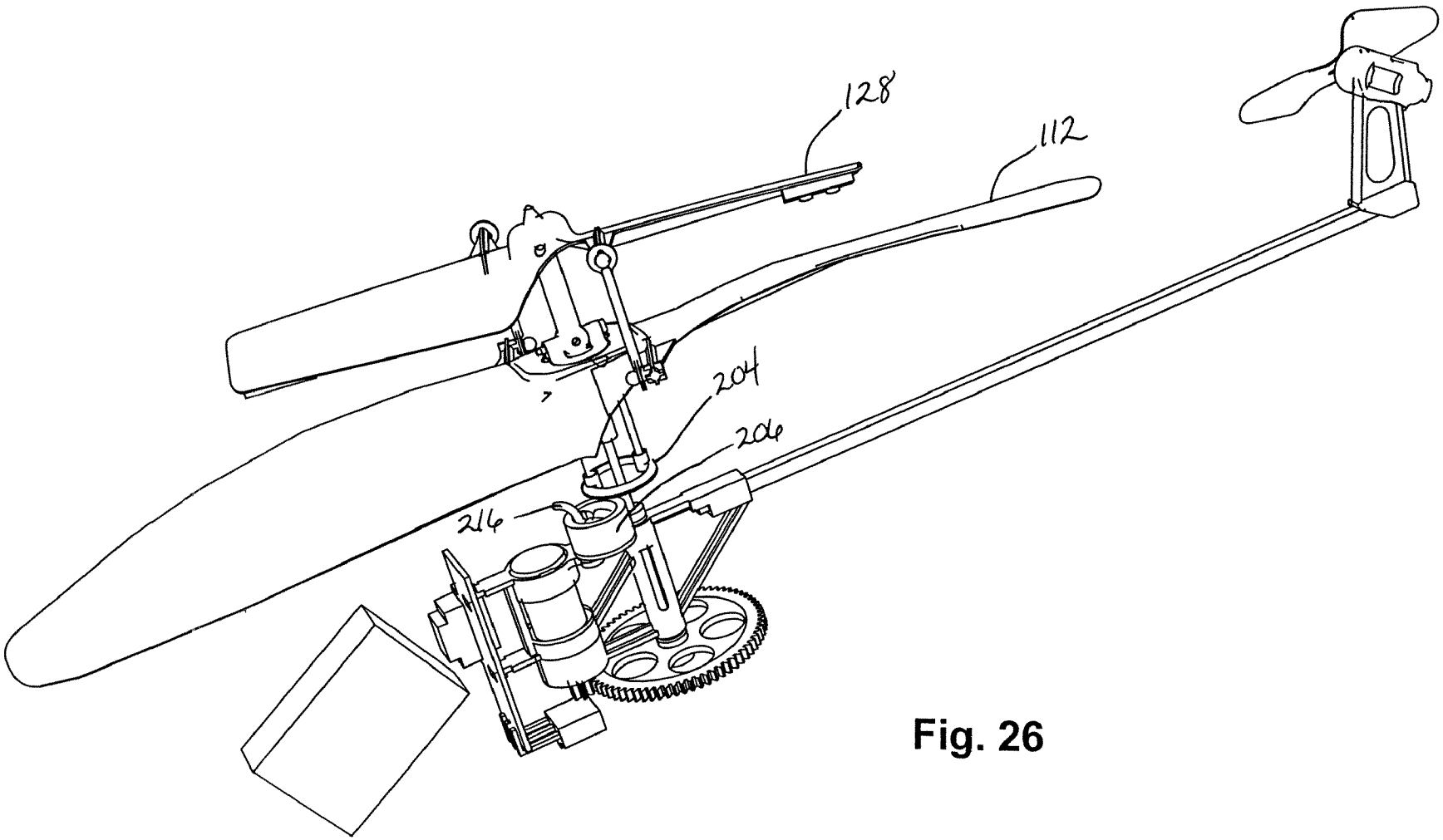
Figure 28A:
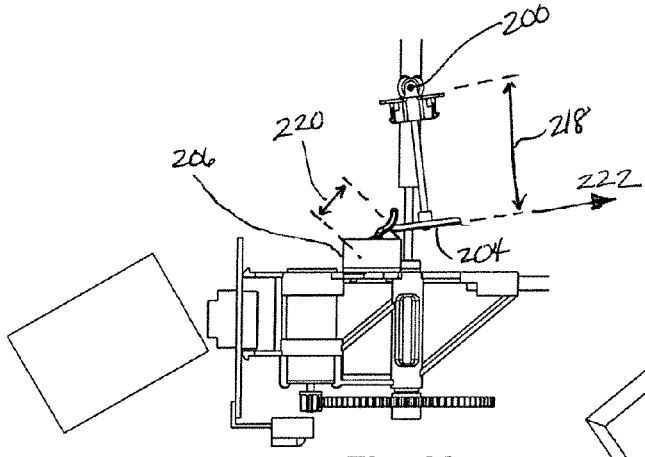
Figure 28B:
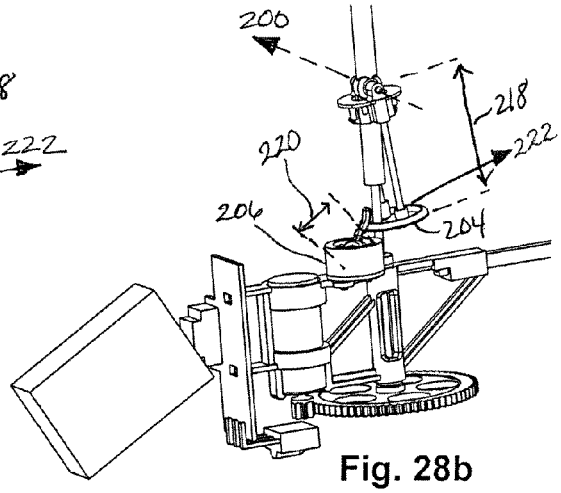
Figure 29A:
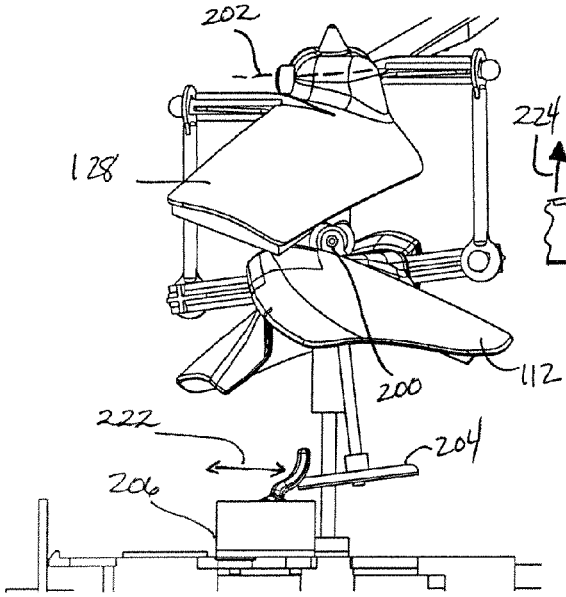
Figure 29B:
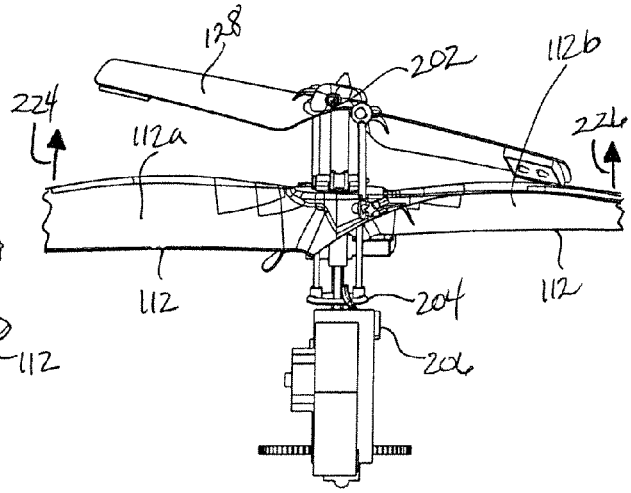
Figure 30A:
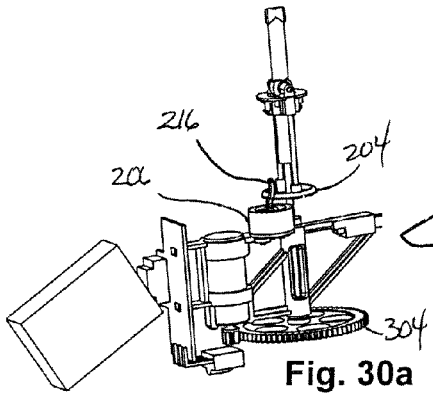
Figure 30B:
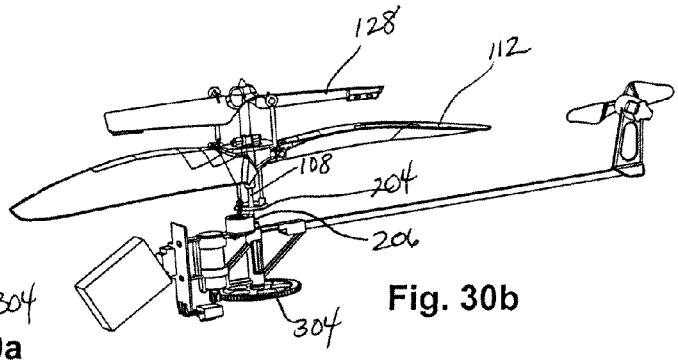
Figure 31A:
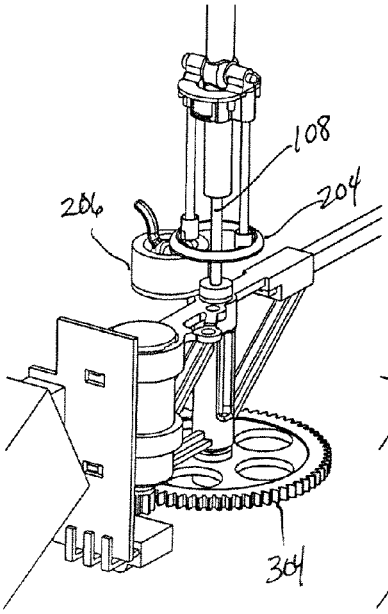
Figure 31B:
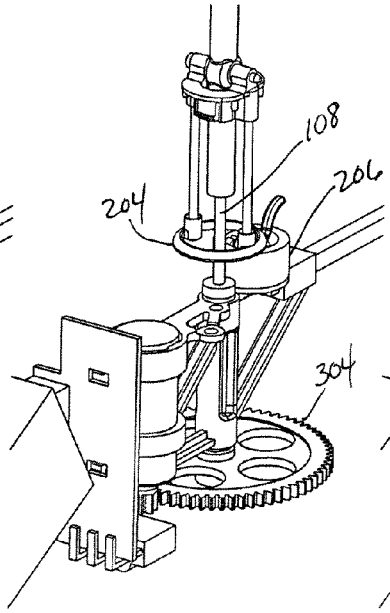
Figure 31C:
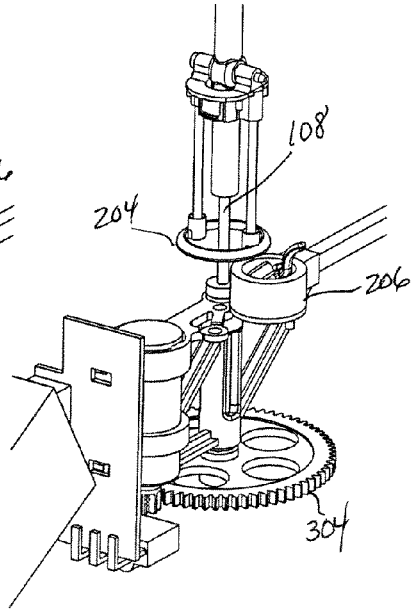
Figure 32:
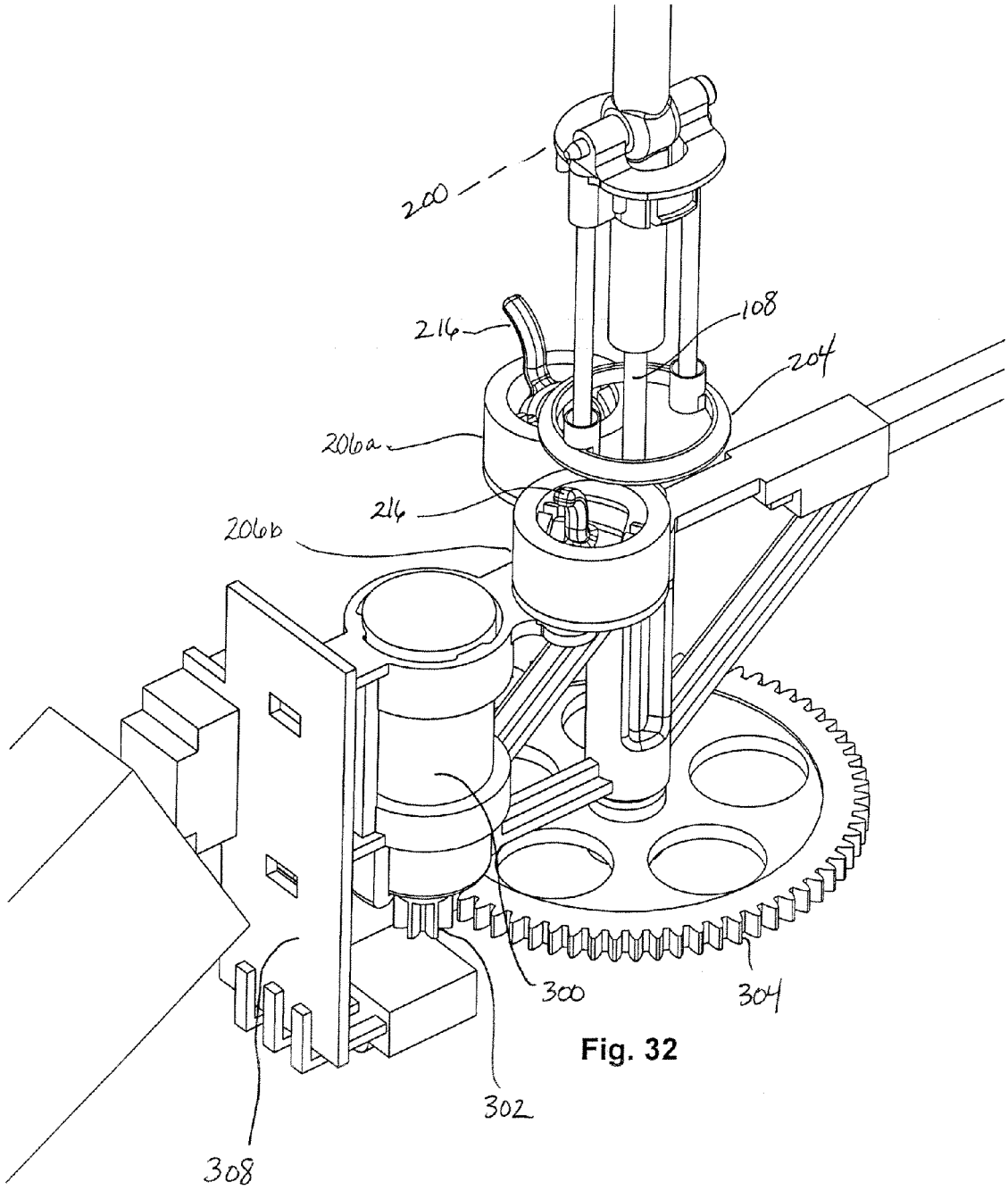
Figure 33B:
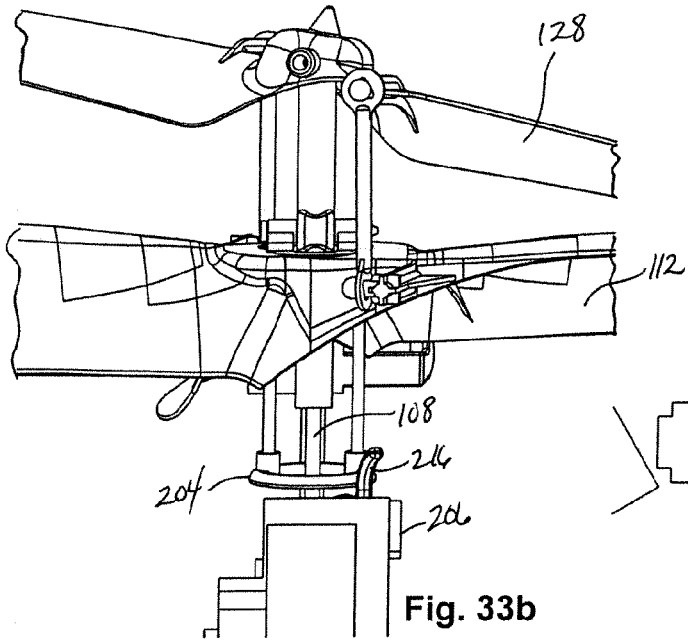
Figure 33A:
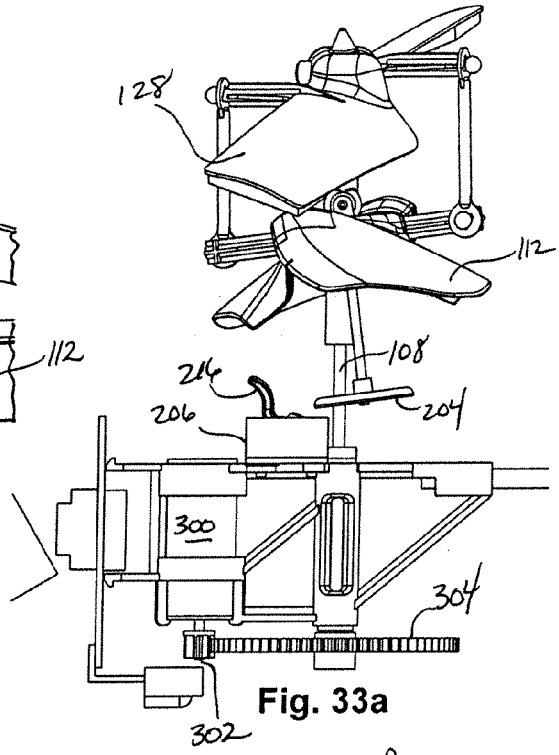
Figure 34B:
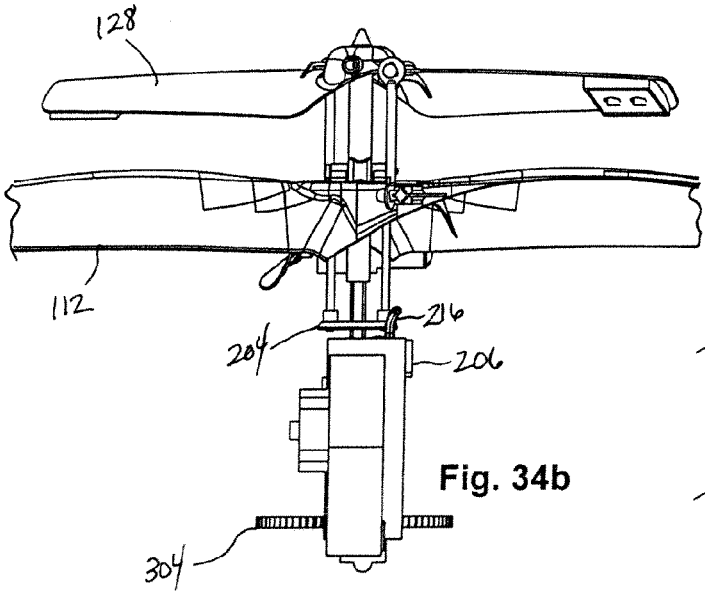
Figure 34A:
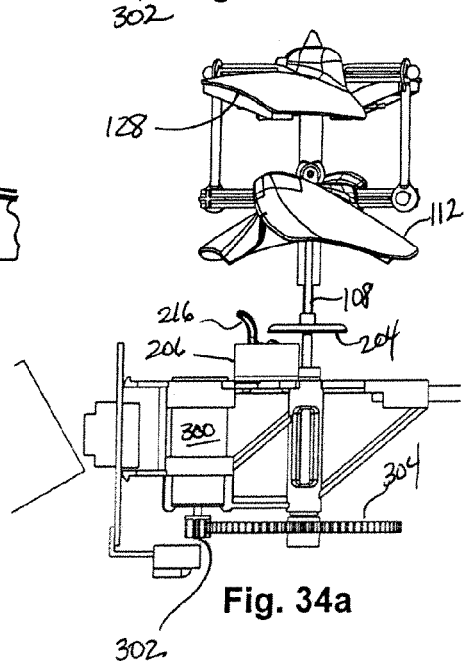
Figure 35:
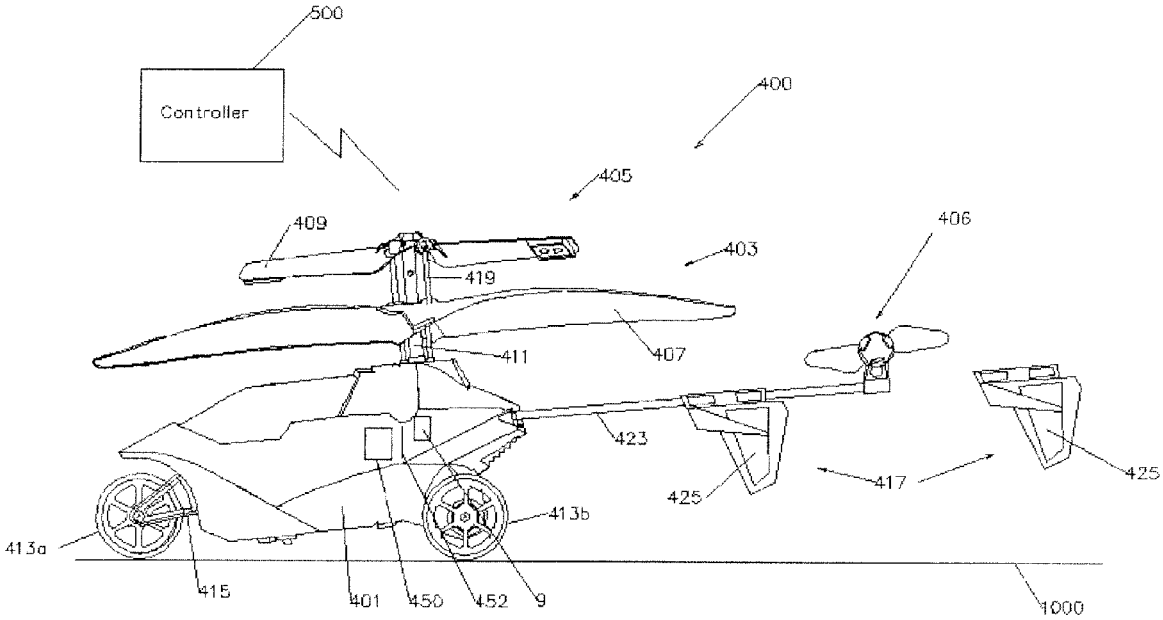
Figure 36:
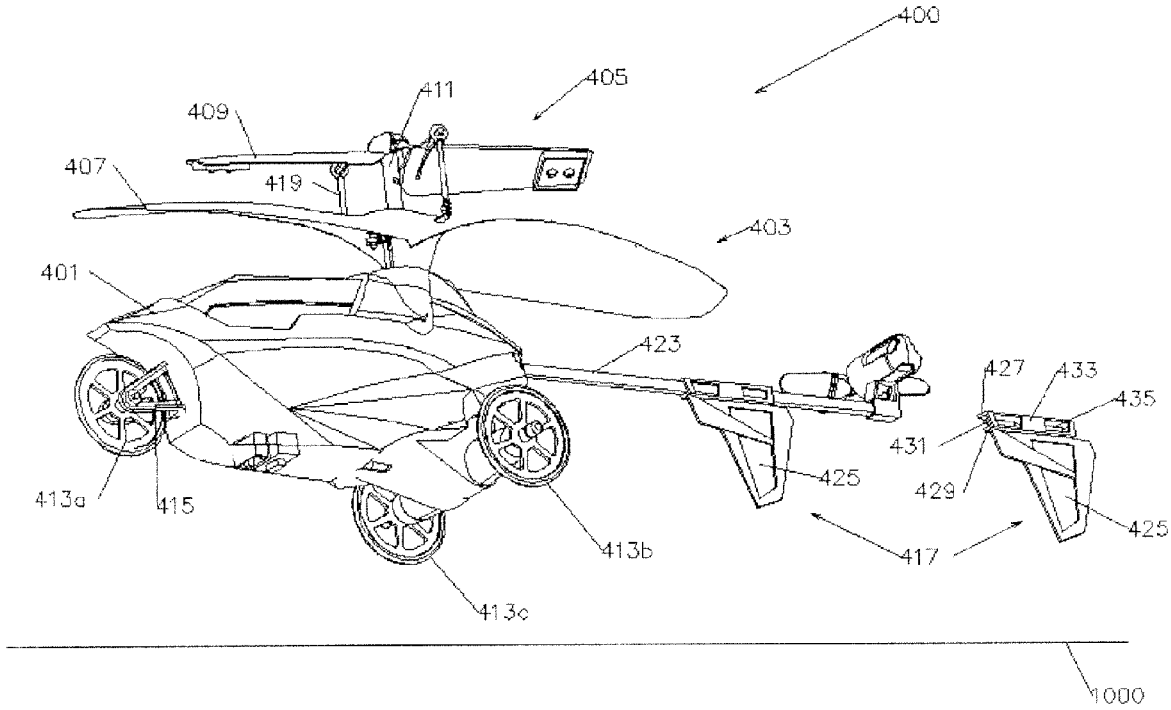
Figure 37:
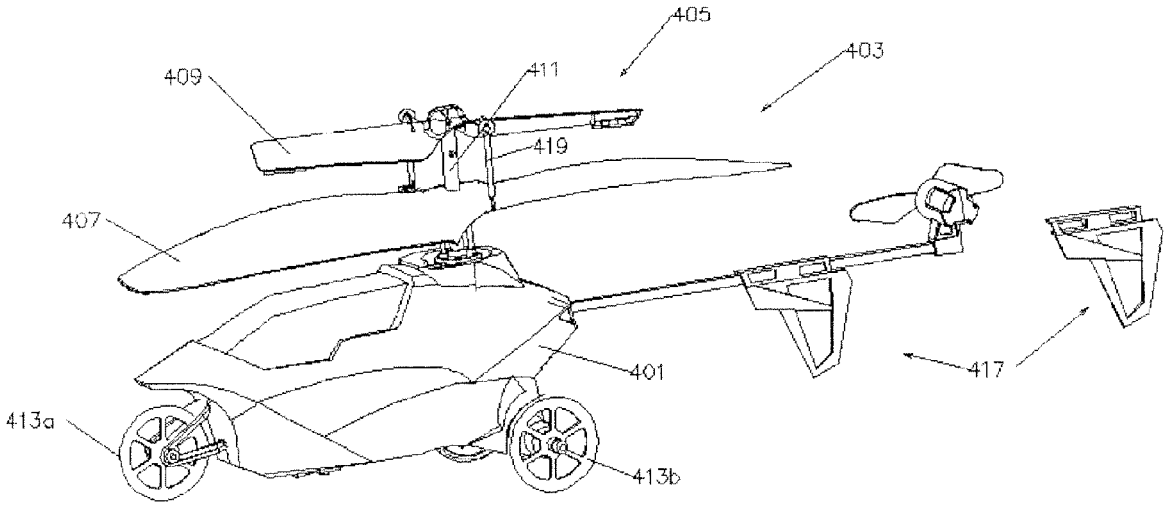
Figure 38:
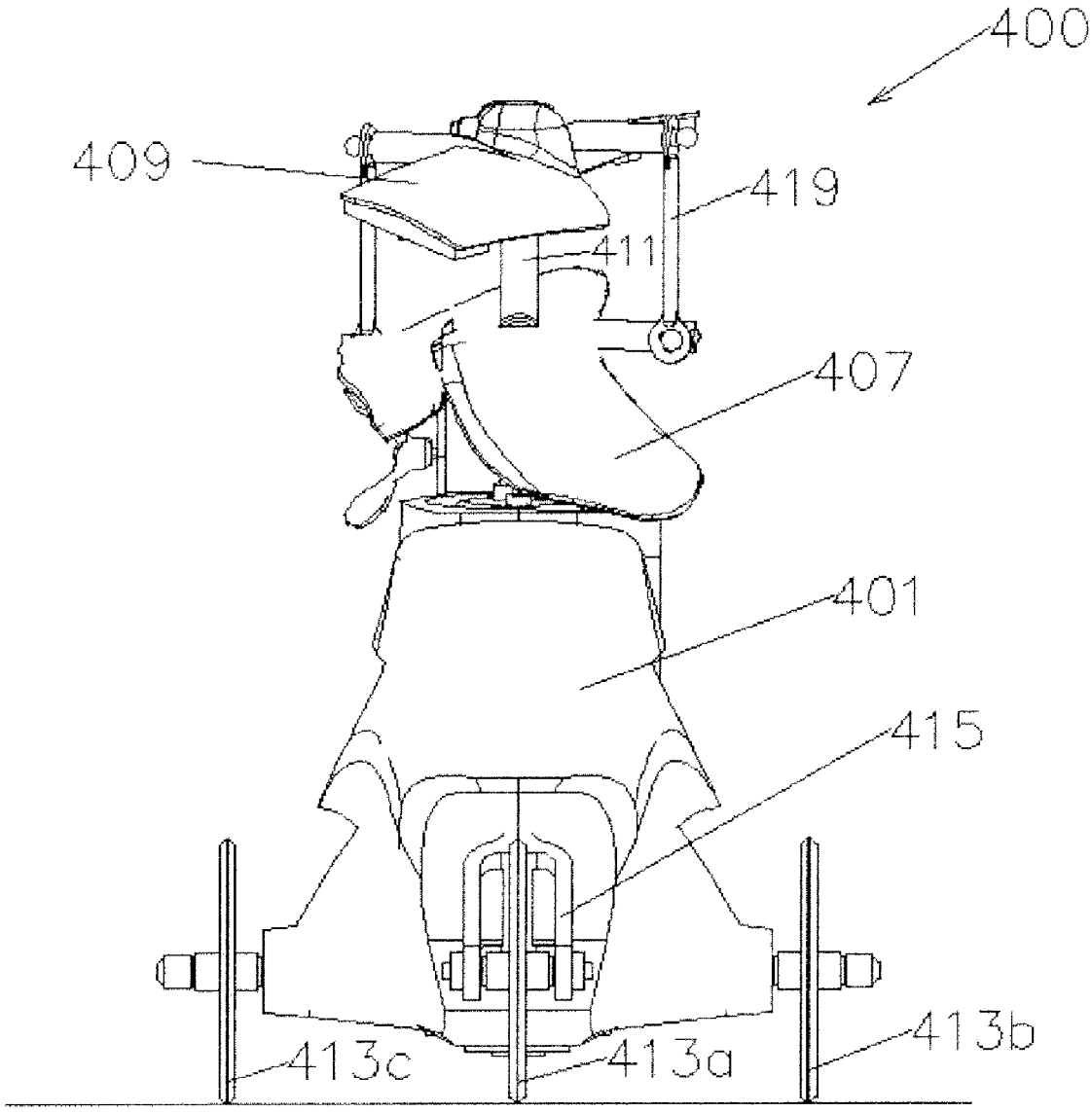
Figure 39:
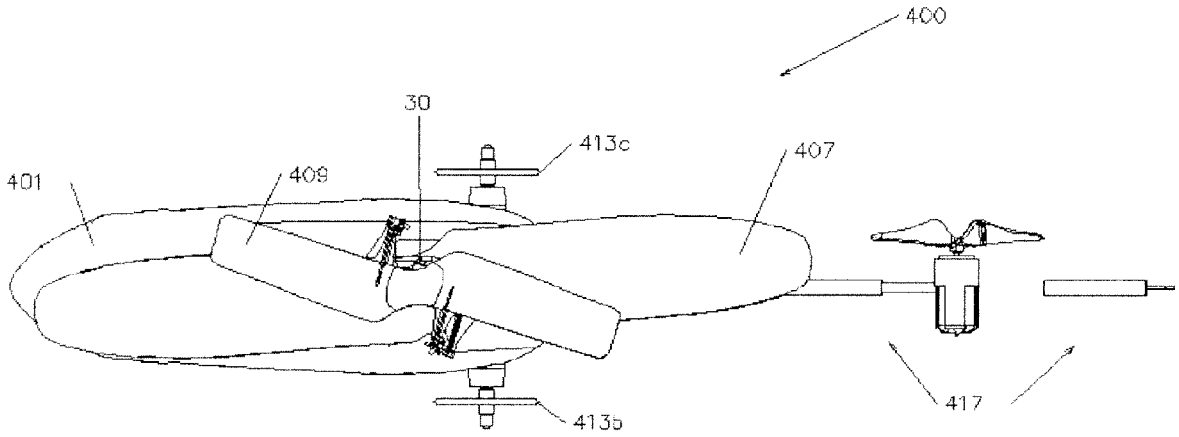
Figure 40:
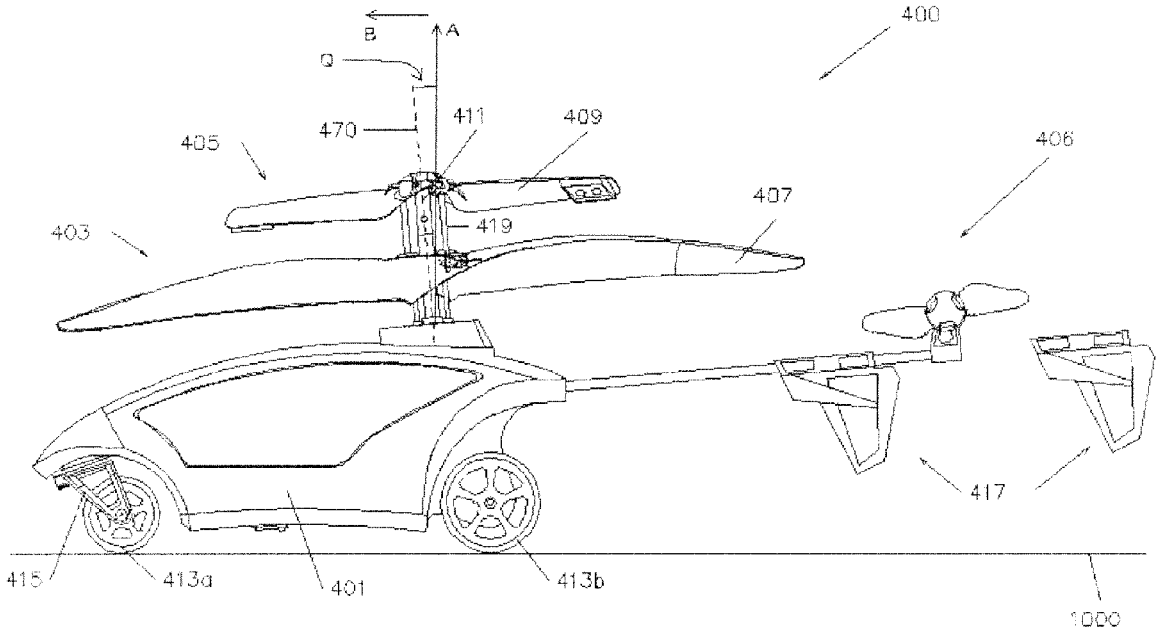
Figure 41:
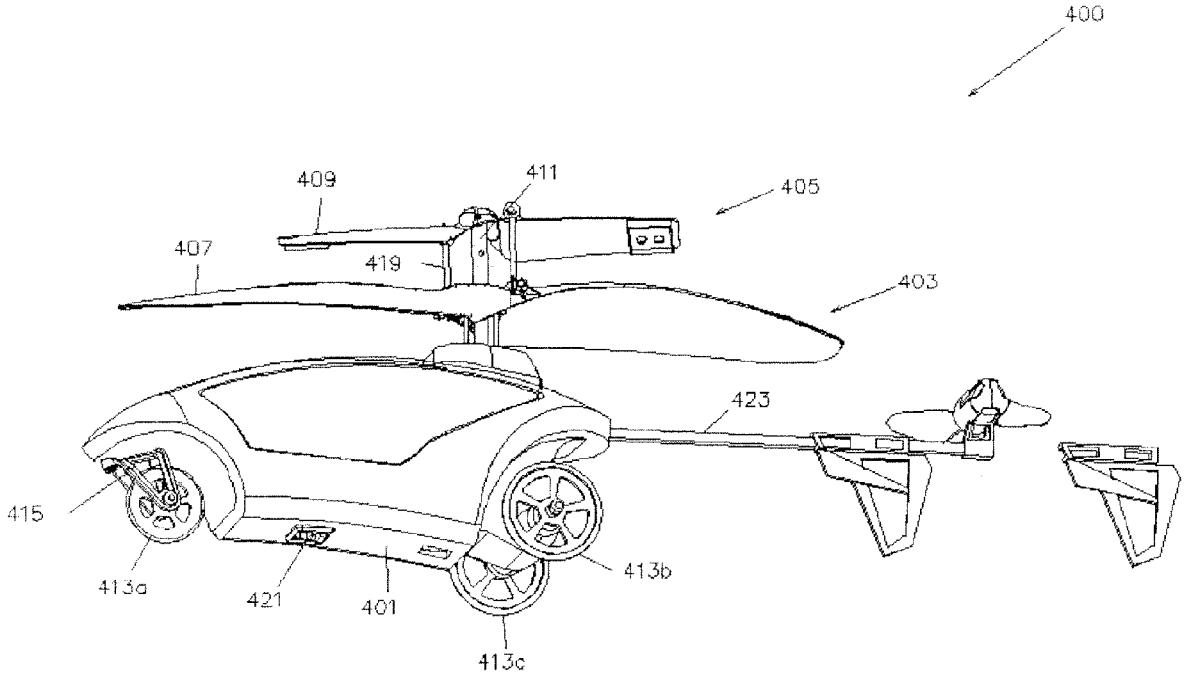
Figure 42:
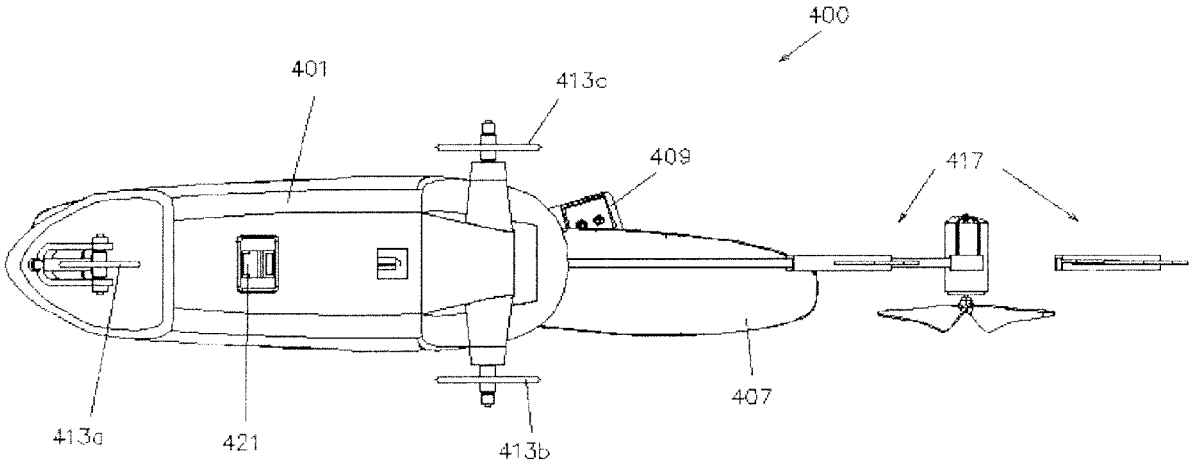
Figure 43:
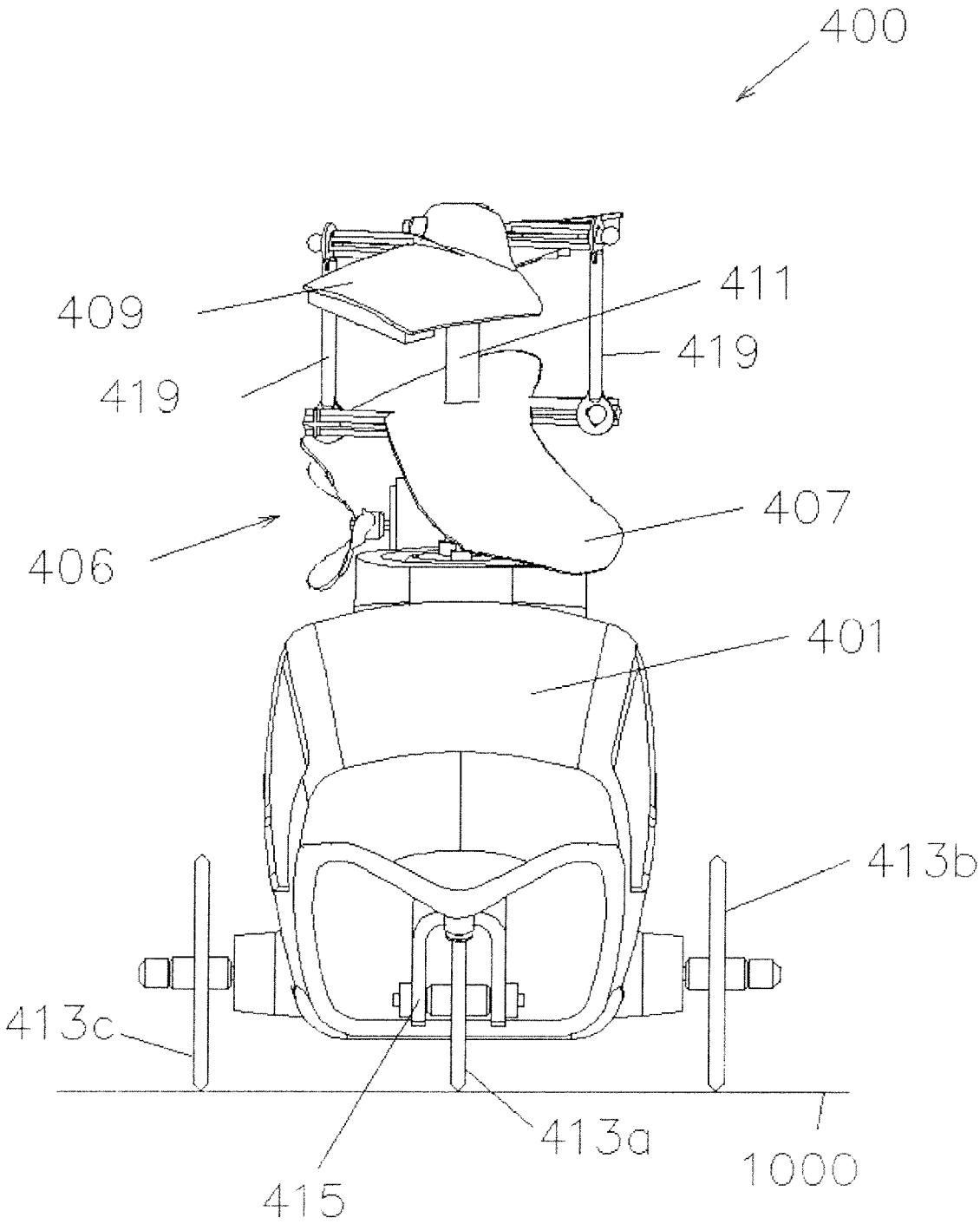
Figure 44:
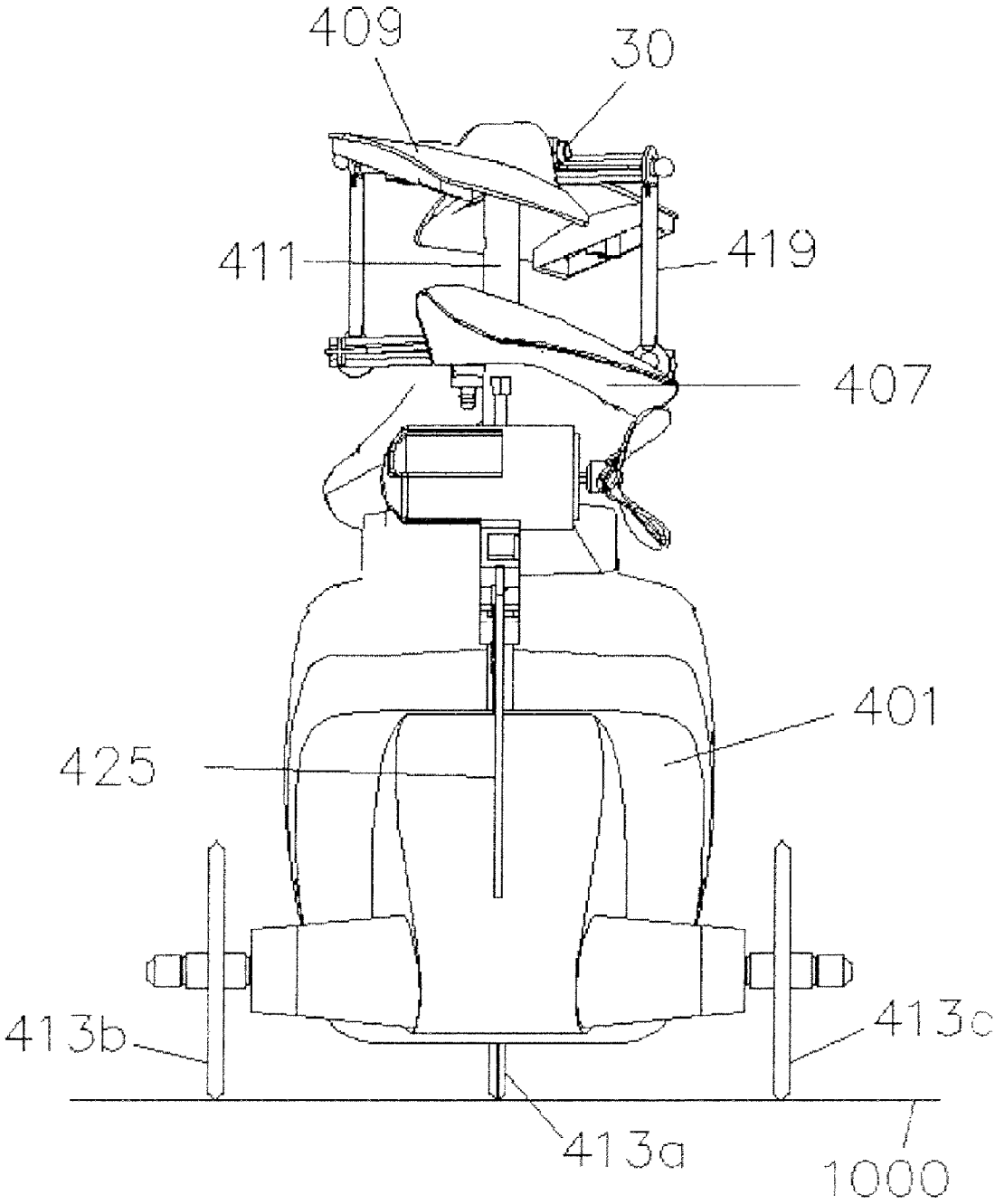
Figure 45:
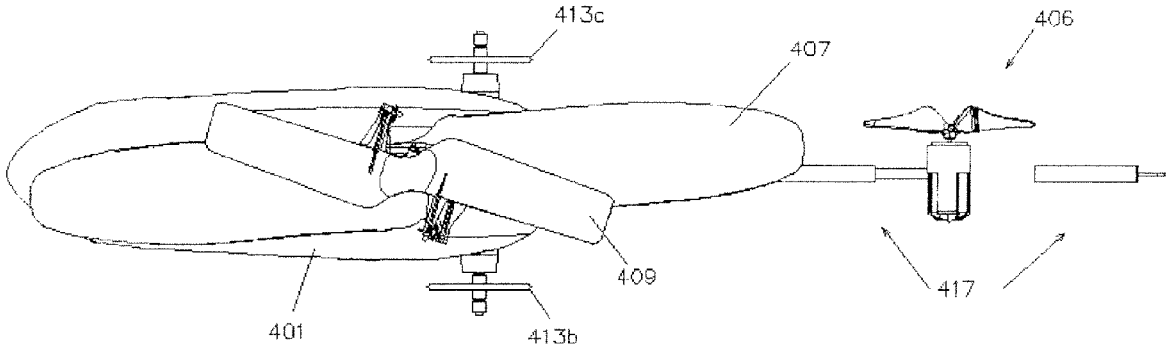
Figure 46:
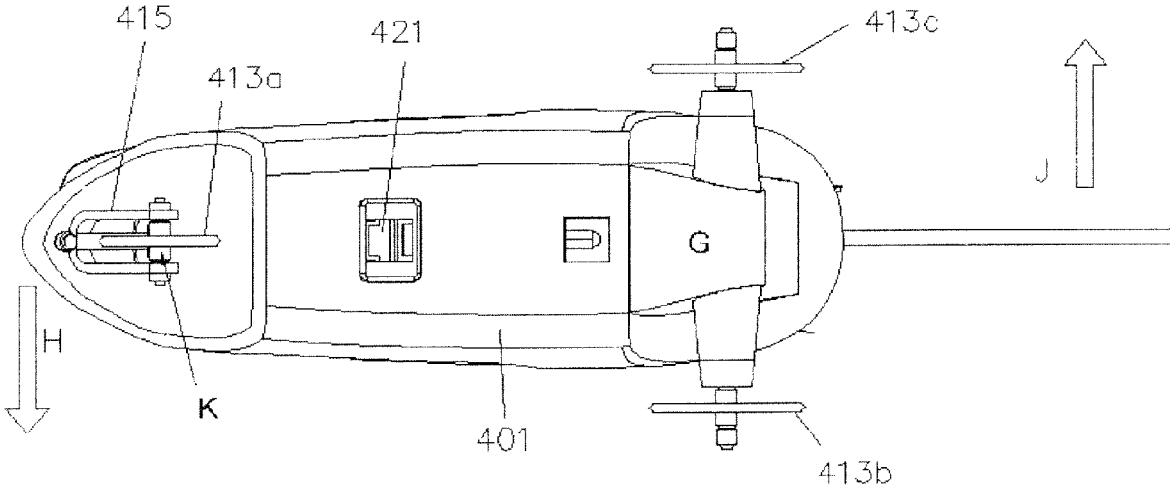

FIG. 11 schematically represents an alternative view of the helicopter according to the disclosure in perspective;

FIG. 12 is a perspective view of the main rotor and auxiliary rotor;

FIG. 13 is a perspective view of the tail rotor and tail stabilizer in a second embodiment of the helicopter;

FIG. 14 represents a side sectional view in the second embodiment of the helicopter;

FIG. 15 represent a perspective view of the second embodiment of the helicopter;

FIG. 16 represents a top view of the second embodiment of the helicopter;

FIG. 17 is a rear view of the second embodiment of the helicopter;

FIG. 18 represents a sectional view of the second embodiment of the helicopter along line !8-!8 of FIG. 16;

FIG. 19 illustrates a helicopter with a rotor that is spinning around to sustain the helicopter in flight and two axes are indicated;

FIG. 20 illustrates a helicopter rotor in flight where the rotor halves produce different lift, the one (A) versus the other (B). A torque C originates and moves the rotor in the direction (C) of that torque;

FIG. 21 shows a helicopter with a rotor and a stabilizer, a control ring, attached to the rotor, and an actuator device connected with the helicopter body structure;

FIGS. 22*a* and 22*b* are two respective views showing the control ring is generally centered around the vertical rotor axis. The ring moves around the rotor axis and with the rotor when the rotor is tilted around the feather axis as shown in FIG. 22*b*. The rotor system omitted for clarity;

FIG. 23 shows an exploded view of the actuator device with a coil, a hinged magnet, a base and a lever;

FIG. 24 shows the lever in different positions (a), (b) and (c);

FIGS. 25, 26 and 27*a* and 27*b* are exemplary and show the control ring and the rotor in different relative positions. FIG. 27*a* is a side view of a portion of the structure and FIG. 27*b* is a front view of the structure;

FIGS. 28*a* and 28*b*, with the rotor omitted for clarity, illustrates the working operation of the control in more detail;

FIGS. 29*a* and 29*b* illustrate the stabilizer movement of the attached rotor depending on its mechanical relationship with the rotor;

FIG. 30*a*, with the rotor omitted for clarity, and FIG. 30*b* show further details of the operation;

FIGS. 31*a*, 31*b* and 31*c* show respectively a control with different possible positions of the actuator. Each position is for a rotor system and determines different unique flight patterns;

FIG. 32 shows a control with two actuators used to exercise force independently and selectively on the control ring;

FIGS. 33*a* and 33*b* show the actuator lever withdrawn and the actuator signal at zero interaction, and the rotor assembly being in a position prior to zero interaction and being free to take control of the rotor;

FIGS. 34*a* and 34*b* show the actuator lever withdrawn and the actuator signal at zero interaction, and the rotor assembly having acted freely under its own control;

FIG. 35 is an exemplary side view of a helicopter showing a separate controller;

FIG. 36 is a perspective under view of the helicopter of FIG. 35;

FIG. 37 is a perspective top view of the helicopter of FIG. 35;

FIG. 38 is an front view of the helicopter of FIG. 35;

FIG. 39 is an top view of the helicopter of FIG. 35;

FIG. 40 is an exemplary side view of a second helicopter;

FIG. 41 is a perspective under view of the helicopter of FIG. 40;

FIG. 42 is an under view of the helicopter of FIG. 40;

FIG. 43 is an front view of the helicopter of FIG. 40;

FIG. 44 is a rear view of the helicopter of FIG. 40;

FIG. 45 is an top view of the helicopter of FIG. 40;

FIG. 46 is another under view of the helicopter of FIG. 40; and

Figure 47:
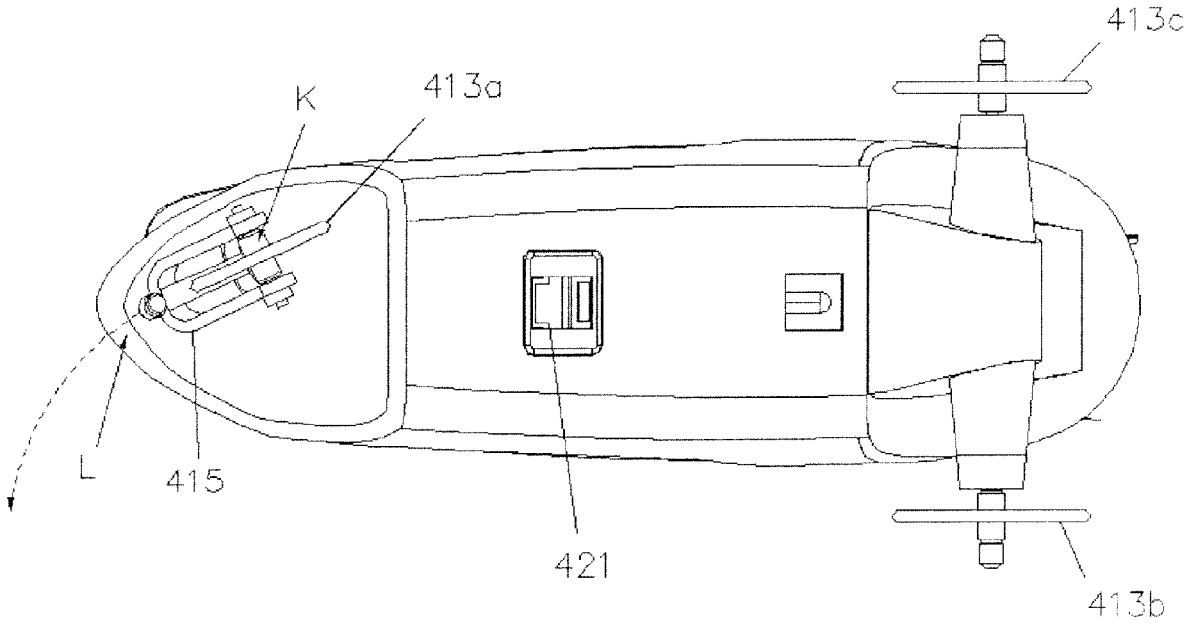

FIG. 47 is another under view of the helicopter of FIG. 40.

DETAILED DESCRIPTION

The following embodiments of an improved helicopter according to the disclosure are given as an example only, without being limitative in any way, with reference to the accompanying drawings.

Typically, a helicopter includes a body, a main rotor and a tail rotor. Alternatively, there can be two rotors, namely a main rotor towards the front of the helicopter body and a tandem rotor spaced towards the rear of the helicopter body.

The main rotor provides an upward force to keep the helicopter in the air, as well as a lateral or forward or backward force to steer the helicopter in required directions. This can be achieved by making the angle of incidence of the rotor blades of the main rotor vary cyclically at every revolution of the main rotor.

The main rotor has a natural tendency to deviate from its position, which may lead to uncontrolled movements and to a crash of the helicopter if the pilot loses control over the steering of the helicopter.

Solutions to slow down the effect have already been provided up to now, including the application of stabilizing rods and weights at the tips of the rotor blades.

In the helicopter with a tail rotor, the tail rotor is not at all insensitive to this phenomenon, since it has to prevent the body to turn round the drive shaft of the rotor as a result of the resistance torque of the rotor on the body.

In general, the stability of a helicopter includes the result of the interaction between:

the rotation of the rotor blades; the movements of any possible stabilizing rods; compensation of the resistance torque of the main rotor by means of the tail rotor;

the system such as a gyroscope or the like to compensate for small undesired variations in the resistance torque of the main rotor; and control of the helicopter which controls the rotational speed of the main rotor and of the tail rotor.

When these elements are essentially in balance, the pilot or controller should be able to steer the helicopter as desired.

Referring to FIGS. 1-18, helicopter 1, represented by way of example, is a remote-controlled helicopter which essentially consists of a body 2 with a landing gear, a motor 9 and a battery for the motor 9. The motor 9 is controllable by a controller remote from the body 2. The body 2 has a tail 3, a main rotor 4 with at least two propeller blades 12. The propeller blades 12 define a plane of rotation of the main rotor 4. The main rotor 4 is driven by a rotor shaft 8 on which the propeller blades 12 are mounted.

The main rotor 4 is provided by means of what is called a rotor head 7 on a first upward directed rotor shaft 8 which is bearing-mounted in the body 2 of the helicopter 1 in a rotating manner and which is driven by means of a motor 9 and a transmission 10, whereby the motor 9 is, for example, an electric motor which is powered by a battery 11.

The main rotor 4 in this case has two blades 12 which are in line or practically in line, but which may just as well be composed of a larger number of blades 12.

There is a tail rotor 6 driven by a second rotor shaft 17 directed transversely to the rotor shaft 8 of the main rotor 4. An auxiliary rotor 5 also driven by the rotor shaft 18 of the main rotor 4 in the rotational sense of the main rotor 4. The auxiliary rotor 5 is mounted such that a first longitudinal axis 29 of the auxiliary rotor 5 is situated in an acute angle relative to a second longitudinal axis 13 of one of the propeller blades 12 of the main rotor 4. The acute angle is determined when viewed from above the plane of rotation. The auxiliary rotor 4 has a further plane of rotation spaced from the plane of rotation.

The tail rotor 6 is driven via a second rotor shaft 17 by means of a second motor 18 and a transmission 19. Motor 16 can be an electric motor.

The tail rotor 6 with its rotor shaft 17 and its drive 18-19 is suspended in a swing 20 which can rotate round a swing shaft 21 which is fixed to the tail 3 of the helicopter 1 by two supports 22 and 23.

The main rotor 4 and the auxiliary rotor 5 are linked with each other by a mechanical linkage 31. The auxiliary rotor 5 is mounted in a swinging relationship on an oscillatory shaft 30 provided essentially transversally to the rotor shaft 8 of the main rotor 4. The swinging motion is relatively upwards and downwards around the oscillatory shaft 30, such that the swinging motion of the auxiliary rotor 5 controls an angle of incidence of the propeller blades 12 of the main rotor 4.

Figure 1:
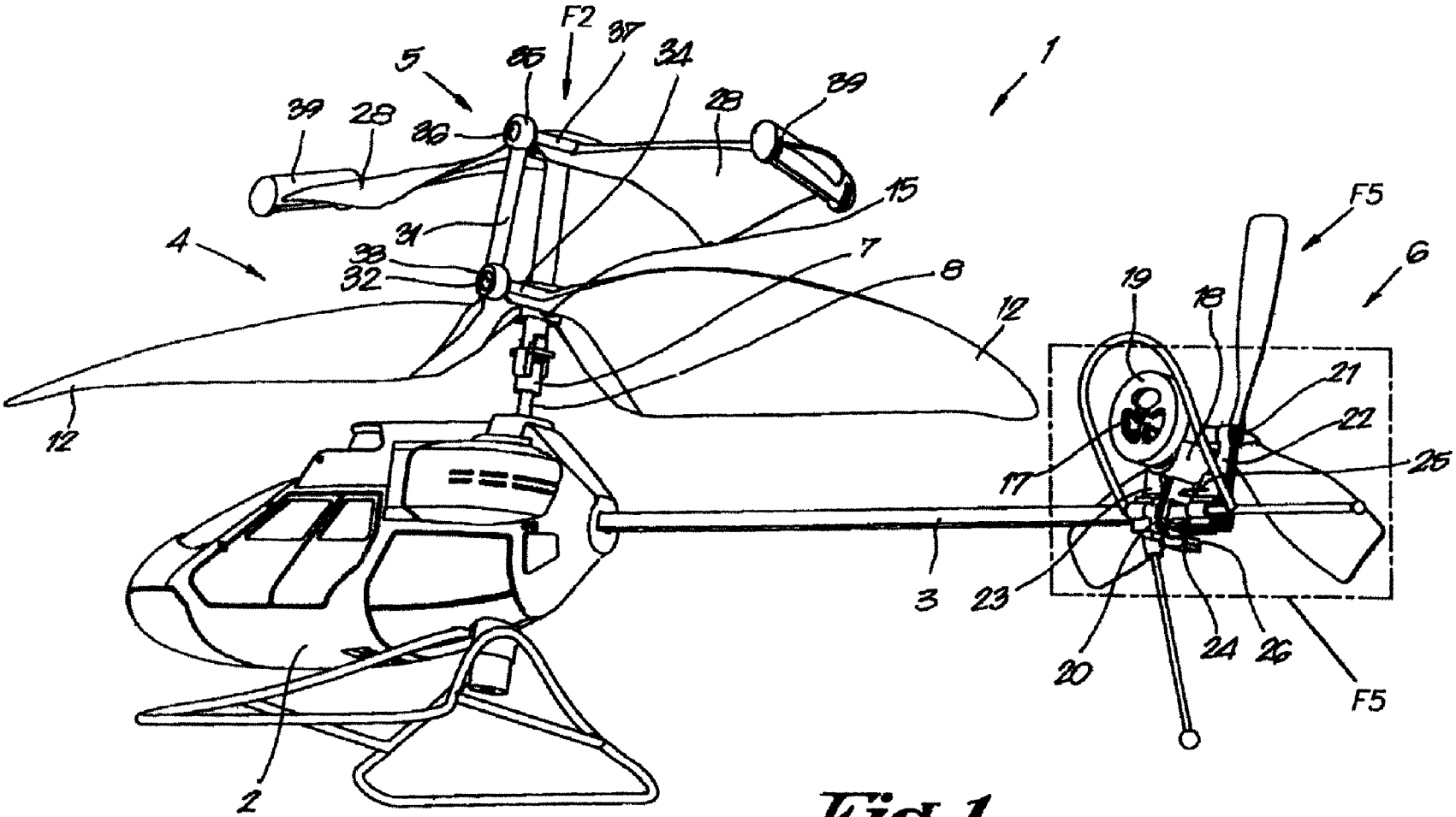
Figure 9:
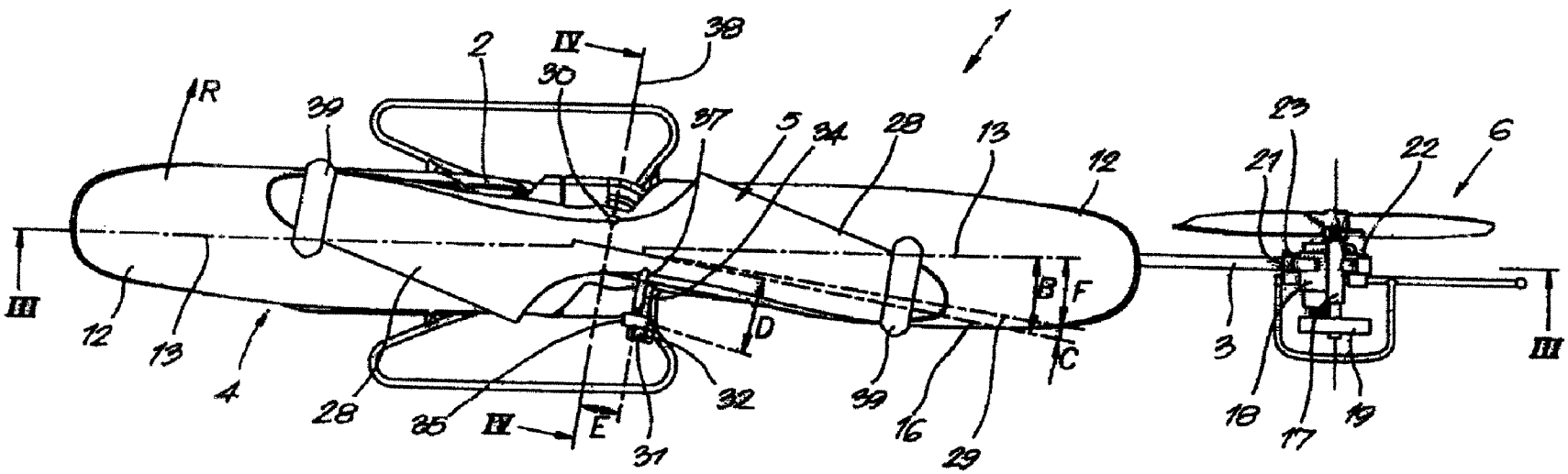
FIG. 9 represents a different view of the tail rotor of FIG. 8.
Figure 3:
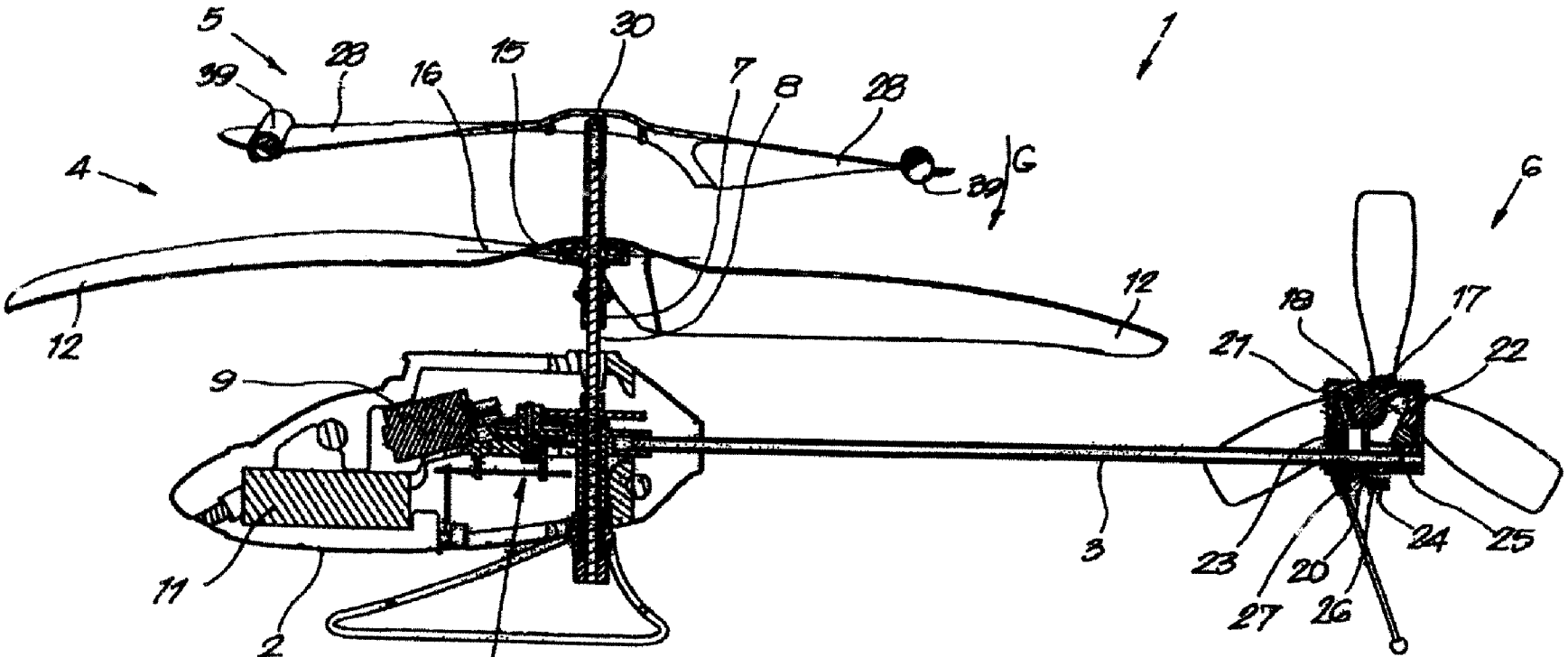
FIGS. 3 and 4 represent respective sections according to lines II-II and III-III in FIG. 2.
Figure 4:
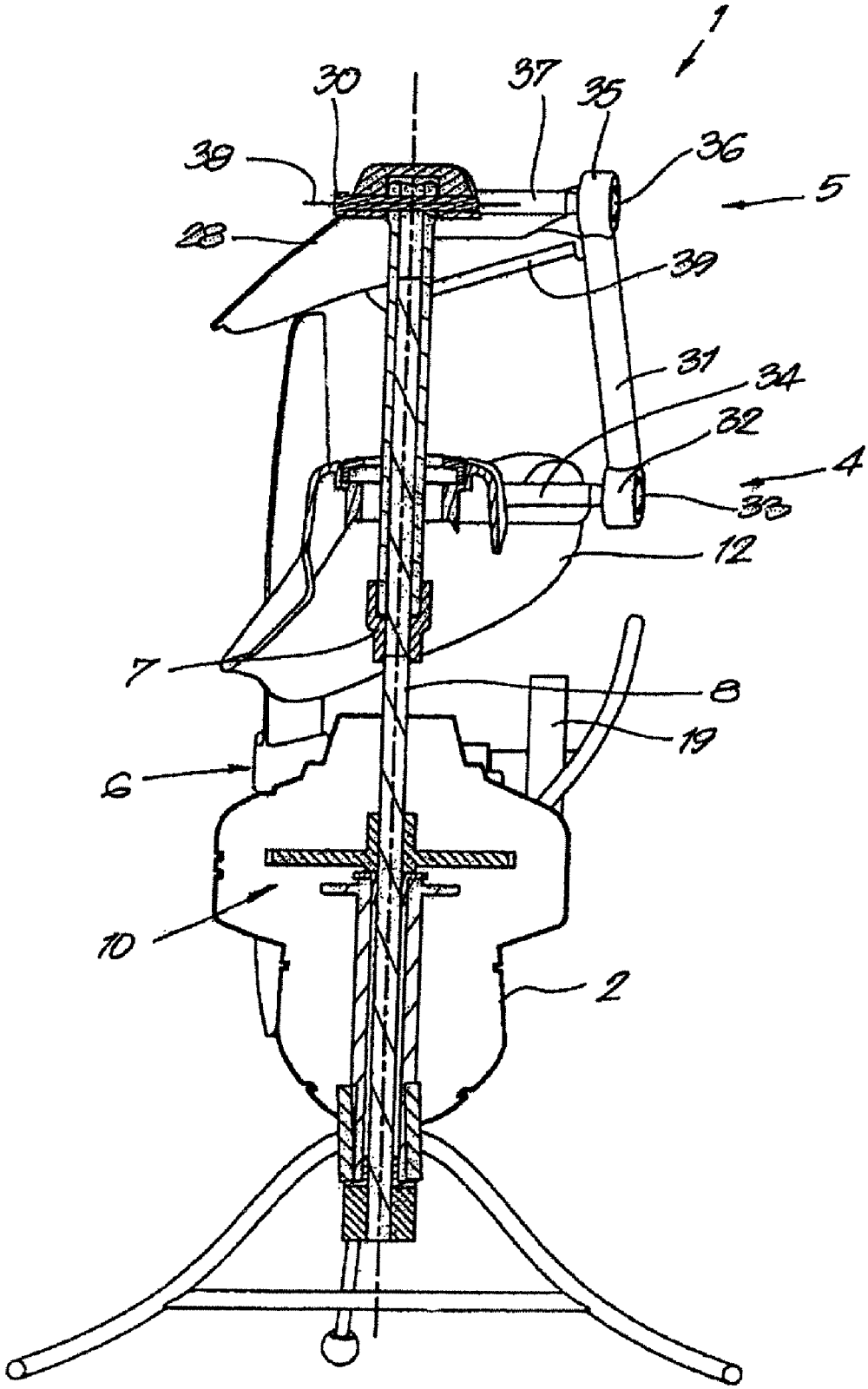
Figure 5:
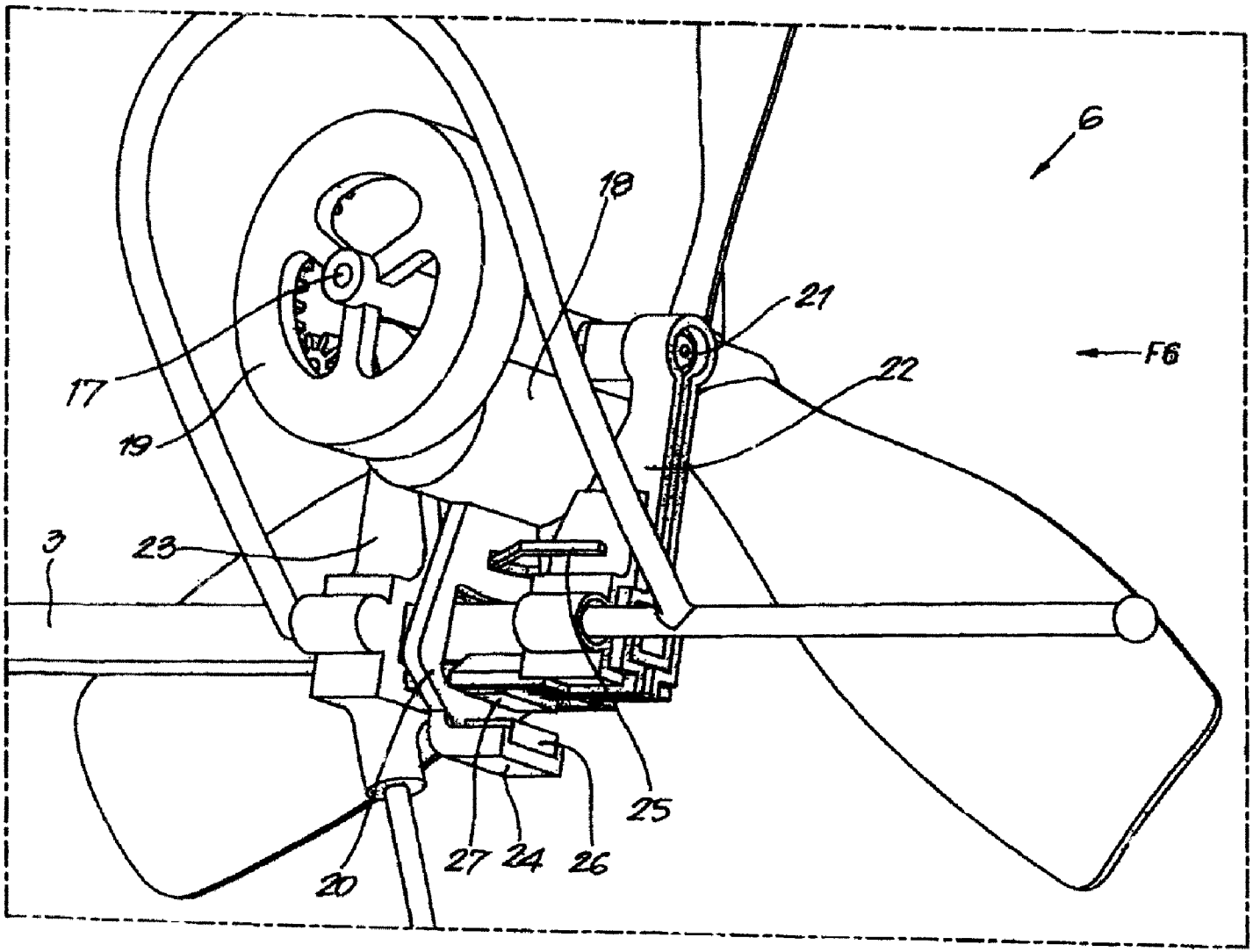
FIG. 5 represents a view of the rear rotor part indicated in FIG. 1 by F5 to a larger scale.
Figure 6:
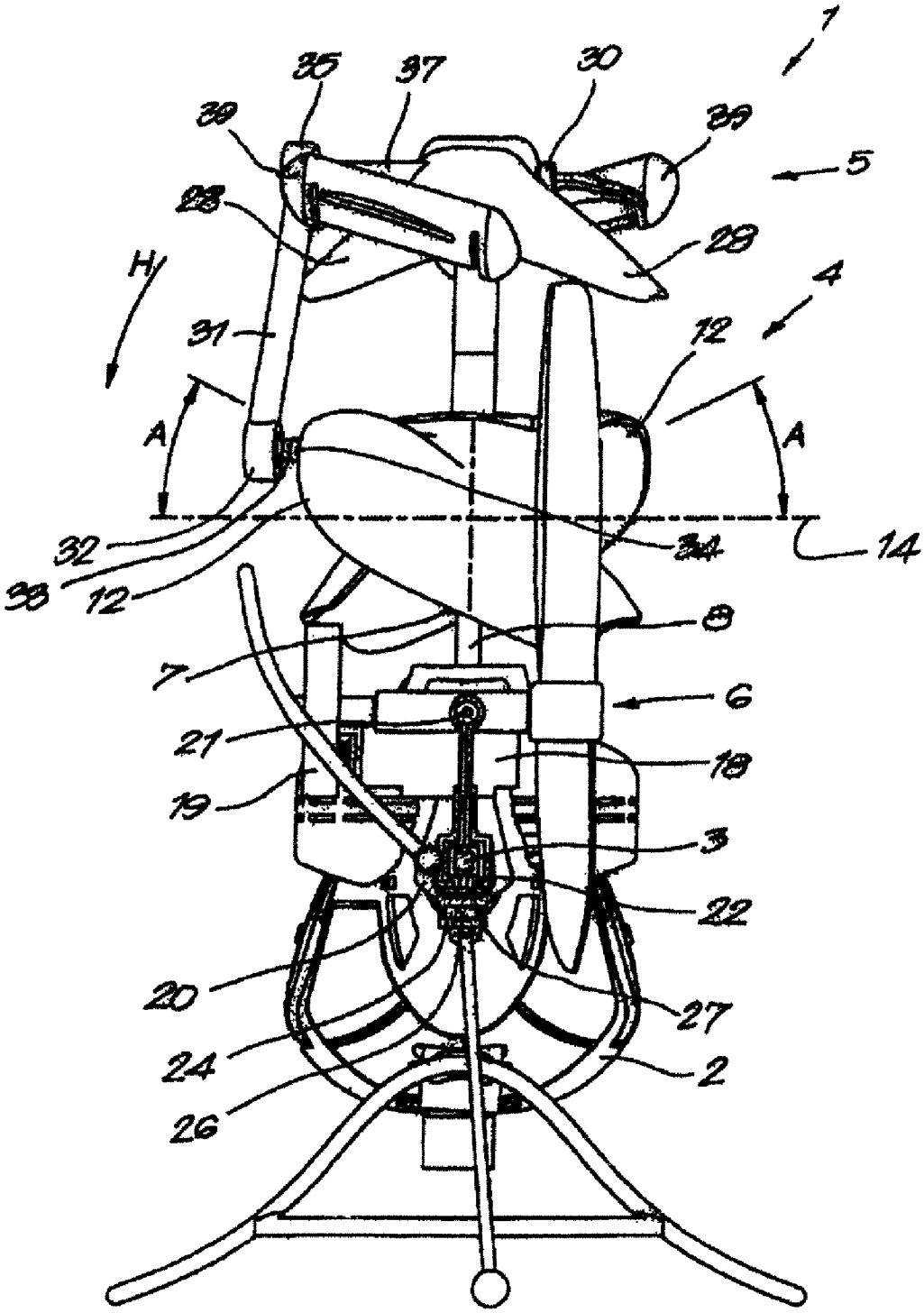
FIG. 6 is a rear view according to arrow F6 in FIG. 5.

The tilt or angle of incidence A of the rotor blades 12, in other words the angle A, which forms the rotor blades 12 as represented in FIG. 6 with the plane of rotation 14 of the main rotor 4, can be adjusted as the main rotor 4 is hinge-mounted on this rotor shaft 8 by means of a joint, such that the angle between the plane of rotation of the main rotor and the rotor shaft may freely vary.

The first longitudinal axis 29 of the auxiliary rotor 5 runs along a line of the auxiliary rotor 5 which runs through the rotor shaft 8. The second longitudinal axis 13 extends from the ends of the propeller blades 12 towards the rotor shaft 8. The propeller blades 12 of the main rotor 4 are mounted pivotably on a joint formed by a spindle 15. The spindle 15 is fixed on the rotor shaft 8 of the main rotor 4 and extends in the direction of the second longitudinal axis 13 of the main rotor 4.

In the case of the example of a main rotor 4 with two blades 12, the joint is formed by the spindle 15 of a rotor head 7.

The axis 16 of this spindle 15 is directed transversal to the rotor shaft 8 and essentially extends in the direction of the longitudinal axis 13 of one of the rotor blades 12 and it preferably forms, as represented in FIG. 2, an acute angle B with this longitudinal axis 13.

Each propeller blade 12 has an upper surface formed in the form of an upwardly convex curve, running from essentially a tip of the propeller blade 10 towards the rotor shaft 8.

The swing 20 is provided with an extension piece 24 towards the bottom, which is kept in a central position by means of a spring 25 when in a state of rest, whereby the second rotor shaft 17 in this position is horizontal and directed crosswise to the first rotor shaft 8.

On the lower end of the extension piece 24 of the swing 20 is provided a magnet 26, whereas opposite the position of the magnet 26 in the above-mentioned state of rest of the swing 20 is fixed a magnetic sensor 27 to the tail 3 which makes it possible to measure the relative angular displacement of the swing 20 and thus of the tail rotor 6 round the swing shaft 21.

The helicopter 1 is also provided with an auxiliary rotor 5 which is driven substantially synchronously with the main rotor 4 by the same rotor shaft 8 and the rotor head 7.

The auxiliary rotor 5 in this case has two elongated members in the form of vanes 28, which are essentially in line with their longitudinal axis 29. The longitudinal axis 29, seen in the sense of rotation R of the main rotor 4, is essentially parallel to the longitudinal axis 13 of blades 12 of the main rotor 4 or encloses a relatively small acute angle C with the latter, so that both rotors 4 and 5 extend more or less parallel on top of one another with their blades 12 and vanes 28.

The diameter of the auxiliary rotor 5 is preferably smaller than the diameter of the main rotor 4 as the vanes 28 have a smaller span than the rotor blades 12, and the vanes 28 are substantially rigidly connected to each other. This rigid whole forming the auxiliary rotor 5 is provided in a swinging manner on an oscillating shaft 30 which is fixed to the rotor head 7 of the rotor shaft 8. This is directed transversally to the longitudinal axis of the vanes 28 and transversally to the rotor shaft 8.

The main rotor 4 and the auxiliary rotor 5 are connected to each other by a mechanical link which is such of the auxiliary rotor 5 the angle of incidence A of at least one of the rotor blades 12 of the main rotor 4. In the given example this link is formed of a rod 31.

This rod 31 is hinge-mounted to a blade 12 of the main rotor 4 with one fastening point 32 by means of a joint 33 and a lever arm 34 and with another second fastening point 35 situated at a distance from the latter, it is hinge-mounted to an elongated member, being a vane 28 of the auxiliary rotor 5 by means of a second joint 36 and a second lever arm 37.

The fastening point 32 on the main rotor 4 is situated at a distance D from the axis 16 of the spindle 15 of the rotor blades 12 of the main rotor 4, whereas the other fastening point 35 on the auxiliary rotor 5 is situated at a distance E from the axis 38 of the oscillatory shaft 30 of the auxiliary rotor 5.

The distance D is preferably larger than the distance E, and about the double of this distance E, and both fastening points 32 and 35 of the rod 31 are situated, seen in the sense of rotation R on the same side of the rotor blades 12 of the main rotor 4 or of the vanes 28 of the auxiliary rotor 5, in other words they are both situated in front of or at the back of the rotor blades 12 and elongated members 28, seen in the sense of rotation.

Also, the longitudinal axis 29 of the elongated members 28 of the auxiliary rotor 5, seen in the sense of rotation R, can encloses an angle F with the longitudinal axis 13 of the rotor blades 12 of the main rotor 4, which enclosed angle F is in the order, of magnitude of about 10°, whereby the longitudinal axis 29 of the vanes 28 leads the longitudinal axis 13 of the rotor blades 12, seen in the sense of rotation R. Different angles in a range of, for example, 5° to 25°.

The auxiliary rotor 5 is provided with two stabilizing weights 39 which are each fixed to an elongated member 28 at a distance from the rotor shaft 8.

Further, the helicopter 1 is provided with a receiver, so that it can be controlled from a distance by means of a remote control. In the helicopter 1 there is a motor, receiver, and battery. There is a separate remote controller device 500.

As a function of the type of helicopter, it is possible to search for the most appropriate values and relations of the angles B, F and G by experiment; the relation between the distances D and E; the size of the weights 39 and the relation of the diameters between the main rotor 4 and the auxiliary rotor 5 so as to guarantee a maximum auto stability.

The operation of the helicopter 1 is as follows:

In flight, when there is a first degree of lift, the rotors 4, 5 and 6 are driven at a certain speed, as a result of which a relative air stream is created in relation to the rotors, as a result of which the main rotor 4 generates an upward force so as to make the helicopter 1 rise or descend or maintain it at a certain height, and the tail rotor 6 develops a laterally directed force which is used to steer the helicopter 1.

It is impossible for the main rotor 4 to adjust itself, and it will turn in the plane 14 in which it has been started, usually the horizontal plane. Under the influence of gyroscopic precession, turbulence and other factors, it will take up an arbitrary undesired position if it is not controlled.

The surface of rotation of the auxiliary rotor 5 may take up another inclination in relation to the surface of rotation 14 of the main rotor 8, whereby both rotors 5 and 4 may take up another inclination in relation to the rotor, shaft 8.

This difference in inclination may originate in any internal or external force or any disturbance whatsoever.

In a situation whereby the helicopter 1 is hovering stably on a spot in the air without any disturbing internal or external forces, the auxiliary rotor 5 keeps turning in a plane which is essentially perpendicular to the rotor shaft 8.

If, however, the body 2 is pushed out of balance due to any disturbance whatsoever, and the rotor shaft 8 turns away from its position of equilibrium, the auxiliary rotor 5 does not immediately follow this movement, since the auxiliary rotor 5 can freely move round the oscillatory shaft 30.

The main rotor 4 and the auxiliary rotor 5 are placed in relation to each other in such a manner that a swinging motion of the auxiliary rotor 5 is translated almost immediately in the pitch or angle of incidence A of the rotor blades 12 being adjusted.

For a two-bladed main rotor 4, this means that the rotor blades 12 and the vanes 28 of both rotors 4 and 5 must be essentially parallel or, seen in the sense of rotation R, enclose an acute angle with one another of, for example, 10° in the case of a large main rotor 4 and a smaller auxiliary rotor 5.

This angle can be calculated or determined by experiment for any helicopter 1 or per type of helicopter.

If the axis of rotation 8 takes up another inclination than the one that corresponds to the above-mentioned position of equilibrium in a situation whereby the helicopter 1 is hovering, the following happens.

A first effect is that the auxiliary rotor 5 will first try to preserve its absolute inclination, as a result of which the relative inclination of the surface of rotation of the auxiliary rotor 5 in relation to the rotor shaft 8 changes.

As a result, the rod 31 will adjust the angle of incidence A of the rotor blades 12, so that the upward force of the rotor blades 12 will increase on one side of the main rotor 4 and will decrease on the diametrically opposed side of this main rotor.

Since the relative position of the main rotor 4 and the auxiliary rotor 5 are selected such that a relatively immediate effect is obtained, this change in the upward force makes sure that the rotor shaft 8 and the body 21 is forced back into their original position of equilibrium.

A second effect is that, since the distance between the far ends of the vanes 28 and the plane of rotation 14 of the main rotor 4 is no longer equal and since the vanes 28 also cause an upward force, a larger pressure is created between the main rotor 4 and the auxiliary rotor 5 on one side of the main rotor 4 than on the diametrically opposed side.

A third effect plays a role when the helicopter begins to tilt over to the front, to the back or laterally due to a disturbance. Just as in the case of a pendulum, the helicopter will be inclined to go back to its original situation. This pendulum effect does not generate any destabilizing gyroscopic forces as with the known helicopters that are equipped with a stabilizer bar directed transversally to the rotor blades of the main rotor. It acts to reinforce the first and the second effect.

The effects have different origins but have analogous natures. They reinforce each other so as to automatically correct the position of equilibrium of the helicopter 1 without any intervention of a pilot.

Stabilization against turning can be affected by adjusting the speed of the tail rotor 6 and/or by adjusting the angles of incidence of the rotor blades of the tail rotor 6, depending on the type of helicopter 1.

Figure 7:
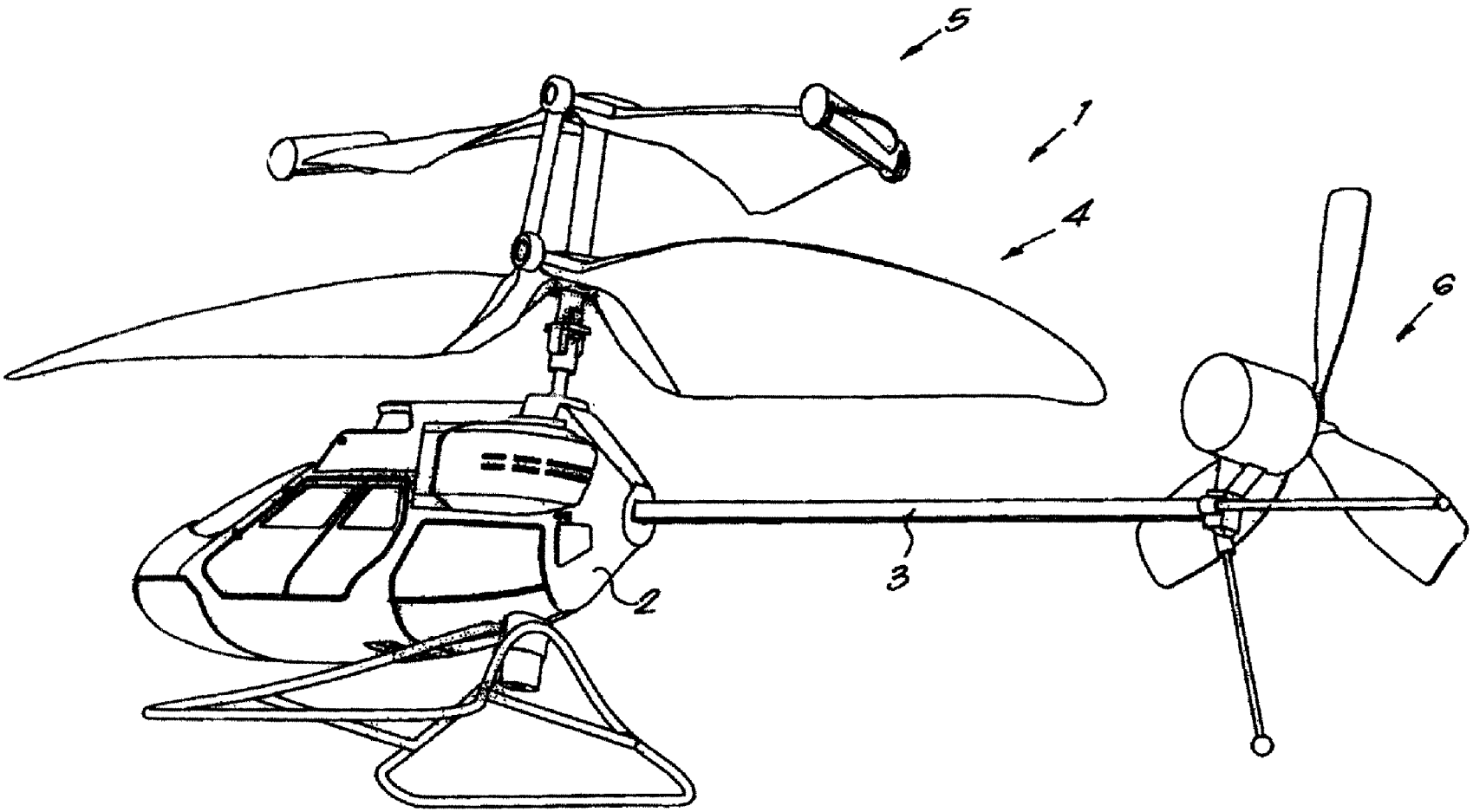
FIG. 7 represents a variant of FIG. 1.
Figure 8:
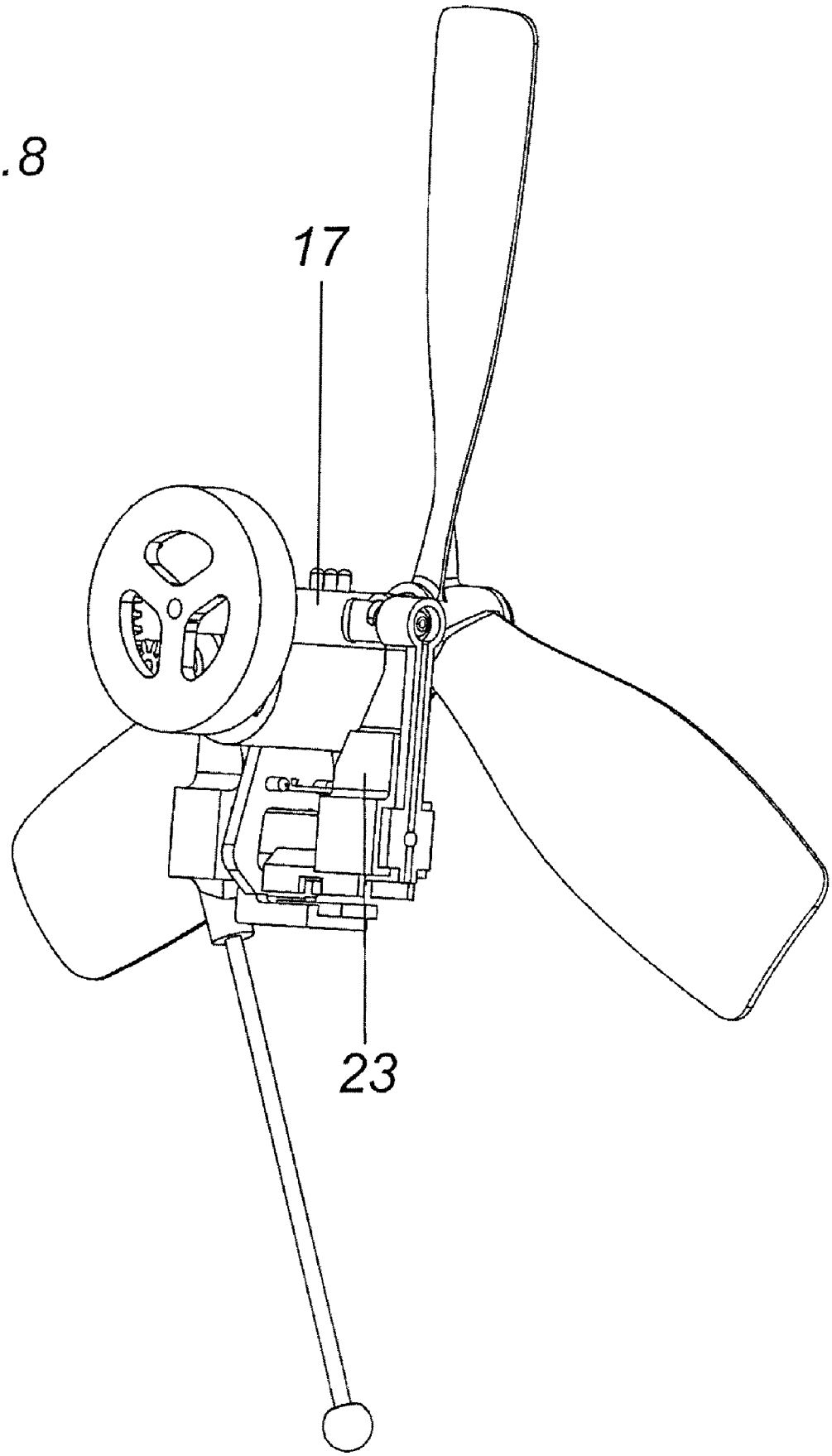
FIG. 8 represents a variant of FIG. 5.
Figure 9:
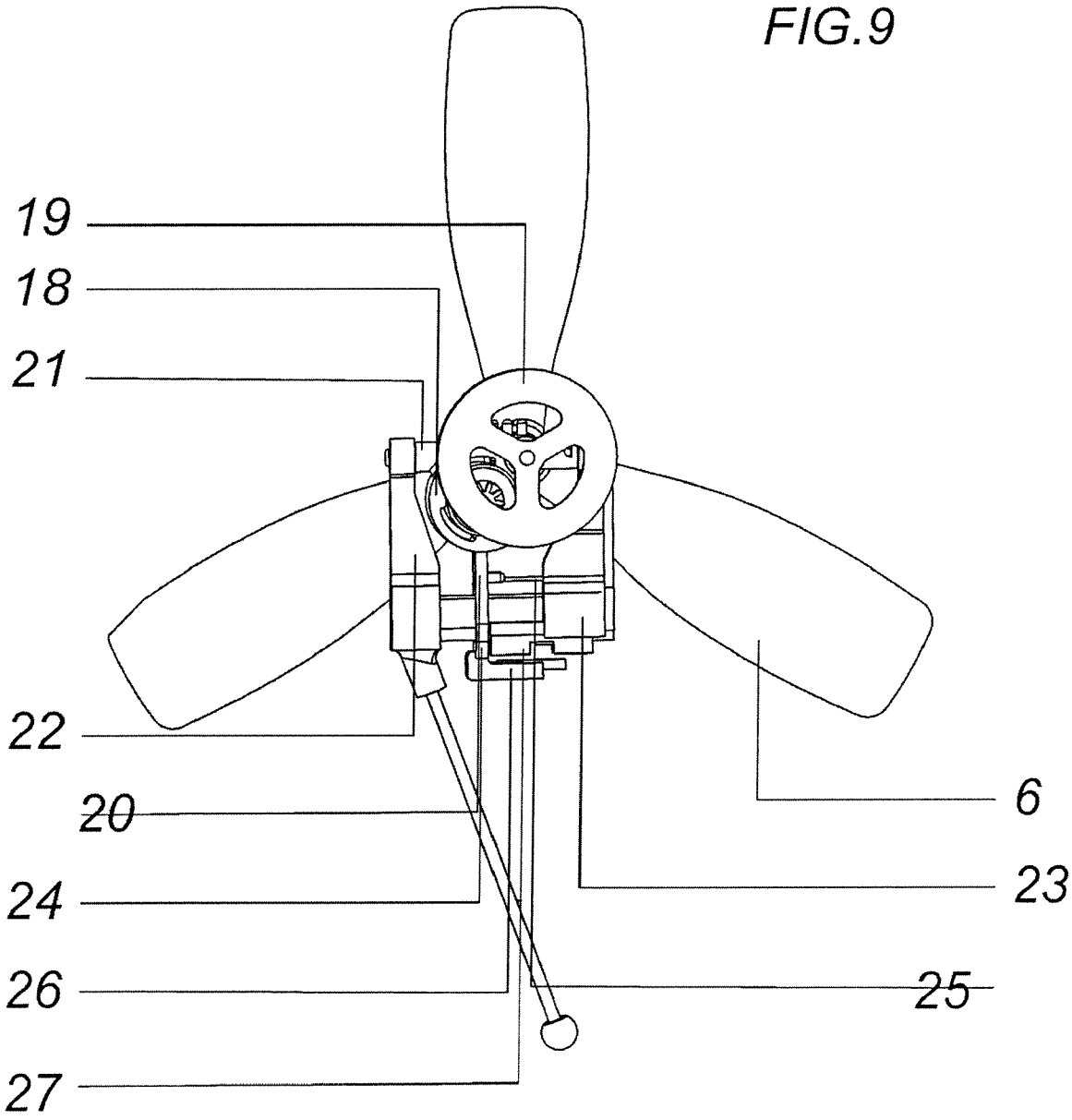
Figure 10:
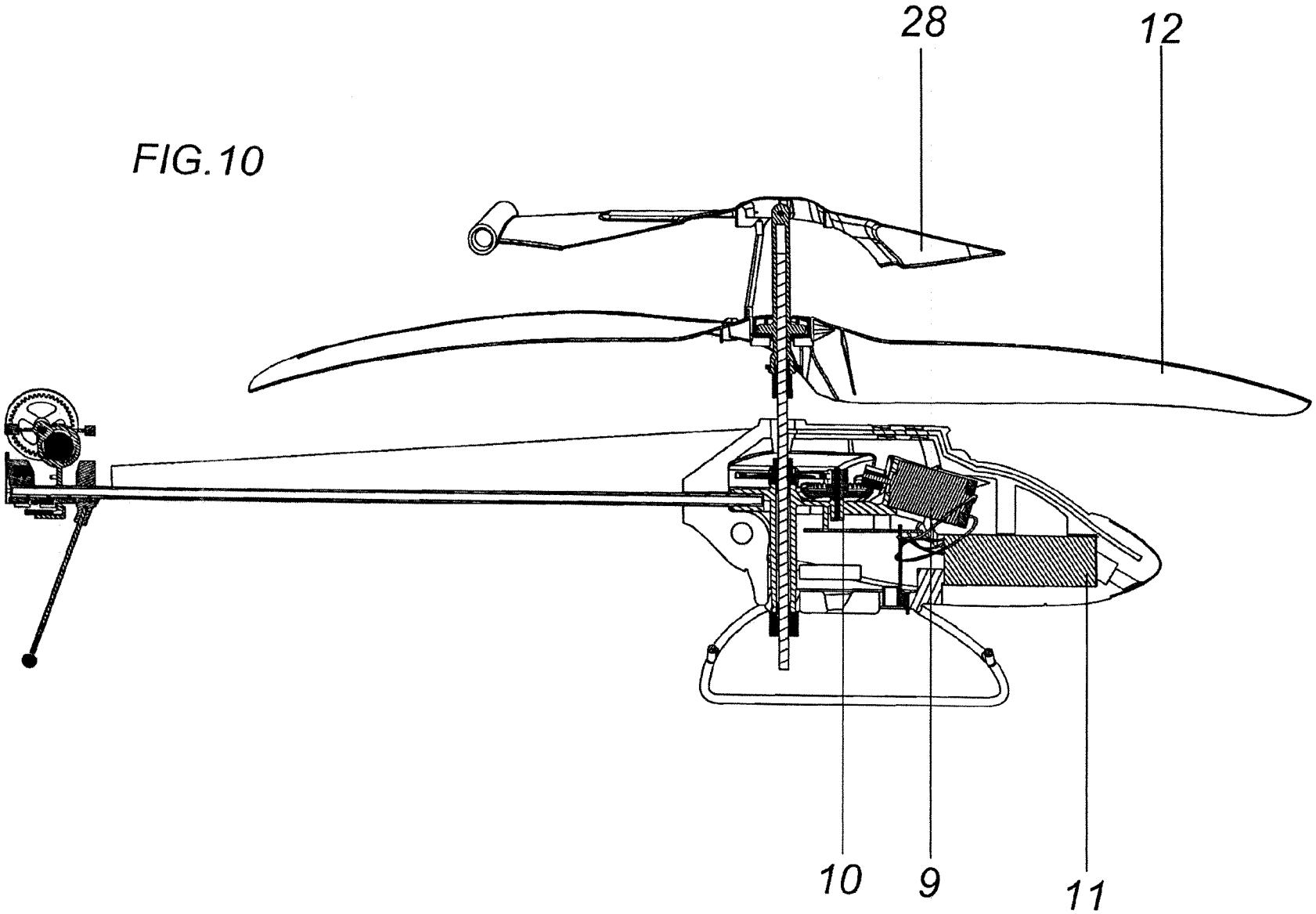
FIG. 10 represents a section of the helicopter.

If necessary, this aspect of the disclosure may be applied separately, just as the aspect of the auxiliary rotor 5 can be applied separately, as is illustrated for example in FIG. 7, which represents a helicopter 1 according to the disclosure having a main rotor 4 combined with an auxiliary rotor 5, but whose tail rotor 6 is of the conventional type, i.e. whose shaft cannot turn in a swing but is bearing-mounted in relation to the tail 3.

In practice, the combination of both aspects makes it possible to produce a helicopter which is stable in any direction and any flight situation and which is easy to control, even by persons having little or no experience.

It is clear that the main rotor 4 and the auxiliary rotor 5 must not necessarily be made as a rigid whole. The shape of the blades 12 of the main rotor 4 can be relatively large in cross section when considered from the leading to the trailing edges. The under face is concave and the top face is convex and as such the blade is relatively thin. The concavity-convexity profile extends essentially from the rotor tip to the essentially towards the rotor shaft and also from the leading end to the trailing ends of the blades and essentially extends over the greater surface area of each rotor blade. This light weight blade is relatively rigid when the blade is considered as a support to the helicopter body in its normal flying mode as shown in the drawings The rotor blades 12 and the elongated members 28 can also be provided on the rotor head 7 such that they are mounted and can rotate relatively separately. In that case, for example, two rods 31 may be applied to connect each time one blade 12 to one elongated member 28.

It is also clear that, if necessary, the joints and hinge joints may also be realized in other ways than the ones represented, for example by means of torsion-flexible elements.

In the case of a main rotor 4 having more than two blades 12, one should preferably be sure that at least one blade 12 is essentially parallel to one of the vanes 28 of the auxiliary rotor. The joint of the main rotor 4 is preferably made as a ball joint or as a spindle 15 which is directed essentially transversely to the axis of the oscillatory shaft 30 of the auxiliary rotor 5 and which essentially extends in the longitudinal direction of the one blade 12 concerned which is essentially parallel to the vanes 28.

In another format, the helicopter comprises a body with a tail; a main rotor with blades which is driven by a rotor shaft on which the blades are mounted. A tail rotor is driven by a second rotor shaft directed transversally to the rotor shaft of the main rotor. An auxiliary rotor is driven by the rotor shaft of the main rotor and is provided with elongated members from the rotor shaft in the sense of rotation of the main rotor.

The auxiliary rotor is mounted in a swinging relationship on an oscillatory shaft and the swinging motion being relatively upwardly and downwardly about the auxiliary shaft. The auxiliary shaft is provided essentially transverse to the rotor shaft of the main rotor. The main rotor and the auxiliary rotor are connected to each other by a mechanical link, such that the swinging motion of the auxiliary rotor controls the angle of incidence of at least one of the rotor blades of the main rotor. There can be different degrees of width, varying from narrow to broader for each of the rotors, and weights can be strategically placed along the length of the auxiliary rotor to achieve the right motion and effect on the main rotor bearing in mind the appropriate angular relationship between the axis of the auxiliary and the axis of the main rotor to achieve the effect and control of the angle of incidence of the main rotor. In some cases, the auxiliary rotor can be mounted below the main rotor, namely between the top of the body and the main rotor and still achieve the right effect on the main rotor angle of incidence.

The angle of incidence of the rotor in the plane of rotation of the rotor and the rotor shaft may vary. An auxiliary rotor rotatable with the rotor shaft is for relative oscillating movement about the rotor shaft. Different relative positions are such that the auxiliary rotor causes the angle of incidence the main rotor to be different. A linkage between the main and auxiliary rotor causes changes in the position of the auxiliary rotor to translate to changes in the angle of incidence.

The rotor blades of the main rotor and the vanes of the auxiliary rotor respectively are connected to each other with a mechanical linkage that permits the relative movement between the blades of the rotor and the vanes of the auxiliary rotor. A joint of the main rotor to the rotor blades is formed of a spindle which is fixed to the rotor shaft of the main rotor.

The mechanical link includes a rod hinge mounted to a vane of the auxiliary rotor with one fastening point and is hinge-mounted with another fastening point to the blade of the main rotor.

There is a downwardly directed stabilizer 108 at the tail of the helicopter.

FIG. 15 also shows a radio control unit for operation with the helicopter. This unit can have appropriate computerized controls for signaling the operation of the motors operating the rotors and their relative positions.

As described and illustrated in detail in this disclosure there is a helicopter rotor that is spinning around to sustain the helicopter in flight, as illustrated in FIG. 19. In this configuration there is a stabilizer auxiliary rotor 128 with a main rotor 112. There is no other control system for changing the angle of incidence of the rotor 112 to affect other control of movement in an essentially horizontal sense.

The rotor 112 and stabilizer rotor 128 are interconnected in FIG. 19. The rotor 112 and also the stabilizer rotor 128 are independent to move around hinging lines as found in helicopter rotors. This can, for example, be a feather or a teether hinge or axis 200 and 202 respectively. The helicopter as represented is able to move up or down by changing rotor rpm, or change heading by altering tail rotor rpm. The helicopter as illustrated in FIG. 19 cannot as effectively be controlled to accelerate forward or backwards, nor sideways left or right, namely in the relatively horizontal dimensions.

In order to more effectively control a helicopter in flight, preferably essentially permanent commands are needed in those horizontal dimensions to direct the helicopter in or towards the desired direction. There is provided a control system to influence the lift force of the rotor 112 in a cyclical way, i.e., in such a way that each rotor blade half 112*a* and 112*b* varies lift along one rotation around the vertical rotor shaft 108. When the rotor halves 112*a* and 112*b* produce different lift 224 for blade 112*a* versus the other lift 226 for blade 112*b*, a torque C originates and moves the rotor 112 in the direction D of that torque. The effect of this torque is not necessarily in line with the span of the rotor and may occur later due to gyroscopic forces. The angle of incidence on the one blade 112*a* related to the plane of rotation is steeper or larger than the angle of incidence of the blade 112*b* or portion related to the plane of rotation which is relatively shallower. This effects a movement in direction D. This can be influenced by gyroscopic forces. This is illustrated in FIG. 20. Each blade 112*a* and 112*b* connected to the rotor assembly sees this change cyclically along a 360-degree rotation of the rotor shaft.

The control system of the disclosure includes the following features:

- a rotor 112, preferably but not essentially complemented with a stabilizer rotor 128,
- a control ring 204, attached to the rotor 112, and
- an actuator device 206, connected with the helicopter body structure represented by a base element 208 illustrated in a representative manner in FIG. 21. Instead of a base there can be other structures to which the ring is attached.

These are illustrated in FIG. 21.

The control ring 204 is generally centered around the vertical rotor axis 108. The ring 204 moves with the rotor 112 when tilted around the feather axis 200. This is illustrated in some detail in FIGS. 22*a* and 22*b*, such that the tilt is shown in FIG. 22*b*.

The actuator device 206 represented includes a coil 210, a hinged magnet 212, a base 214 and a lever 216 as shown in the exploded view in FIG. 23. Depending on the voltage and current sent through the coil 210 from the power supply as controlled by the controller, which is in turn controlled by a radio control unit, the lever 216 exercises a force on the control ring 204 causing changes in incidence of the feathered rotor blade 112.

The actuator device 206 could have many forms, and use different technologies. It could be an electric motor for example with a lever attached to the axis of the motor or other electromagnetic or magnetic systems can be used. Other systems can be used. There could be a piezoelectric device, ionic polymer actuators, other non-magnetic devices and other interactive and/or inter-responsive systems for causing a lever to move, or if there is no lever there could be a different configuration for having the rotor move about an axis such as the feather axis in a periodic manner.

Operation: No Command State

In the situation where the actuator 206 is not activated, there is no contact between the lever 216 and the ring 204, no matter the rotation position of the rotor 112. The rotor system behaves as if no control mechanism was present. In the case of a self-stabilizing rotor system, the helicopter will float more or less in a hovering position, depending mainly on the position of the center of gravity, as explained in the prior patent applications referred to above and also disclosed in this disclosure. FIGS. 25, 26 and 27*a* and 27*b* are illustrative.

Operation: Command State

When the actuator 206 is activated, then the lever 216 moves or rotates, and engages the control ring 204 and exercises a force on the ring 204. The size of that force depends on the size of the control signals sent by the actuator 206. The force causes a torque on the control ring assembly 204. The size of the torque transmitted to the assembly depends on the ratio between 218 and 220. The longer the relative length of 218 to 220, the more torque is transmitted. FIGS. 28*a* and 28*b* are illustrative.

This torque inclines the attached rotor 112 along the feather axis 200, which is perpendicular to the actuator force direction 222. In FIG. 28*a* this is a representative position along a 360° path of the rotor 112. One rotor half or one blade 112*a* takes a higher angle of incidence, while the opposing rotor half or blade 112*b* takes a lower angle of incidence. The lift force 224 generated by rotor half or blade 112*a* is bigger than the lift force 226 generated by rotor half or blade 112*b*.

The stabilizer or auxiliary rotor 128 follows the movement of the attached rotor 112 depending on its mechanical relationship with that rotor 112. In the case of the helicopter of FIGS. 1 to 18, the stabilizer 128 hinges around the teether axis 202. FIGS. 29*a* and 29*b* are illustrative.

This asymmetry in lift force exercises a torque on the helicopter as further explained in relation to FIG. 20.

When the rotor 112 progresses in its rotation by 90 degrees, the feather axis 200 of the rotor 112 and control ring assembly 204 is now in line with the force of the actuator 206 and its lever 216. The rotor 112 cannot incline as a result of the exercised force, and the rotor 112 does not 'see' this force or torque. FIG. 30*a*, with the rotor omitted for clarity, and FIG. 30*b* are illustrative. This is a mechanical explanation of how the control is relatively cyclical. The ring 204 is not tilted in this portion of the cycle and has zero effect.

This means that the impact from the actuator force goes from maximum to zero in a 90-degree progression of the rotor. It goes to maximum again for the next progression of 90 degrees, and again to zero for the next 90 degrees, etc. This can be essentially a sinusoidal type change of force acting on the blade or blades of the rotor.

This causes the effect of the force to vary cyclically. This is a term generally used in helicopters to indicate that the impact of the control input varies not only with the size and type of control input, but as well with the position of the blade progressing along a 360-degree circle around the rotor shaft. With the position of the actuator 206 with respect to the rotor axis 108 and the body fixed, the effect of the actuator force makes the helicopter go in essentially or substantially the same or similar direction. This is determined by the angle of the actuator position relative to the body and the rotor shaft 108 and the gyroscopic effects. The size of the force mostly impacts the speed and/or acceleration of the movement of the body. This is a control system to control the movement of the helicopter body.

Operation: Variations and Parameters

When the actuator position is in line with the axis of the helicopter body from nose to tail, it does not mean the helicopter moves forward with a control input. Gyroscopic forces tend to delay the effects of moving the position of spinning masses by up to 90 degrees. The exact delay depends on parameters like the masses of the spinning objects such as, for instance, the rotor, and/or stabilizer, and the aerodynamic forces, the angle between the rotor feather axis and the rotor centerline, the type of rotor hinges ('rigid' or 'soft') etc. The preferred positioning of the actuator for the desired effect is effectively determined as a function of the desired direction of movement.

FIG. 31*a*, 31*b* and 31*c* show different possible positions of the actuator 206. Each position establishes a rotor system with a unique flight pattern.

FIG. 32 shows how two actuators 206*a* and 206*b* are used to exercise force independently on the control ring. As such, and in case these actuators 206*a* and 206*b* are disposed 90 degrees one versus the other and commanded by two independent signals, two-dimensional horizontal movement can be initiated. When four actuators are installed, one every 90 degrees relative to each other, a fuller directional control in the horizontal plane is possible.

When, for instance, three actuators are used, each 120 degrees from the other and commanded by three independent signals, and provided some interrelation of the three signals, a fuller directional control in the horizontal plane is possible.

Operation Specifics

The helicopters of the prior related patent applications create auto-stability. One of the elements of the system is a completely free to move rotor/stabilizer assembly. Any external obstruction to this causes the stabilizing effect to disappear. In a 'classic' cyclical control system, the control mechanism takes full control over the rotor system. The degree to which the control system overrides the stability system may not be 100%. Tuning and calibration however can keep stability. This is a lower effect, when given a movement command on the actuator.

With the actuator-based control system, there are disclosed different features and capabilities.

When the actuator 206 is at rest, there is no contact with the rotor or mechanical disturbance to the free movement of the rotor 112 and stabilizer rotor 128. FIGS. 25, 26, 27*a* and 27*b* are illustrative.

When a signal is passed to the actuator 206, the force temporarily interferes with the rotor system, 'destabilizing' it in such a way that the helicopter moves in the desired direction. FIGS. 29*a* and 29*b* are illustrative.

When the actuator signal is put back to zero, then the rotor assembly is free again to take over control. FIGS. 33*a* and 33*b* are illustrative.

There is a control system for regulating the degree of requisite horizontal movement and a control system for regulating the stability of the helicopter in a relative non-horizontal moving sense. The degree to which the horizontal movement control system is dominant over the non-horizontal movement stability system of the helicopter determines the rate of change in position in the horizontal sense. The horizontal control system includes the interaction of the ring 204, actuator 206 and its control operation. The control system for stability is achieved in part by the interactive rotor 112 and stabilizing rotor 128.

The motor 300 and interactive gear system 302 and 304 drive the rotor shaft 108 at the requisite speed. Control electronics 306 can be mounted on the substitute 308 as necessary.

In the case represented, when the rotor 112 and stabilizer 128 find themselves in an 'unnatural state'—they realign themselves automatically for all the reasons claimed by prior helicopter and come back to state as shown in FIGS. 34*a* and 34*b*. The stabilizing effect of the helicopters of FIGS. 1 to 18 takes over again. This means that there is accomplished the combination of both desired components: stability when no input is given, and control when input signal is given to the actuator 206 and the rotor assembly ring 204.

The disclosure has been described and illustrated with a self-stabilizing rotor system. Other non-self stabilizing flying devices could also use the control system of the disclosure.

A helicopter according to the disclosure can be made in all sorts of shapes and dimensions while still remaining within the scope of the disclosure. In this sense, although the helicopter in some senses has been described as toy or model helicopter, the features described and illustrated can have use in part or whole in a full-scale helicopter. In some cases the helicopter may be a structure without a tail rotor. Different helicopter-type systems can use the control of the disclosure. In other cases the rotor control can be used with different flying objects.

In other forms instead of the mechanical interaction to effect the control a suitable magnetic or electro magnetic servo can be used for instance with a helicopter using the main rotor and also a stabilizer auxiliary rotor.

Although the disclosure has detailed a system for essentially substantial or approximate horizontal movement in one or two directions, the disclosure includes systems for permitting control of the movement in other substantially horizontal directions. As such, the helicopter control can affect control of horizontal movement forward and/or backwards and/or sideways to the left and/or sideways to the right or different combinations of those movements.

For this purpose there may be more than the one control system for inter-reacting with the rotor assembly. There could be several control systems operating on the rotor in parallel and/or series manner to effect the desired horizontal movement.

The horizontal movements effected by the control systems are in addition to the up and/or down movements that are possible with the helicopter system with the control being non-operation or on-function on the rotor assembly.

Instead of an assembly depending from the rotor there could be other structures for the actuator to interact with the rotor system. Further, instead of a ring for interaction with the actuator there could be other physical structures for interaction with the actuator. In different cases there can be more than two blades for the rotor, and one or two or more of the blades of the rotor can be controlled to different or the same degree.

Referring to FIGS. 35-47, a toy helicopter 400 of one form of this disclosure comprises a body 401; a motor 9 in the helicopter 400, a battery 450 for powering the motor, and a receiver 452 for communicating signals between the motor and a separate remote controller 500. There is a separate remote controller.

The main rotor 403 with blades 407 is driven by a rotor shaft 411 and is hinge-mounted on this rotor shaft 411. The angle between the plane of rotation of the main rotor 403 and the rotor shaft 411 may vary. There is a control for moving the angle of incidence of at least one blade of the rotor relative to the angle of incidence of another blade of the rotor cyclically along at least part of a 360-degree rotation path around the rotor shaft 411. This causes a variation in lift force of the blade along at least part of the rotation path. This causes the body 400 to be urged in a relatively horizontal direction from a relative position of rest.

There is a first lift force developed by the main rotor 411 to retain the helicopter 400 airborne.

There is an element 413 for permitting the helicopter 400 to travel on a surface when the main rotor 403 develops a second degree of lift force; the second degree of force is less than a first degree of force. The element 413 for permitting movement on the surface 1000, selectively the ground or a floor, which is relatively smooth, are wheels 413*a*-413*c*.

The element 413 is not limited to wheels, however, the element 413 should minimize or limit a point of contact between the helicopter 400 and the surface 1000. Additionally, the element 413 should be able to direct the helicopter 400 in a direction by offering a path of least resistance. Wheels are suitable toward this end. Wheels provide less friction in the direction the wheel turns. Thus, the helicopter 400 will tend to move in the direction the wheels turn even if a force with a component perpendicular to the direction the wheel turns is applied. The wheels may have tread to increase resistance to movement in directions other than the direction the wheels turn.

There are wheels 413*a*-413*c* for permitting the helicopter 400 to travel on a ground surface 1000 when the main rotor 403 develops a second degree of lift force. There are at least three wheels 413*a*-413*c* arranged in spaced relationship with the body 401, and the wheels 413*a*-413*c* can be arranged to permit a stable relationship of the helicopter 400 on the ground 1000 when in an at rest position.

In one form the rotor shaft 411 is relatively forwardly tilted relative to vertical, shown as angle Q in FIG. 40. The rear portion is adjacent to the body 401, thus the top the shaft 411 is closer to the front of the body 401 than to the portion adjacent to the body 401.

In one form there is only a single front wheel 413*a* and two rear wheels 413*b* and 413*c* respectively, and the rear wheels 413*b* and 413*c* are spaced apart. The single front wheel 413*a* is mounted relative to the body 401 such that it is pivotable relative to a forward axis which extends between the front and the rear of the body 401. The single front wheel 413*a* can be mounted relative to the body 401 such that the pivot point is located ahead of the wheel, and a fork 415 for supporting a wheel 413 is inclined from the pivot point rearwardly towards an axle of the wheel.

In another form the single front wheel 413*a* is mounted relative to the body 401 such that it is fixed relative to a forward axis which extends between the front and the rear of the body 401. Here the single front wheel 413*a* is mounted relative to the body 401 such that the support point is located ahead of the wheel. There is a fork for supporting a wheel that is inclined from the support point rearwardly towards an axle of the wheel.

In another form the single front wheel 413*a* is mounted relative to the body 401 such that it is pivotable relative to a forward axis which extends between the front and the rear of the body 401. The single front wheel 413*a* is mounted relative to the body 401 such that the pivot point is located ahead of the wheel, and there is a fork for supporting a wheel that is inclined from the pivot point rearwardly towards an axle of the wheel. The single front wheel is mounted relative to the body such that it is fixed relative to a forward axis which extends between the front and the rear of the body. The single front wheel can be mounted relative to the body such that the support point is located ahead of the wheel. The fork 415 for supporting a wheel is inclined from the support point rearwardly towards an axle of the wheel.

There can be an element 417 attached to the remote control toy helicopter 400. The element 417 is selectively movable to different operating positions along the longitudinal length of the toy helicopter 400 to change the center of gravity of the remote control toy helicopter.

An auxiliary rotor 405 is driven by the rotor shaft 411 of the main rotor 403 in the rotational sense of the main rotor 403. The auxiliary rotor 405 is mounted such that a first longitudinal axis of the auxiliary rotor 405 is situated in an angle relative to a second longitudinal axis of one of the propeller blades 407 of the main rotor 403. The acute angle is determined when viewed from above the plane of rotation. The auxiliary rotor 405 has a further plane of rotation spaced from the plane of rotation.

The main rotor 403 and the auxiliary rotor 405 are linked with each other by a mechanical linkage 419, such that the auxiliary rotor 405 is mounted in a swinging relationship on an oscillatory shaft provided essentially transversally to the rotor shaft 411 of the main rotor 403. The swinging motion is relatively upwards and downwards around the oscillatory shaft 419, such that the swinging motion of the auxiliary rotor 405 controls an angle of incidence of the propeller blades 407 of the main rotor 403.

There is a first longitudinal axis of the auxiliary rotor 405 that runs along a line of the auxiliary rotor 405 which runs through the rotor shaft 411. There is a second longitudinal axis extending from the ends of the propeller blades 407 towards the rotor shaft 411. The propeller blades 407 of the main rotor 403 are mounted pivotably on a joint formed by a spindle which is fixed on the rotor shaft of the main rotor. The spindle of the main rotor 403 extends along the second longitudinal axis of the main rotor 403, and the auxiliary rotor 405 is mounted.

The first longitudinal axis of the auxiliary rotor 405 is situated in an acute angle relative to the second longitudinal axis of one of the propeller blades 407 of the main rotor 403.

Each propeller blade 407 has an upper surface formed in the form of an upwardly convex curve, running from essentially a tip of the propeller blade 407 towards the rotor shaft 411.

There is a variation in lift force of the blade along at least part of the rotation path and thereby causes the body 401 to be urged in a relatively horizontal direction from a relative position of rest, and being such that for first lift force developed by the main rotor 403, the helicopter is airborne.

There are wheels 413 for permitting the helicopter 400 to travel on a ground surface 1000 when the main rotor 403 develops a second degree of lift force.

The auxiliary rotor 405 is a rigid whole mounted pivotably around the oscillatory shaft 419. The main rotor 403 is a unitary one-piece body. The propeller blades 407 are essentially rigidly connected with each other.

Each of the propeller blades 407 has a substantially convex upper surface along the second longitudinal axis. The upper surface is convex from a leading edge to a trailing edge of the blade 407, and each propeller blade 407 has a substantially concave lower surface along the second longitudinal axis. The lower surface is concave from the leading edge to the trailing edge of the blade throughout a substantial portion of the second longitudinal axis of the blade 407.

The longitudinal axis of the elongated elements 409 of the auxiliary rotor 405 in the sense of rotation is located within an angle of about 5 to 25 degrees with the longitudinal axis of one of the rotor blades 407 of the main rotor 403.

An aspect of the disclosure is a toy that can drive around on a surface 1000 and be controllable like a car, can lift off and fly around, and land back and continue its flight.

There is an integrating control in both 'modes' in a manner that does not add undue complexity to the technology, nor extra weight that would be an increased problem for flight mode. It is also relatively simple for the driver/pilot to go from one mode to another.

The controller has the following features. Overall there is a push button on the transmitter. As long as this button is not depressed after power up of the transmitter, the helicopter 400 is in 'car mode'. In the car mode, the main rotor 403 rpm is zero when the stick is at 0, and never goes higher than, say, 15% rpm. This number depends on how fast we want the 'car' to ride even if the stick is pushed to 100%. This mode is used to drive around. In this mode, the impact of the direction control stick is made much bigger than in flight mode, because it has to turn the body/wheels against the friction of the wheels/floor etc.

Then, when the pilot hits the button once, the car converts to helicopter-flying mode, meaning the rpm is following the stick from 0 to 100% and direction/yaw control sensitivity is much lower, about +/−9% rpm in car mode against +/−6% rpm in helicopter-flying mode. Thus if the stick was, say, at 73% while the 'car' was riding (with rpm at 20%), and the button is hit, rpm raises to 73% and the helicopter lifts off. Then, when the pilot lands the helicopter and returns to zero speed, it switches back to car mode.

The disclosed toy uses the forces acting on a helicopter as a means to control the toy in a car mode.

The horizontal control system, that includes the interaction of the ring 204 and actuator 206 shown in FIG. 32, may also move the helicopter 400 backward and forward while in a car mode on the ground 1000.

When a helicopter rotor starts spinning, lift forces are created in the direction orthogonal to the rotational plane. Therefore, when the lift is high enough, at least above a first level, the helicopter lifts vertically. This is because the rotor is in a position substantially parallel to the surface on which it is based. This is also determined by the way the landing gear is angled versus the vertical rotor axis.

In the disclosed configuration of the application as illustrated in FIGS. 35-47, the axis 470 of the main rotor 411 is inclined versus the surface 1000 upon which the helicopter 400 is resting. The lift force is thereby inclined too. This can be decomposed in two vectors, namely vector A shown in FIG. 56, which is vertical to the surface 1000, and is the part of the lift force that is against gravity, and Vector B, which is parallel to the surface 1000 and pushes the body 401 forward. By changing the angle Q of the rotor shaft 411, namely the inclination, the size of the force B can be altered. An effective range of the angle of inclination for the present disclosure is between about 1 and about 10 degrees, and preferably about 2 to 5 degrees. The chosen angle determines the speed at which the helicopter 400 rides on the ground 1000 and or rises from the ground 1000 in the flying mode. The tilt could be changed by a separate function, actuator or servo to tune the forward speed by the receiver.

When provided with wheels 413 or any other features, such as rollers or skids that facilitate sliding, this will move the body 401 of the helicopter 400 in the direction of the vector B. As long as the vector A is lower than the weight, it should continue to ride on a ground surface 1000. When vector A gets bigger than the weight of the helicopter toy, the helicopter lifts off and is in flying mode.

When steering left and right, the body 401 is mainly rotating around its vertical axis. Thereby, the front slides to the left and to the right accordingly. A front wheel 413*a* that can eventually rotate along this axis, but is fixed in direction, opposes this sliding. To solve that, the front wheel 413*a* can be mounted on a pivot F that yaws the wheel in the direction wanted by the varying tail force for direction control.

Referring to FIGS. 46-47, another aspect is to consider the tail force is change so that the tail moves in direction J. This makes the body turn roughly around point G, and the nose of the body yaws in direction H. Because the friction point to the surface is in position K, and the hinge point L is at a distance ahead from that, the wheel assembly yaws to accommodate the turning of the forward moving body.

Additionally shown in FIGS. 46-47 is a port 421. The port 421 includes a station to attached a wire for charging the helicopter 400 and an on/off switch.

The helicopter of this disclosure should be able to move up or down by changing rotor rpm, or change heading by altering tail rotor rpm. The helicopter can be effectively controlled to accelerate forward or backward and sideways left or right, namely the horizontal dimensions with the control system.

In one form of the disclosure, with the first degree of lift provided by the rotor, in order to control a helicopter in flight, commands are used in those horizontal dimensions to direct it towards the desired direction. A rotor system influences the lift force of the rotor in a cyclical way.

With a second degree of lift, the helicopter is for travelling on the ground surface using wheels 413 on the body to facilitate ground motion. The rotor system provides the force for motion in the horizontal direction when the helicopter travels on the ground.

In a first form, a helicopter 400 includes a system to effect motion in a horizontal dimension thereby to direct the desired direction, selectively a desired horizontal direction. The rotor blades 407 are driven by a rotor shaft 411, and are hinge-mounted on this rotor shaft 411, such that the angle between the plane of rotation of the main rotor 403 and the rotor shaft 411 may vary.

Referring to FIGS. 20-34, a control is provided for moving the angle of incidence of at least one blade of the rotor cyclically along a 360 degree rotation path around the vertical rotor shaft 108, causing a variation in lift force of the blade along the rotation path, thereby causing the body 401 to be urged in a relatively horizontal direction from a relative position of horizontal rest. The relative position of horizontal rest is a relatively hovering position above a ground level. By the term, angle of incidence is meant the relative angle of attack of the blade 407 in the plane of rotation.

The control includes an actuator for engaging with an assembly depending from the rotor the inter-engagement of the actuator and assembly effecting a change in the angle of incidence of at least the one blade of the rotor 403.

In different formats, the system is a multi-control or a multi-channel system for controlling the helicopter 400 in different essentially horizontal directions.

The system includes a rotor, preferably complemented with a stabilizer rotor. There is a control ring attached to the main rotor, and an actuator device connected with the helicopter body structure. The control ring is generally centered around the vertical rotor shaft, and moves with the rotor when tilted around the feather axis.

In other situations the disclosure is concerned with a rotor without a stabilizer.

The control includes an actuator for engaging with an assembly depending from the rotor. The inter-engagement of the actuator and assembly effects a change in the angle of incidence of at least one blade of the rotor.

The interaction occurs when the assembly is aligned with the actuator. There can be multiple actuators, the multiple actuators being spaced circumferentially around the rotor shaft thereby to interact with the assembly at different circumferential positions relative to the rotor shaft. The interaction occurs when selected actuators are aligned with selected locations of the assembly, for instance, where the actuator engages the ring.

The actuator includes an arm that is movable between a position of repose and a position of inter-engagement with the assembly and wherein the degree of movement of the arm affects the degree of interaction with the assembly and the degree of change of angle of inclination of the at least one blade. The length of the arm relative to the length of the assembly from the location of anchoring the rotor to the shaft can affect the degree of interaction with the assembly and the degree of change of angle of inclination of the at least one blade. Furthermore, the size of the force exercised by the arm on the assembly can effect the degree of interaction with the assembly and the degree of change of angle of inclination of the at least one blade.

The stability of the helicopter system preferably continues to operate together with the applied control when the control is applied. The degree to which the control system is dominant over the stability system data determines the rate of change in position in the horizontal.

The actuator includes an arm that is movable between a position of repose and a position of inter-engagement with the assembly, the assembly including a ring transversally located about and movable with the rotor shaft and the actuator is located at a fixed location on the body.

The control is applied thereby to cause the blade to turn on the feather axis of the rotor blade, the control being effectively applied to the blade when an actuator is cyclically aligned relative to the blade thereby to affect the turning, preferably, only about the feather axis. This causes the incidence of at least one blade to vary cyclically.

The control is applied thereby to cause the blade to turn on the feather axis of the blade, the control being effectively applied selectively to the blade through a system to operate the control thereby to effect the angle of incidence of the blade periodically or at selected times, or at selected angles in the 360 degree rotation determined essentially by the position of the actuator on the body. There is selective interactive force or movement thereby to selectively change the blade angle of incidence in requisite response to the control.

The control selectively changes the blade angle of incidence in requisite response to the control, and periodically or at selected times, or at selected angles in the 360 degree rotation, determined essentially by the position of the actuator on the body. This permits the blade angle to be responsive to forces unrelated to the control.

The helicopter can be provided with an auxiliary stabilizer rotor which is driven by the shaft of the main rotor. The auxiliary rotor, which is two elongated members, can be provided with two vanes extending essentially in line with their longitudinal axis. Different formats and shapes of auxiliary rotors can be used and different weight applied as necessary.

The 'longitudinal' axis is seen in the sense of rotation of the main rotor, and is essentially parallel to the longitudinal axis of at least one of the rotor blades of the main rotor or is located within a relatively small acute angle with the latter blade axis. This auxiliary stabilizer rotor is provided in a swinging manner on an oscillatory shaft which is provided essentially transversal to the rotor shaft of the main rotor. The longitudinal axis of the stabilizer rotor is directed essentially transverse to the longitudinal axis of at least one of the rotor blades. The main rotor and the auxiliary rotor are connected to each other through a mechanical link, such that the swinging motions of the auxiliary rotor control the angle of incidence of at least one of the rotor blades of the main rotor.

The helicopter should meet the following requirements to a greater or lesser degree:

(a) it can return to a stable hovering position, in case of an unwanted disturbance of the flight conditions. Such disturbance may occur in the form of a gust of wind, turbulence, a mechanical load change of the body or the rotors, a change of position of the body as a result of an adjustment to the cyclic variation of the pitch or angle of incidence of the rotor blades of the main rotor or a steering of the tail rotor or the like with a similar effect; and (b) the time required to return to the stable position should be relatively short and the movement of the helicopter should be relatively small.

To this end, the disclosure concerns an improved helicopter including a body with a tail; a main rotor with blades which are driven by a rotor shaft and which are hinge-mounted to the rotor shaft by means of a joint. The angle between the surface of rotation of the main rotor and the rotor shaft may vary. A tail rotor is driven by a second rotor shaft, which is directed transversal to the rotor shaft of the main rotor.

The main rotor with blades is driven by a rotor shaft on which the blades are mounted. The auxiliary rotor is driven by the rotor shaft of the main rotor and is provided with elongated elements from the rotor shaft in the sense of rotation of the main rotor.

The auxiliary rotor is mounted in a swinging relationship on an oscillatory shaft and the swinging motion is relatively upwardly and downwardly about the auxiliary shaft. The auxiliary shaft is provided essentially transverse to the rotor shaft of the main rotor. The main rotor and the auxiliary stabilizer rotor are connected to each other by a mechanical link, such that the swinging motion of the auxiliary rotor controls the angle of incidence of at least one of the rotor blades of the main rotor.

The angle of incidence of the rotor in the plane of rotation of the rotor and the rotor shaft may vary; and an auxiliary rotor rotatable with the rotor shaft is for relative oscillating movement about the auxiliary rotor hinge. Different relative positions are such that the auxiliary rotor causes the angle of incidence of the main rotor to be different. A linkage between the main and auxiliary rotor causes changes in the position of the auxiliary rotor to translate to changes in the angle of incidence.

The rotor blades of the main rotor and the vanes of the auxiliary stabilizer rotor respectively are connected to each other with a mechanical linkage that permits the relative movement between the blades of the rotor and the vanes of the auxiliary rotor.

The rotor and stabilizer are interconnected. The rotor and stabilizer are also independent to move around the hinging lines as typically found in helicopter rotors. This can for example be feather or teether hinges.

Referring to FIGS. 35-45, there is an element 417 for adjusting the location of the center of gravity of the remote control toy helicopter 400. Represented in the figures by way of example, an element 417 may include a weight, a fin 425 and attachment means for slidable attachment along a longitudinal length of the helicopter 400. Element 417 allows a user to adjust the location of the center of gravity by moving the element 417 along the longitudinal length, thereby changing the velocity or speed of the helicopter 400.

The center of gravity (also called the center of mass) of a toy helicopter is designed such that the helicopter is hovering or slightly moving in a forward direction (<50 cm per second) while flying. The location of the center of gravity of the helicopter 400 is called the design CG. If the center of gravity is adjusted to be located in front of the design CG, the helicopter will fly at a greater forward velocity than a helicopter with a center of gravity located at the design CG would. If the center of gravity is adjusted to be located behind the design CG, the helicopter will fly at a slower forward velocity than a helicopter with a center of gravity located at the design CG or it may be static and hover in the air. In some cases, if the center of gravity is located too far behind the design CG, the helicopter 1 may fly backwards. Thus, the velocity of the helicopter 1 is proportional to the error between the design CG and the adjusted center of gravity.

A weight can be fixed to the fin 425 or the fin 425 can have a volume sufficient to provide the suitable mass. The fin 425 can be hung from a tail boom or boom 423 of the helicopter 400. Shown in FIGS. 35-37, the boom 223 is a thin rod with a substantially square shape cross section to which the fin 425 is slidably attached.

The fin 425 is movable along the longitudinal length by a user, however, during flight the fin 425 is held stationary in the location chosen by the user. This is due to friction between the attachment means and the boom 423. Thus, there is a preferably tight fit between the attachment means and the boom 423. It is tight enough essentially not to move during flight or inclination, but loose enough to be adjusted forwardly and backwardly by a user.

The fin 425 is attached to the boom 423 such that the fin hangs down from the boom 423. The fin 425 has a longitudinal dimension, a vertical dimension and a substantially thin thickness and a top edge. The longitudinal dimension can be about 1.5 times larger than the vertical dimension. The top edge engages the boom 423, and is substantially parallel to the boom 423 and substantially bears a majority of the weight of the element 417.

The attachment means of the fin 425 to the boom 423 can be a square-shaped ring complementary to the square cross shape of the boom 423, shown in FIG. 36, for substantially locking the fin 425 steady from swinging movement around the boom 423. The square-shaped ring that has four side surfaces. There is a top surface 427, a bottom surface 429 and two side surfaces 431 and 433. There can be a hole 435 in the surface 433. The hole 435 can be created by making three cuts in the form of a square and the hole 435 is made by making a fold along the edge to complete a square shape hole. The piece of the surface 433 is folded inward toward the center of the square shaped ring of the attachment means and creates the hole 435. This piece of the surface 433 that is folded inward frictionally engages the boom 423 and partially holds the element 417 in place during flight or inclination.

Alternatively, the attachment means of the fin 425 to the boom 423 can be a snap-fitted, injection-molded C-shaped clip or hook that allows the element 417 to optionally detach. In such an instance, the attachment means may include the top surface 427, the bottom surface 429 and side surface 433 while omitting side surface 431. In other instances, the attachment means can be a locking screw or any other fastener, clip or spring loaded mechanism that allows longitudinal movement of the fin 425 along the boom 423.

During flight, the main rotor 403 exerts a force on the fin 425 in the form of airflow on the movable fin 425. This force counteracts a portion of the turning movement induced by torque of the main rotor 403.

The center of gravity of the helicopter 400 is shifted according to the position of the element 417 along the longitudinal length of the helicopter. Thus, when the element 417 is in the forward position, the helicopter will have a greater forward velocity during flight than it would if the element 417 was in the rearward position or any other position there between.

In the forward position, the center of gravity is in front of the axis of the rotor shaft 411. With the center of gravity in front of the rotor shaft 411, the front of the helicopter 400 dips forward, the tail raises upward and there is a forward inclination of the rotor shaft 411 during flight that results in a forward velocity of the helicopter 400. A greater forward inclination of the rotor shaft 411 results in greater forward velocity.

When the element 417 is in the rearward position, the helicopter 400 will have a slower forward velocity, relative to the helicopter 400 with element 417 in the forward position, or may hover and remain static in the air. In the rearward position, the center of gravity is substantially in line with the axis of the rotor shaft 411. With the center of gravity in line with the rotor shaft 411, the main rotor 403 and the boom 110 are substantially parallel with the horizon resulting in the helicopter 400 hovering or having a substantially static velocity during flight. If the center of gravity 250 is located behind the rotor shaft 411, the helicopter 400 will have a backward component of velocity that conflicts with the laterally directed force of the tail rotor and result in an unstable configuration. Therefore, for a helicopter with a boom and a tail rotor, such as helicopter 400, it is critical to locate the element 417 in a position so that the center of gravity is in front of or in line with the rotor shaft 411. In other helicopters, such as tandem rotor helicopters, this is not necessarily the case.

If the element 417 is located at an intermediate position along the boom 423, the helicopter 400 will have a forward velocity that is between the forward velocity of the helicopter 400 with the element 425 in the forward position and the forward velocity of the helicopter 400 with the element 417 in the rearward position. Thus, the element 417 allows the user to adjust the helicopter 400 to a desired velocity.

The body 425 can be made of a material that has sufficient weight, such as a metal, or the body 425 can be made of plastic and sufficiently thick to achieve a weight of about 1 to about 15 percent, preferably about 3 to about 10 percent, of the weight of the helicopter 400.

In another embodiment, an element movable for changing the center of gravity of a toy helicopter can be mechanically adjusted, in accordance with the present disclosure. The element can be movable by a servo or a motor. The element can be a part of the helicopter, such as the battery or the element can be an additional piece of material that has weight or mass. This embodiment would allow a user to be able to remotely control the element's position relative to the center of gravity of the helicopter, thereby adjusting the center of gravity and controlling the helicopter's flight characteristics.

The element 417 can be utilized by and configured to adjust the center of gravity of any toy helicopter and thereby change the helicopter's velocity. Referring to FIGS. 1-12, the element 417 can be configured to slidably attach to tail 3 of helicopter 1. Referring to FIGS. 13-18, the element 417 can be configured to slidably attach to the tail 3 of a helicopter 1 that has a downwardly directed stabilizer 108 that extends along the length of the tail 3.

The present disclosure is not limited to the embodiments described as an example and represented in the accompanying figures. Many different variations in size and scope and features are possible. For instance, instead of electrical motors being provided, other forms of motorized power are possible. A different number of blades may be provided to the rotors. The element 417 may be attached to helicopter 400 along a dedicated center of gravity adjusting system that is not attached to the boom 423. A helicopter utilizing the element 417 may only have a single rotor and no auxiliary rotor and, in other instances and configurations, may not necessitate a tail rotor. The element 417 may be enlarged to incorporate a larger fin for counteracting a larger portion of the turning moment induced by torque of the main rotor. The shape of the body 401 and the element 417 can be configured into different shapes while still being complimentary in shape. In other instances, the body 401 and the element 417 may not be complimentary.

In one embodiment, there is an element 417 movable along a longitudinal length of a remote control toy helicopter 400. The element 417 comprises a body 425 for attachment to a helicopter 400. The body 425 is selectively movable to different operating positions along a longitudinal length of the helicopter 400 to change the center of gravity of helicopter 400. The body 425 is about 1 to about 15 percent, preferably about 3 to about 10 percent, of the weight of the helicopter 400. Selective movement of the body 425 along the longitudinal length changes the speed of the helicopter 400. The body 425 can be hung from a boom 423 of the remote control helicopter 400. The center of gravity of the helicopter 400 is shifted according to the position of the body 425 along the longitudinal length of the helicopter 400. The body 425 can be a fin, such that airflow from the main rotor 403 exerts pressure on the fin for counteracting a turning moment induced by torque of the main rotor 403. The fin can also be hung from a boom 423.

The body is selectively movable to different operating positions along the longitudinal length to change the center of gravity of the remote control toy helicopter. The body 425 may include an attachment for attaching the body 425 to the boom 423.

The body 425 may have an undercut substantially complimentary in shape to a portion of the body 401. The body 425 can be in the form of a movable fin and in a forward position is substantially located under the body 401. The boom 423 may include a downwardly directed stabilizer under the tail rotor 406 and, in a rearward position, the movable fin may overlap a portion of the downwardly directed stabilizer.

The helicopter of the disclosure in its different modes operates effectively indoors and is a relatively light weight structure. The body can be made by a suitable foamed type plastic material so at give light weight characteristics. The helicopter toy could be a tandem helicopter operating according to the system of the disclosure as a flying helicopter in one mode and as a car in another mode. The helicopter toy of the disclosure could have different numbers of wheels, for instance four or more.

The center of gravity of the helicopter should be between the points where the body rests on the floor or ground. This inhibits or prevents the helicopter at least in the car mode from tipping over, even in rest position. The center of gravity of a helicopter is usually somewhere close to the rotor axis. The wheels could be put anywhere, and the rotor shaft can be behind the rear wheels. Certain angles would change. Further the rear wheels could be the steering wheels, and if chosen, one or more of these wheels could be pivotable wheels.

In the configuration of the disclosure, the body is provided with three wheels. These three wheels can be made free turning for easier movement, or could be molded into the body. There could be any number of wheels.

It is intended to cover various modifications and similar arrangements included within the spirit and scope of the claims, the scope of which should be accorded the broadest interpretation so as to encompass all such modifications and similar structures. The present disclosure includes any and all embodiments of the following claims.

We claim:

1. A toy helicopter comprising a body; a motor in the helicopter, a battery for powering the motor, and a receiver for communicating signals between the motor and a separate remote controller, a main rotor with blades which is driven by a rotor shaft and which is hinge-mounted on this rotor shaft, such that the angle between the plane of rotation of the main rotor and the rotor shaft may vary; a control for moving the angle of incidence of at least one blade of the rotor relative to the angle of incidence of another blade of the rotor cyclically along at least part of a 360 degree rotation path around the rotor shaft, causing a variation in lift force of the blade along at least part of the rotation path and thereby cause the body to be urged in a relatively horizontal direction from a relative position of rest, and such that for first lift force developed by the main rotor, the helicopter is airborne, and including an element for permitting the helicopter to travel on a surface when the main rotor develops a second degree of lift force, and the main rotor having at least two propeller blades, wherein the propeller blades have a first longitudinal axis, and including an auxiliary rotor mounted such that rotor elements of the auxiliary rotor have a second longitudinal axis, and wherein the longitudinal axis of the rotor elements of the auxiliary rotor is located within an angle of 5 to 25 degrees, preferably approximately 10 degrees, with the longitudinal axis of one of the blades of the main rotor.

2. A helicopter of claim 1 wherein the rotor shaft is relatively forwardly tilted relative to vertical.

3. A helicopter of claim 1 wherein the element for permitting movement on the surface, selectively the ground or a floor which is relatively smooth, are wheels, and preferably at least three wheels arranged in spaced relationship with the body, the wheels being arranged to permit a stable relationship of the helicopter on the ground when in an at rest position.

4. A helicopter of claim 3 including a single front wheel and two rear wheels, the rear wheels being spaced apart.

5. A helicopter of claim 4 wherein the single front wheel is mounted relative to the body such that it is pivotable relative to a forward axis which extends between the front and the rear of the body.

6. A helicopter of claim 5 wherein the single front wheel is mounted relative to the body such that the pivot point is located ahead of the wheel, and a fork for supporting a wheel is inclined from the pivot point rearwardly towards an axle of the wheel.

7. A helicopter of claim 4 wherein the single front wheel is mounted relative to the body such that it is fixed relative to a forward axis which extends between the front and the rear of the body.

8. A helicopter of claim 7 wherein the single front wheel is mounted relative to the body such that the support point is located ahead of the wheel, and a fork for supporting a wheel is inclined from the support point rearwardly towards an axle of the wheel.

9. A remote control toy helicopter comprising:

a body having a longitudinal length;

a main motor and a battery for the main motor, the main motor being controllable by a controller remote from the body;

a battery for powering the motor;

a receiver for communicating signals between the motor and a separate remote controller;

a main rotor with propeller blades driven by the main motor, the motor driving a rotor shaft and the rotor being hinge mounted on the rotor shaft; and wherein there is a variation in lift force of the blade along at least part of the rotation path, thereby causing the body to be urged in a relatively horizontal direction from a relative position of rest, and being such that for first lift force developed by the main rotor, the helicopter is airborne, and including wheels for permitting the helicopter to travel on a ground surface when the main rotor develops a second degree of lift force, and the main rotor having at least two propeller blades, wherein the propeller blades have a first longitudinal axis, and including an auxiliary rotor mounted such that rotor elements of the auxiliary rotor have a second longitudinal axis, and wherein the longitudinal axis of the rotor elements of the auxiliary rotor is located within an angle of 5 to 25 degrees, preferably approximately 10 degrees, with the longitudinal axis of one of the blades of the main rotor.

10. A helicopter of claim 9 wherein the rotor shaft is relatively forwardly tilted relative to vertical.

11. A helicopter of claim 9 wherein there are at least three wheels arranged in spaced relationship with the body, the wheels being arranged to permit a stable relationship of the helicopter on the ground when in a at rest position.

12. A helicopter of claim 11 including a single front wheel and two rear wheels, the rear wheels being spaced apart.

13. A helicopter of claim 12 wherein the single front wheel is mounted relative to the body such that it is pivotable relative to a forward axis, which extends between the front and the rear of the body.

14. A helicopter of claim 13 wherein the single front wheel is mounted relative to the body such that the pivot point is located ahead of the wheel, and a fork for supporting a wheel is inclined from the pivot point rearwardly towards an axle of the wheel.

15. A helicopter of claim 11 wherein the single front wheel is mounted relative to the body such that it is fixed relative to a forward axis, which extends between the front and the rear of the body.

16. A helicopter of claim 15 wherein the single front wheel is mounted relative to the body such that the support point is located ahead of the wheel, and a fork for supporting a wheel is inclined from the support point rearwardly towards an axle of the wheel.

17. The toy helicopter of claim 11 including an element attached to the remote control toy helicopter, wherein the element is selectively movable to different operating positions along the longitudinal length of the toy helicopter to change the center of gravity of the remote control toy helicopter.

18. The toy helicopter of claim 9 including an element attached to the remote control toy helicopter, wherein the body is selectively movable to different operating positions along the longitudinal length of the toy helicopter to change the center of gravity of the remote control toy helicopter.

19. A remote control toy helicopter comprising a body, a motor and a battery for the motor, the motor being controllable by a controller remote from the body with a tail; a main rotor with at least two propeller blades, wherein the propeller blades define a plane of rotation of the main rotor, wherein the main rotor is driven by a rotor shaft, on which the propeller blades are mounted; a tail rotor driven by a second rotor shaft directed transversely to the rotor shaft of the main rotor; an auxiliary rotor driven by the rotor shaft of the main rotor in the rotational sense of the main rotor, the auxiliary rotor being mounted such that a first longitudinal axis of the auxiliary rotor is situated in an acute angle relative to a second longitudinal axis of one of the propeller blades of the main rotor, the acute angle being determined when viewed from above the plane of rotation, the auxiliary rotor having a further plane of rotation being spaced from the plane of rotation, the main rotor and the auxiliary rotor being linked with each other by a mechanical linkage, such that the auxiliary rotor is mounted in a swinging relationship on an oscillatory shaft provided essentially transversally to the rotor shaft of the main rotor and the swinging motion being relatively upwards and downwards around the oscillatory shaft, such that the swinging motion of the auxiliary rotor controls an angle of incidence of the propeller blades of the main rotor, and wherein the first longitudinal axis of the auxiliary rotor runs along a line of the auxiliary rotor which runs through the rotor shaft, and wherein the second longitudinal axis extends from the ends of the propeller blades towards the rotor shaft wherein the propeller blades of the main rotor are mounted pivotably on a joint formed by a spindle which is fixed on the rotor shaft of the main rotor wherein the spindle of the main rotor extends along the second longitudinal axis of the main rotor, and each propeller blade has an upper surface formed in the form of an upwardly convex curve, running from essentially a tip of the propeller blade towards the rotor shaft and wherein there is a variation in lift force of the blade along at least part of the rotation path and thereby cause the body to be urged in a relatively horizontal direction from a relative position of rest, and being such that for first lift force developed by the main rotor, the helicopter is airborne, and including wheels for permitting the helicopter to travel on a ground surface when the main rotor develops a second degree of lift force, and wherein the first longitudinal axis of the rotor elements of the auxiliary rotor in the sense of rotation R, is located within an angle of 5 to 25 degrees, preferably approximately 10 degrees, with the second longitudinal axis of one of the propeller blades of the main rotor.

20. A helicopter according to claim 19 wherein the auxiliary rotor is a rigid whole mounted pivotably around the oscillatory shaft.

21. A helicopter according to claim 19 wherein the main rotor is a unitary one-piece body.

22. A helicopter according to claim 19 wherein the propeller blades are essentially rigidly connected with each other.

23. A helicopter according to claim 19 wherein each of the propeller blades has a substantially convex upper surface along the second longitudinal axis, the upper surface being convex from a leading edge to a trailing edge of the blade, and wherein each propeller blade has a substantially concave lower surface along the second longitudinal axis and the lower surface being concave from the leading edge to the trailing edge of the blade throughout a substantial portion of the second longitudinal axis of the blade.

24. A helicopter of claim 1 wherein the control includes an actuator for engaging with an assembly depending from the rotor, the inter-engagement of the actuator and assembly effecting a change in the angle of incidence of at least the one blade of the rotor, or wherein at least one of the actuators is non-interfering with the rotor, or with the control assembly being in a position of rest relative to the actuator, or there being no command from the actuator to interact with the assembly, the helicopter retains relative stability.

25. A helicopter of claim 1 wherein the interaction occurs when the assembly is in alignment with the actuator whereby the actuator engages a ring associated with the assembly.

26. A helicopter of claim 25 wherein the actuator includes an arm that is movable between a position of repose and a position of inter-engagement with the assembly, the assembly including a ring transversally located about and movable with the rotor shaft, and the actuator or multiple actuators are located at a fixed location on the body.

27. A helicopter of claim 25 wherein the control is applied thereby to cause the blade to turn on a feather axis of the rotor blade, the control being effectively applied to the blade when an actuator is aligned relative to the blade thereby to effect the turning about the feather axis.

28. A helicopter comprising a body with a tail; a main rotor with blades which are driven by a rotor shaft and which are hinge-mounted on this rotor shaft, such that the angle between the plane of rotation of the main rotor and the rotor shaft may vary; a tail rotor which is driven by a second rotor shaft directed transversally to the rotor shaft of the main rotor, an auxiliary rotor driven by the rotor shaft of the main rotor and provided with two vanes extending essentially in a line with their longitudinal axis in the sense of rotation of the main rotor is essentially parallel to the longitudinal axis of at least one of the rotor blades of the main rotor or is at a relatively small acute angle relative to the axis, the auxiliary rotor being mounted in a swinging relationship on an oscillatory shaft which is provided essentially transversally to the rotor shaft of the main rotor and being directed essentially transversally to the longitudinal axis of the vanes, and the main rotor and the auxiliary rotor are connected to each other by a mechanical link, such that the swinging motion of the auxiliary rotor controls the angle of incidence of at least one of the rotor blades of the main rotor, and a control for moving the angle of incidence of at least one blade of the rotor cyclically along at least part of a 360 degree rotation path around a rotor shaft, causing a variation in lift force of the blade along the rotations path and thereby cause the body to be urged in a relatively horizontal direction from a relative position of horizontal rest, the relative position of horizontal rest being a relatively hovering position above a ground level, wherein there is a variation in lift force of the blade along at least part of the rotation path and thereby cause the body to be urged in a relatively horizontal direction from a relative position of rest, and being such that for first lift force developed by the main rotor, the helicopter is airborne, and including wheels for permitting the helicopter to travel on a ground surface when the main rotor develops a second degree of lift force, and wherein the longitudinal axis of the elongated elements of the auxiliary rotor in the sense of rotation is located within an angle of about 5 to 25 degrees with the longitudinal axis of one of the rotor blades of the main rotor.

* * * * *